US006246181B1

(12) United States Patent
Naruo et al.

(10) Patent No.: US 6,246,181 B1
(45) Date of Patent: Jun. 12, 2001

(54) DISCHARGE LAMP LIGHTING DEVICE

(75) Inventors: Masahiro Naruo, Katano; Masahito Ohnishi, Kobe; Kazuhiro Hori, Kadoma; Takashi Kanda, Hirakata, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/507,690

(22) Filed: Feb. 22, 2000

(30) Foreign Application Priority Data

Feb. 23, 1999 (JP) ..... 11-045411

(51) Int. Cl.[7] ..... H05B 37/00
(52) U.S. Cl. ..... 315/209 R; 315/224; 315/307
(58) Field of Search ..... 315/209 R, 209 CD, 315/240, 241 R, 224, 225, 244, 291, 307

(56) References Cited

U.S. PATENT DOCUMENTS 5,134,344 * 7/1992 Vos et al. ..... 315/224
5,949,199 * 9/1999 Qian et al. ..... 315/307
6,118,224 * 9/2000 Murakami et al. ..... 315/209 R

FOREIGN PATENT DOCUMENTS 10-14257 1/1998 (JP) .

* cited by examiner

*Primary Examiner*—Don Wong
*Assistant Examiner*—Wilson Lee
(74) *Attorney, Agent, or Firm*—Burns, Doane, Swecker & Mathis, LLP

(57) ABSTRACT

A discharge lamp lighting device includes a rectifier, a first diode connected at the anode in forward direction to a positive polarity output terminal of the rectifier, a smoothing capacitor connected between the cathode of the first diode and a negative polarity output terminal of the rectifier, a second diode connected at the anode in forward direction to the cathod of the first diode, a pair of switching elements connected in series between the cathode of the second diode and the negative polarity output terminal of the rectifier, a first capacitor connected in parallel to one of the first diode and the rectifier, a second capacitor connected in parallel to the second diode, and a control circuit for controlling ON/OFF operation of these switching elements, and a transformer having a primary winding n11 connected between a junction point of the pair of switching elements and one of output terminals of the rectifier and a secondary winding connected to a load circuit including a discharge lamp, and their arrangement can reduce peak factor of currents flowing to the load circuit and any loss occurring at the switching elements.

19 Claims, 52 Drawing Sheets

Iin
Vs
AC
DB
Vc10
C10
Vc11
C11
D11
IT11
VT11
n11
n12
T11
FL
C111
11
Q1
IQ1
Q2
IQ2
VQ1
VQ2
D12
C12
Vc12
CONTROL CIRCUIT
10
Q1
Q2

Iin
Vs
AC
DB
Vc10
C10
Vc11
C11
D11
ITII
VTII
n11
n12
TII
Vc12
C12
D12
Q1
IQ1
VQ1
CP1
Q2
IQ2
VQ2
FL
CIII
II
Q1
Q2
CONTROL CIRCUIT
10

DISCHARGE LAMP LIGHTING DEVICE

TECHNICAL BACKGROUND OF THE INVENTION

This invention relates to a discharge lamp lighting device which rectifies and smoothes AC power into DC power, and supplies a high frequency power to a load circuit including a discharge lamp by converting the DC power thus obtained through the rectification and smoothing into a high frequency voltage.

DESCRIPTION OF RELATED ART

A known example of the discharge lamp lighting device of the kind referred to has been disclosed in U.S. patent application Ser. No. 09/042,555, in which a circuit is formed to include a rectifier for full-wave rectification of AC source power, and to connect a capacitor of a relatively small capacity across output terminals of the rectifier. Further, a smoothing capacitor and a series circuit of a pair of first and second transistors connected in parallel with the smoothing capacitor are provided, while a low potential side terminal of the smoothing capacitor is connected to a low potential side DC output terminal of the rectifier. Across a high potential side DC output terminal of the rectifier and a junction point the pair of transistors, a primary winding of a transformer is connected. A load circuit is connected to a secondary winding of the transformer, which load circuit comprises such discharge lamp as a fluorescent lamp having filaments connected at respective one end across the secondary winding of the transformer, and a preheating and resonating capacitor connected across the other non-discharge lamp lighting device side ends of the filaments of the lamp, so that a resonance circuit is constituted by a leakage inductance of the transformer and the preheating, resonating capacitor. Further, the pair of transistors comprise bipolar transistors, and a diode is connected in inverse parallel to each of these transistors, which transistors are provided to be alternately turned ON and OFF by means a control circuit (not shown) at a sufficiently higher frequency than a power source frequency.

Referring to the operation in stationary state of this known device, the smoothing capacitor is charged in the stationary state, so that, as the first transistor turns ON, there flows a current through a path including the smoothing capacitor, the first transistor, the primary winding of the transformer, the capacitor connected across the output terminals of the rectifier and the smoothing capacitor, and a power is supplied through the transformer to the load circuit, upon which a voltage across the smoothing capacitor is caused to increase due to its resonance. As the first transistor turns OFF, an energy accumulated in the primary winding of the transformer is discharged, the current continues to flow through a path including the transformer, the capacitor connected across the output terminals of the rectifier, the diode and the transformer, and the voltage across the capacitor connected across the output terminals of the rectifier further increases.

As the second transistor turns ON next, a resonance action of the leakage inductance of the transformer with the preheating and resonating capacitor and the capacitor connected across the output terminals of the rectifier causes a resonance current to flow through a path including the capacitor across the output terminals of the rectifier, the transformer, the second transistor and the capacitor across the output terminals of the rectifier, upon which the voltage across the capacitor connected across the rectifier starts decreasing. As this voltage becomes lower than the DC output voltage of the rectifier, an input current from the AC power source is drawn in, and the current flows through a path including the AC power source, the rectifier, the transformer, the second transistor, the rectifier and the AC power source. As the second transistor turns OFF, the current continues to flow through a path including the AC power source, the rectifier, the transformer, one of the diodes, the smoothing capacitor, the rectifier and the AC power source, and the initial state restores as the first transistor turns ON.

Now, in the circuit of this kind for providing the high frequency power to the load circuit, it has been generally taken a measure of inserting a high-frequency blocking filter circuit between the AC power source and the rectifier, in order to prevent any high frequency component from being mixed into the AC source power. With the use of such filter circuit, the input current from the AC power source is made substantially proportional to the AC source power voltage.

As to an input current waveform, the capacity of the capacitor connected across the output terminals of the rectifier will be an important factor. When the voltage across the smoothing capacitor becomes large in the amplitude, for example, the polarity is inverted in a period in which the input current flows from the AC power source to the high frequency blocking filter, and a remarkable noise occurs. Further, when the voltage across the smoothing capacitor becomes small in the amplitude, there occurs a quiescent period in the input current to the high frequency blocking filter. In either event, the noise is caused to be mixed with the AC source power, and the capacity of the capacitor connected across the output terminals of the rectifier is properly set, whereby not only the higher harmonics of the input current can be reduced but also the input power factor can be elevated.

In another example shown in Japanese Patent Laid-Open Publication No. 10-14257, there has been suggested a discharge lamp lighting device in which a second impedance element is connected between a junction point of an output terminal of the rectifier with a diode and a series circuit of a coupling capacitor and an inductor, and a load circuit is connected through a diode across the second impedance.

In this known device, however, the load current becomes high in troughs and low at crests of pulsating current. In order to lower the crest factor of the load current, in this case, it is required to increase the voltage of the smoothing capacitor, and required costs for manufacturing the device are increased by required measure for increasing the withstand voltage of the smoothing capacitor. Upon turning ON of the other transistor, the resonating current is caused to be superposed on the input current, so that a current flowing through the transistor at the moment when the other transistor turns OFF will be large, so as to be remarkably larger particularly at the pulsation crests where the input current reaches its peak. For this reason, there arises a problem that the switching loss at the other transistor is increased due to increments in the voltage and switching current of the smoothing capacitor, so as to lower the circuit efficiency.

SUMMARY OF THE INVENTION

An object of the present invention is to provide a discharge lamp lighting device which generates less higher harmonics in the input current, renders the crest factor of the current flowing to the load circuit to be small even when the voltage of the smoothing capacitor is low, and reduces the loss at the switching elements.

According to the present invention, the above object can be accomplished by means of a discharge lamp lighting device comprising a rectifier for rectifying an AC power into a DC power, first diode connected at one end in forward direction to one of output terminals of the rectifier, a smoothing capacitor connected between the other end of the diode and the other output terminal of the rectifier, second diode connected at one end in forward direction to the other end of the first diode, first and second capacitors connected respectively in parallel to the first and second diodes, a pair of switching elements connected in series between the other end of the second diode and the other output terminal of the rectifier, third and fourth diodes connected respectively in inverse parallel to each of the pair of the switching elements, a load circuit including a discharge lamp, and an inductor element connected between a junction point of the pair of the switching elements and one of the output terminals of the rectifier and across the discharge lamp in the load circuit.

According to the foregoing device, the crest value of an output voltage is caused to be substantially constant by voltages generated at the first and second capacitors, so as to render the crest factor of the output current to be smaller, and it is made possible to reduce the loss at the switching elements.

Other objects and advantages of the present invention shall be made clear in the following description of the invention detailed with reference to preferred embodiments shown in accompanying drawings.

Figure 1:
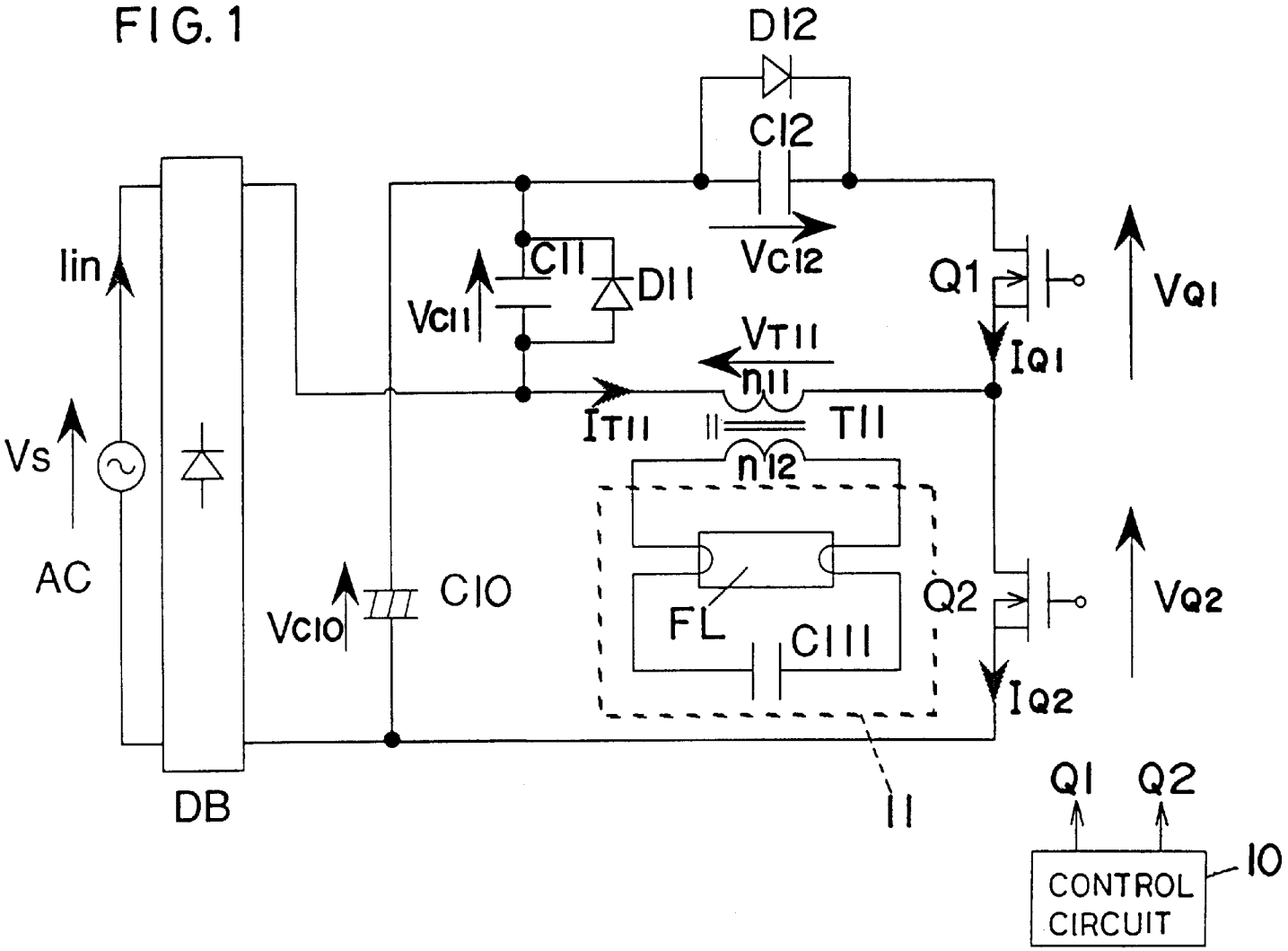
FIG. 1 is a schematic circuit diagram showing an embodiment of the discharge lamp lighting device according to the present invention.

While the present invention shall now be described with reference to the respective embodiments shown in the drawings, it should be appreciated that the intention is not to limit the invention only to these embodiments but rather to include all alterations, modifications and equivalent arrangements possible within the scope of appended claims.

DETAILED DESCRIPTION OF THE PREFERRED EMBODIMENTS

Referring to FIG. 1, a discharge lamp lighting device according to the present invention comprises a rectifier DB for full-wave rectification of an AC power from an AC power source AC into a DC power, first diode D11 connected at the anode in forward direction to an output terminal in positive polarity of the rectifier DB, a smoothing capacitor C10 connected between the cathode of the first diode D11 and the other output terminal in negative polarity of the rectifier DB, second diode D12 connected at the anode in forward direction to the cathode of the first diode D11, a pair of first and second switching elements such as FET's Q1 and Q2 connected in series between the cathode of the second diode D12 and the negative polarity output terminal of the rectifier DB, a control circuit 10 for controlling ON/OFF operation of the FET's Q1 and Q2, a transformer having a primary winding n11 connected between a junction point between the FET's Q1 and Q2 and the positive polarity output terminal of the rectifier DB and a secondary winding n12 to which a load circuit 11 is connected, and first and second capacitors C11 and C12 respectively connected in parallel to each of the first and second diodes D11 and D12.

The foregoing FET's Q1 and Q2 may be, for example, MOSFET's each of a structure having the source and substrate mutually connected and a parasitic diode in which the cathode and anode are inverse connected to the drain and source. Here, the control circuit 10 operates the first and second FET's Q1 and Q2 to alternately turn ON and OFF at an operating frequency sufficiently higher than the frequency of the AC power source AC. That is, the switching frequency is so set as to be effective to render the voltage of the AC power source AC regarded constant during 1 cycle.

Further, the load circuit 11 comprises such discharge lamp FL as a fluorescent lamp having a pair of filaments connected at their one end to both ends of the secondary winding n12 of the transformer T11, and a preheating and resonating capacitor C111 connected across the other ends of the pair of filaments. The transformer T11 is a leakage transformer, and the arrangement is so made that a resonance circuit will be formed by a leakage inductance of this transformer T11 and the capacitor C111.

Figure 7:
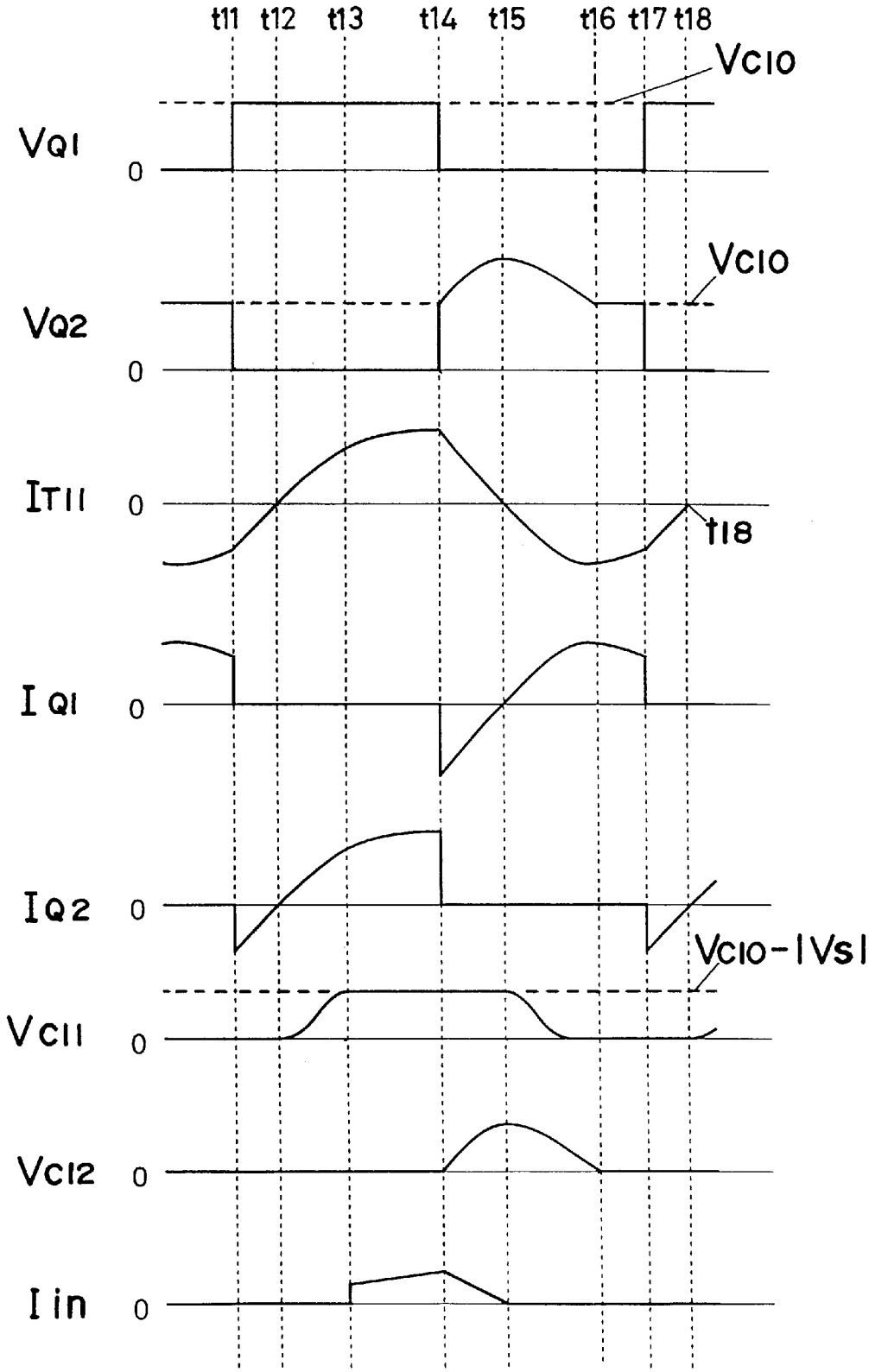
FIGS. 7 and 8 are waveform diagrams showing signals at various points in the circuit during the operation of the device shown in FIG. 1.
Figure 8:
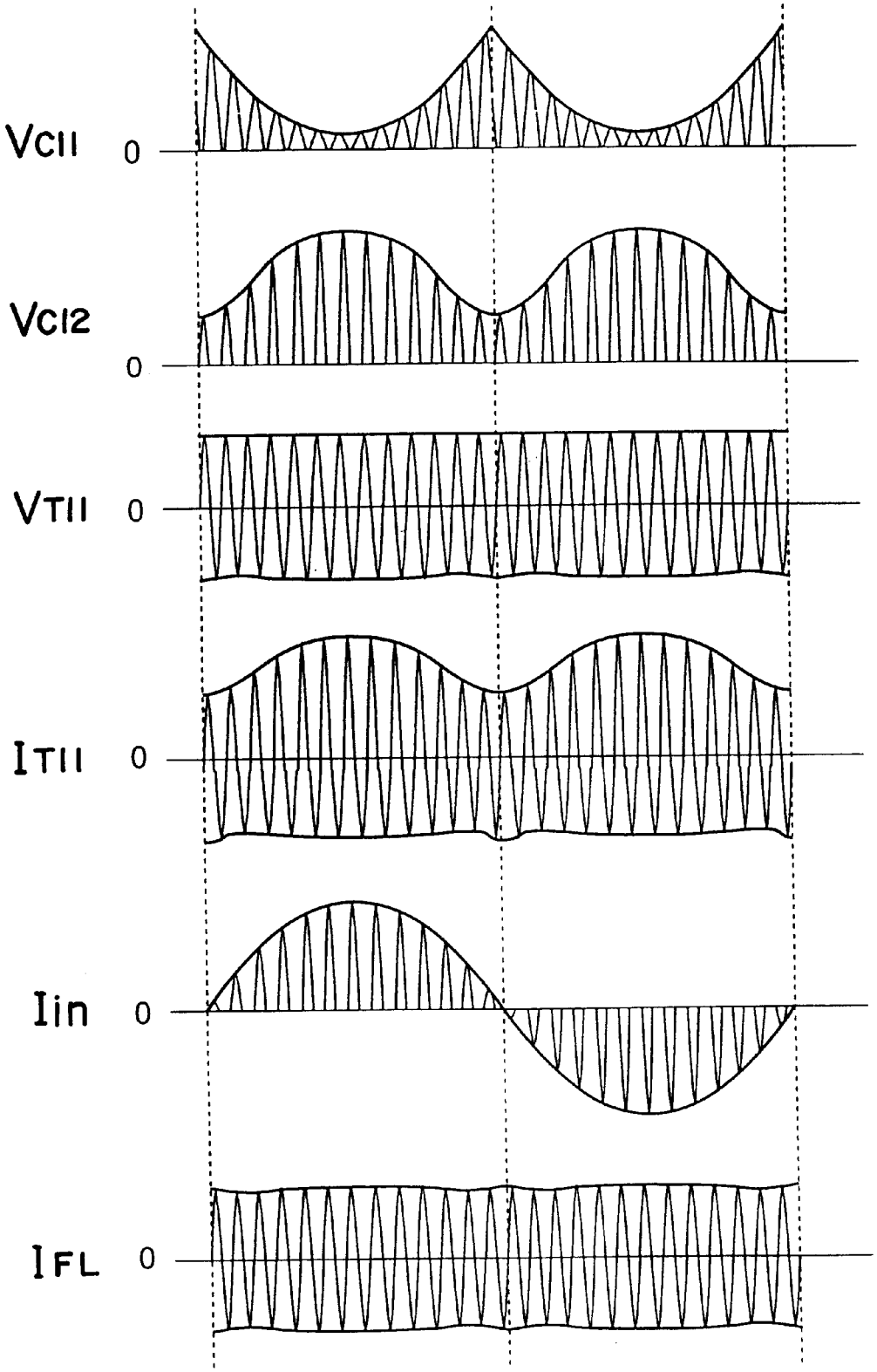

Next, the circuitry operation of the present discharge lamp lighting device of the above arrangement shall be described with reference to FIGS. 2–8. Here, a time t11 in FIG. 7 denotes ON time of the second FET Q2, and voltages VQ1, VQ2, VC11 and VZ12 and currents $I_{T11}$, IQ1, IQ2 and Iin in FIG. 7 are respectively corresponding to signals of the same codes shown in FIG. 1. Similarly, voltages VC11, VC12 and VT11 and currents IT11 and Iin in FIG. 8 are corresponding to signals of the same codes shown in FIG. 1. Further, a current IFL in FIG. 8 denotes the current flowing to the discharge lamp FL.

Figure 2:
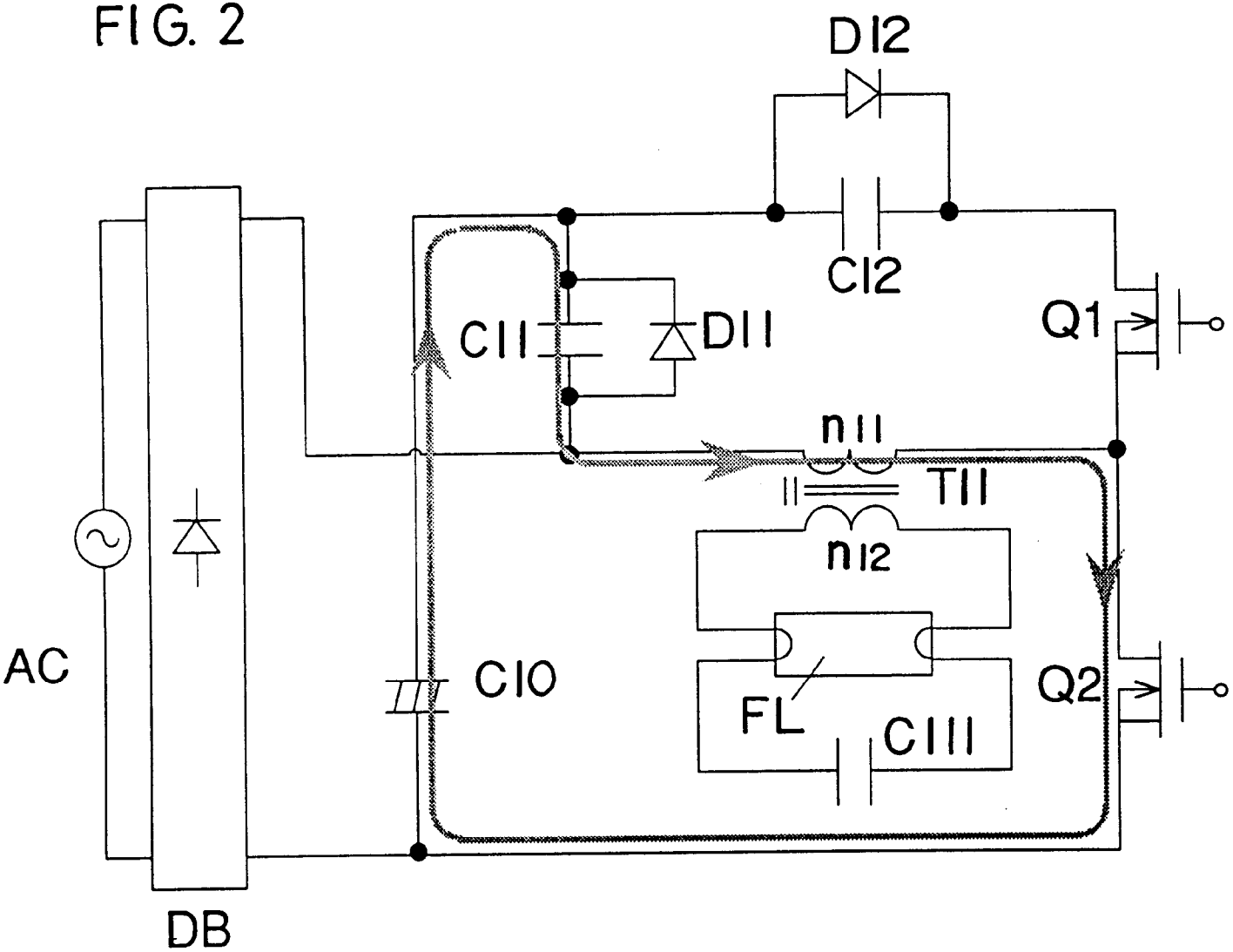
FIGS. 2–6 are explanatory circuit diagrams similar to FIG. 1 for the operation of the device shown in FIG. 1.

When a time t12 shown in FIG. 7 is reached in the stationary state after charging of the capacitor C10, the current IT11 flows through a path from the capacitor C10 through the capacitor C11, primary winding n11 and second FET Q2 and back to the capacitor C10, as shown by arrows in FIG. 2, so that the capacitor C11 will be charged by the capacitor C10 used as a power source and, as the voltage VC11 thereof increases, a power is supplied through the transformer T11 to the load circuit 11.

Figure 3:
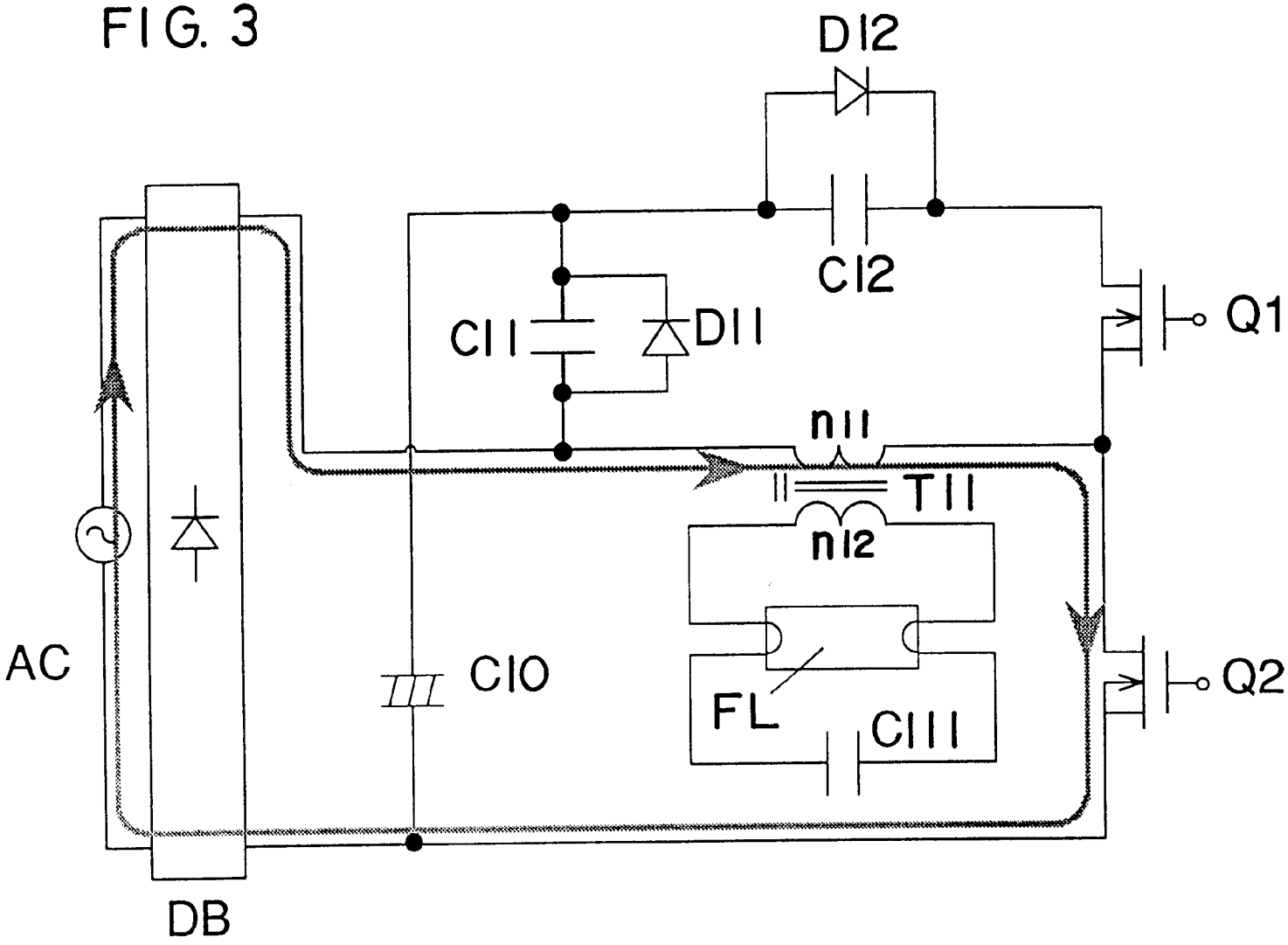

Thereafter, as the voltage VC11 of the capacitor C11 increases to a differential voltage (VC10–|Vs|) between the voltage VC10 of the capacitor C10 and an output voltage |Vs| of the rectifier DB (at time t13 in FIG. 7), the current IT11 is made to flow through a path of the AC power source AC, rectifier DB, primary winding n11, FET Q2 and AC power source AC, as shown by arrows in FIG. 3, and the input current Iin is drawn from the AC power source AC into the present discharge lamp lighting device. Here, it is seen from FIG. 7 that, in a period in which FET's Q1 and Q2 repeat their ON and OFF just once, there exists a period (from time t13 to time t15) in which the input current Iin is drawn from the power source AC into the device.

Figure 4:
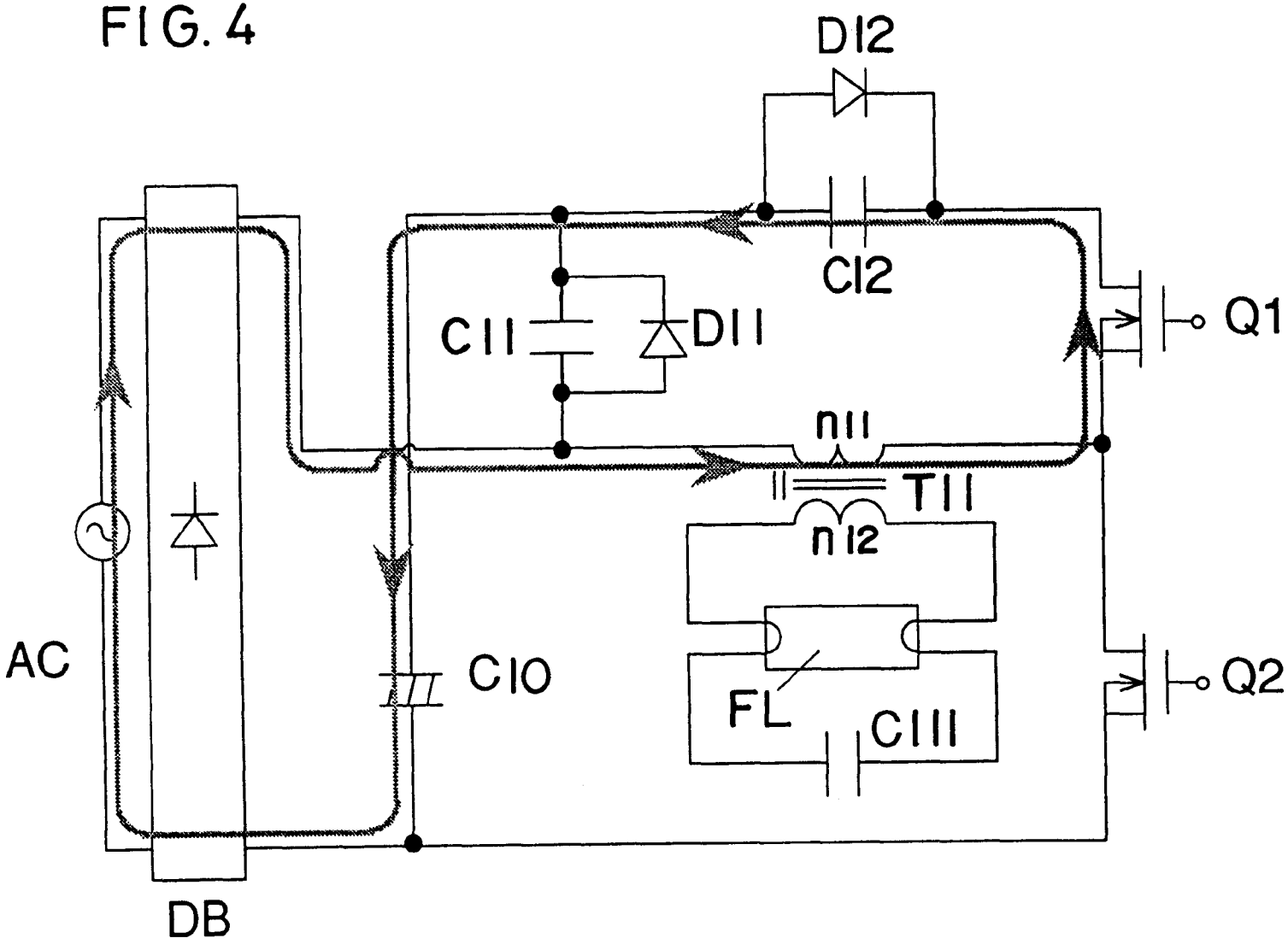

As FET Q2 turns OFF (at time t14 in FIG. 7), the transformer T11 in which an energy has been accumulated with the current flowed through the primary winding n11 and the AC power source AC are to act as a power source, and the current IT11 flows through a path, as shown by arrows in FIG. 4, of the power source AC, rectifier DB, primary winding n11, parasitic diode of FET Q1, capacitor C12, capacitor C10, rectifier DB and power source AC, and the capacitors C10 and C12 are charged while drawing the input current Iin into the device, upon which the voltage VC12 of the capacitor C12 is caused to increase, as shown in FIG. 7 by means of a resonation of the capacitor with the leakage inductance of the transformer T11, and FET Q1 turns ON.

Figure 5:
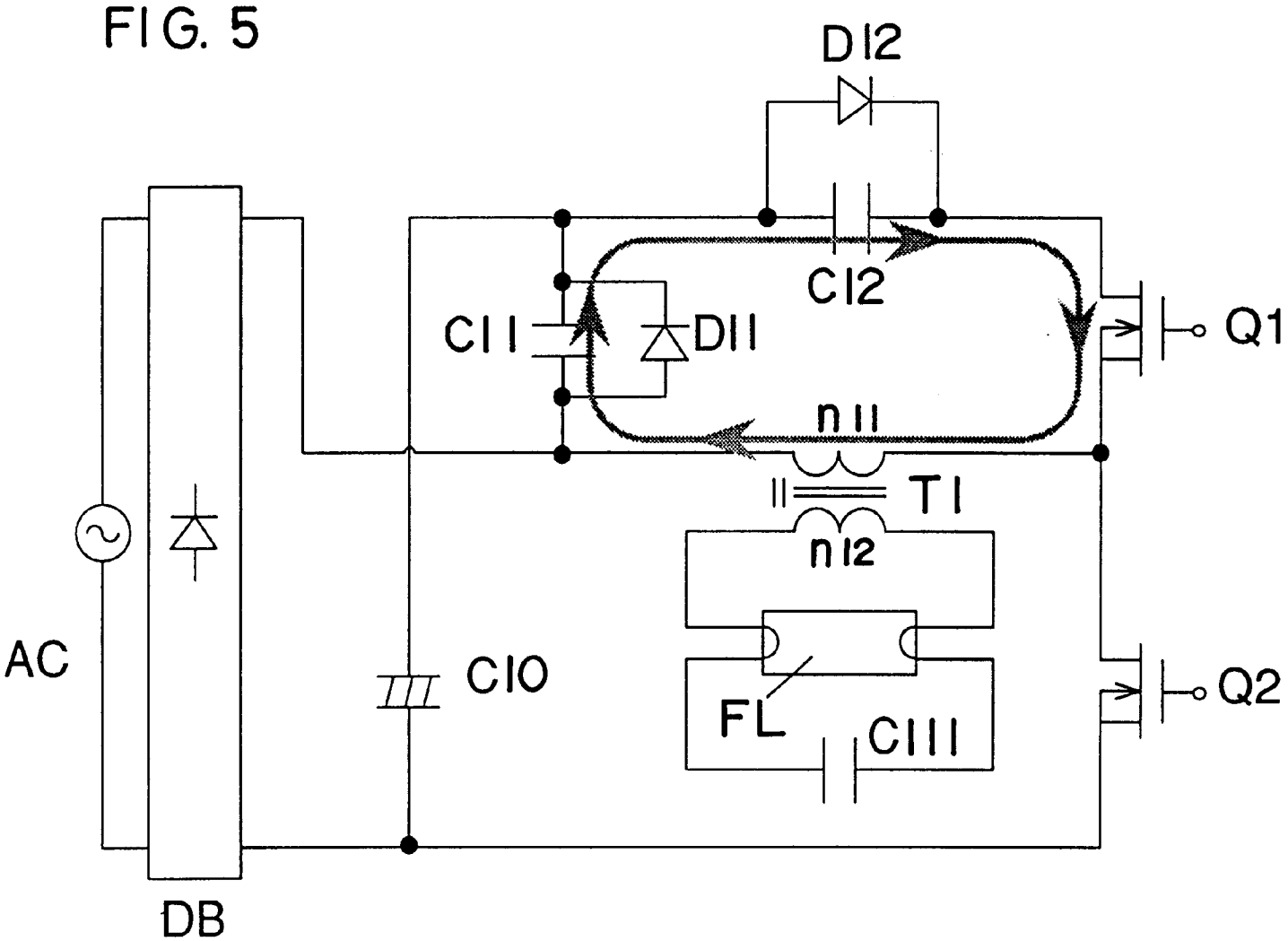
Figure 6:
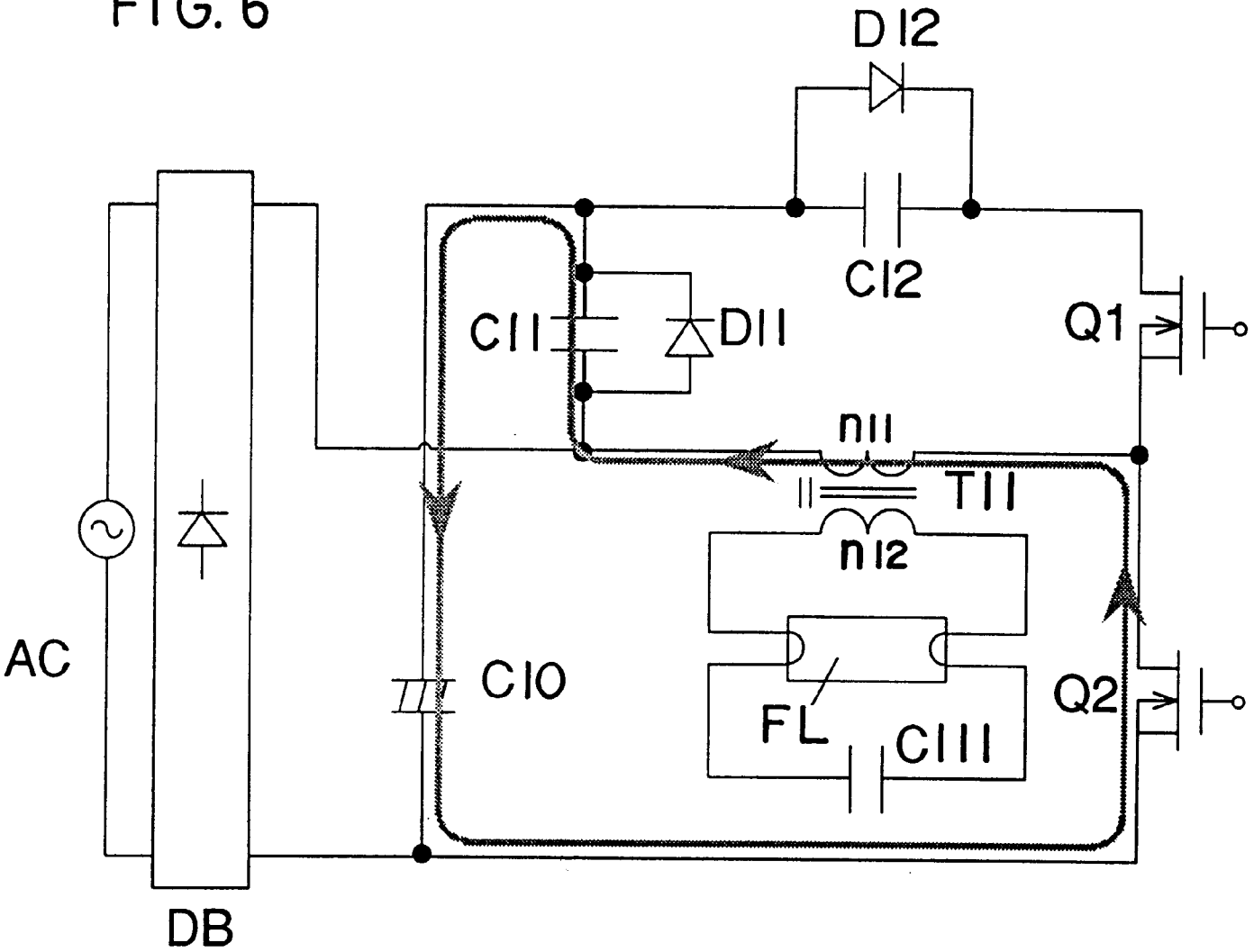

Upon the conduction of FET Q1, the resonation of the leakage inductance of the transformer T11 with the respective capacitors C11, C12 and C111 causes a resonance current to flow, as shown by arrows in FIG. 5, through a path of the capacitor C11, capacitor C12, FET Q1, primary winding n11 and capacitor C11. Thereafter, the voltages VC11 and VC12 of the capacitors C11 and C12 start decreasing (time t15 in FIG. 7), and their energy will be supplied through the transformer T11 to the load circuit 11, upon which the current flowing to the primary winding n11 is inverse directional to that upon turning ON of FET Q2, so that an alternating high frequency voltage will be applied to the load circuit 11.

Thereafter, as the voltages VC11 and VC12 of the capacitors C11 and C12 become zero (time t16 in FIG. 7), the diodes D11 and D12 connected respectively in parallel to each of these capacitors C11 and C12 are made ON, to continue the foregoing resonance current to flow. As FET Q2 turns OFF (time t17 in FIG. 7), a current flows through a path of, as shown by arrows in FIG. 6, the primary winding n11, capacitor C11, capacitor C10, parasitic diode of FET Q2 and primary winding n11, and the energy accumulated in the transformer T11 is discharged. Upon completion of this discharge of the energy out of the transformer T11 (time t18), the circuit state at time t12 of FIG. 2 restores.

With the foregoing circuit operation repeated periodically, the high frequency power is supplied to the load circuit 11. That is, waveforms of the foregoing main signals observed for one cycle of the AC power source AC will be as shown in FIG. 8.

Here, as seen in FIG. 8, the voltage VC11 of the first capacitor C11 increases and decreases sinusoidally with the sinusoidal increment and decrement of the AC source voltage Vs, and the voltage VT11 applied to the primary winding n11 is made to have a substantially constant fluctuation level (amplitude) by the above voltage VC11 as well as the voltage VC12 of the second capacitor C12 which also increases and decreases similar to the sinusoidal increment and decrement of the source voltage Vs. As a result, the current IFL which flows to the load circuit 11 on the secondary winding side is made small in the crest factor.

According to such foregoing embodiment as in FIG. 1, it is possible to reduce the crest factor of the current to the load circuit 11 even without increasing the voltage of the smoothing capacitor C10. Further, as the voltage of the second capacitor C12 is superposed on the voltage of the smoothing capacitor C10, the voltage of the capacitor C10 can be set to be lower. Further, as the voltage of the second capacitor C12 increases in resonating manner as shown in FIG. 7, the voltage applied at OFF time to the second FET Q2 will be equal to the voltage of the smoothing capacitor C10, and it is possible to reduce the switching loss by the extent to which the voltage of the smoothing capacitor C10 is set lower. While in the arrangement of FIG. 1 no filter circuit is provided on the input side, a provision of the filter circuit for high-frequency blocking between the AC power source AC and the rectifier DB in accordance with general known arrangement will prevent any entry of the high frequency component into the AC power source from occurring.

As has been described, the embodiment of FIG. 1 allows the crest factor of the output current to the load circuit 11 as well as the switching loss to be further decreased while lowering the voltage of the smoothing capacitor C10 than in the known arrangements, and it is possible to improve the circuit efficiency and to reduce manufacturing costs.

Figure 9:
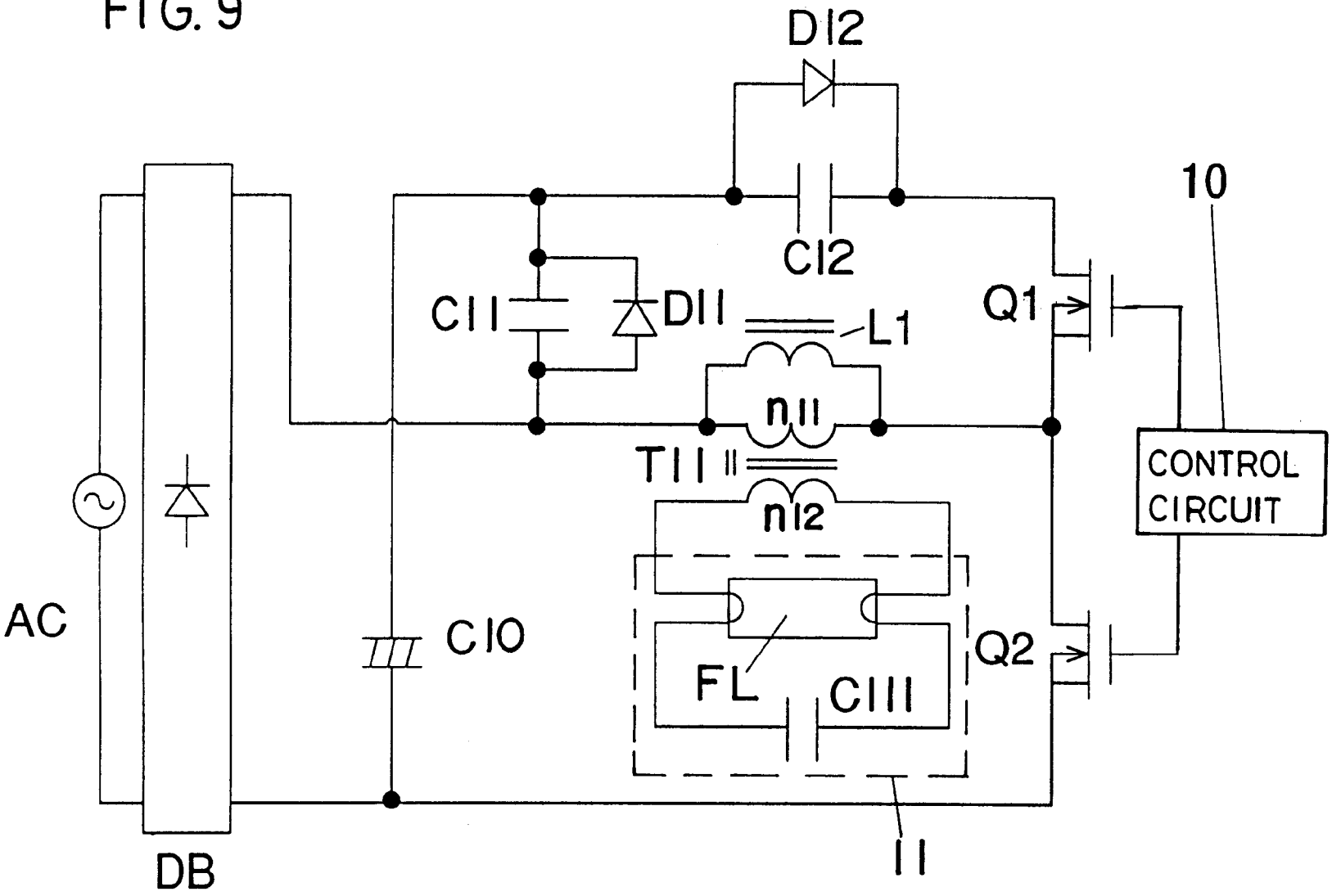
FIGS. 9–12 are schematic circuit diagrams showing respectively other embodiments of the discharge lamp lighting device according to the present invention.

FIG. 9 shows in a schematic circuit diagram the discharge lamp lighting device in another embodiment according to the present invention, details of which shall be described in the following, whereas the device in this embodiment is arranged in the same manner as in the device of the foregoing embodiment of FIG. 1 except for a further provision of an inductor L1 connected in parallel to the primary winding n11 of the transformer T11.

When an equivalent inductance of the primary side exciting inductance of the transformer T11 and the inductor L1 are set to be substantially equal to the primary side exciting inductance of the transformer T11 in the foregoing embodiment of FIG. 1, the circuit operation of the discharge lamp lighting device in the present embodiment will be substantially the same as that in the embodiment of FIG. 1. Consequently, the embodiment of FIG. 9 allows the same effect as in the embodiment of FIG. 1 to be realized.

Figure 10:
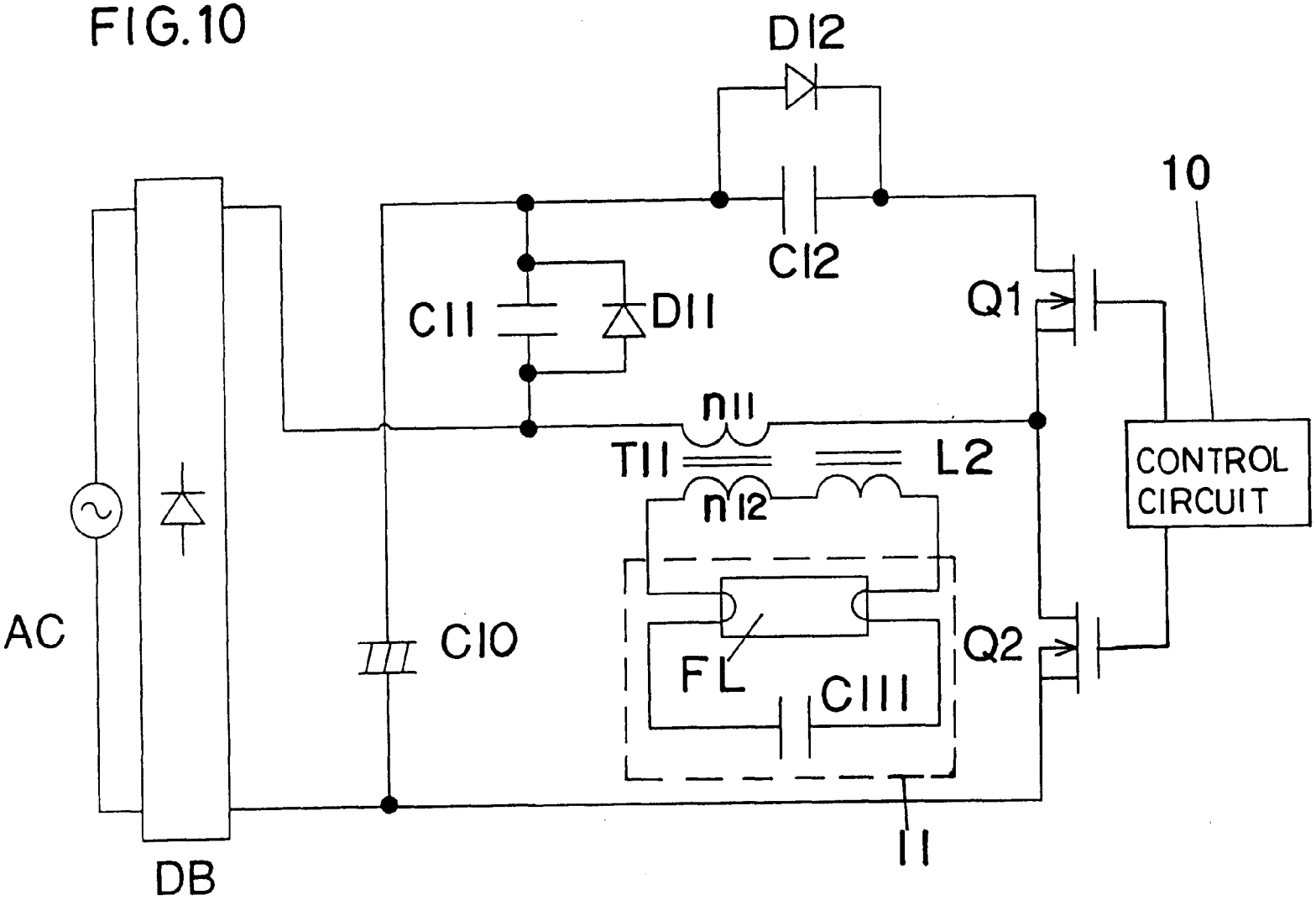

FIG. 10 shows in a schematic circuit diagram of the discharge lamp lighting device in still another embodiment of the present invention, in which the device generally comprises a rectifier DB, capacitors C10–C12, diodes D11 and D12, FET's Q1 and Q2, transformer T11 and control circuit 10, in the similar manner to the embodiment of FIG. 1, while the transformer T11 is additionally provided with an inductor L2 connected in series to the secondary winding n12, and the load circuit 11 is connected across the secondary winding n12 and inductor L2.

Figure 11:
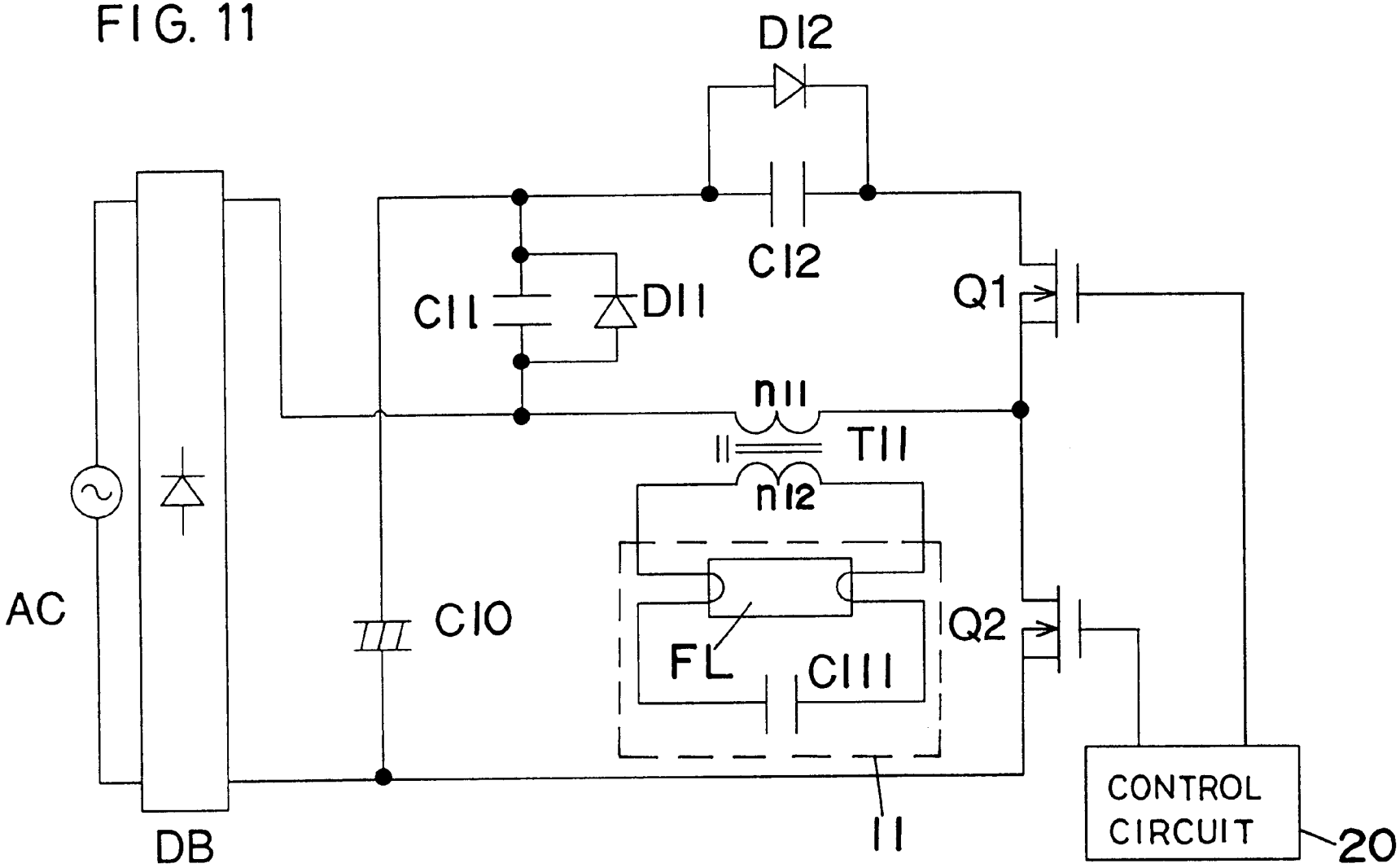

In this case, the inductor L2 can be employed in place of the leakage inductance of the transformer T11 in the embodiment of FIG. 1. Therefore, the device in the present embodiment attains substantially the same circuit operation and the same effect as in the embodiment of FIG. 1. FIG. 11 is a schematic circuit diagram of the discharge lamp lighting device in another embodiment according to the present invention, which also comprises the rectifier DB, capacitors C10–C12, diodes D11 and D12, FET's Q1 and Q2, and transformer T11, in the same manner as in the embodiment of FIG. 1, while the control circuit 20 is provided for ON/OFF control of FET's Q1 and Q2 for modifying at least one of the switching frequency and ON-duty, to be different in this respect from the embodiment of FIG. 1.

Here, it becomes possible to adjust the supplied electric energy to the load circuit 11 to a desired value, by properly modifying at least one of the switching frequency, ON period, ON duty ratio and so on with respect to FET's Q1 and Q2. Provided, for example, that the control circuit 20 controls the ON/OFF operation so as to shorten the ON period of the second FET Q2, then the input current Iin drawn from the AC power source AC can be reduced. Further, when the control circuit 20 performs the control so that the ON period ratio in 1 cycle of FET Q2 will be less at the time of preceding preheating, starting or the like in which the discharge lamp FL consumes less energy, it becomes possible to control any increment in the voltage of the smoothing capacitor C10.

According to the embodiment of FIG. 11, consequently, the preceding preheating, starting and lighting are made controllable. It is also made possible to adjust the supplied energy to the load circuit, that is, a dimming lighting of the discharge lamp, and further to prevent such circuit elements as FET and the like from being damaged by any increment in the DC voltage due to fluctuation in consumed energy.

Figure 12:
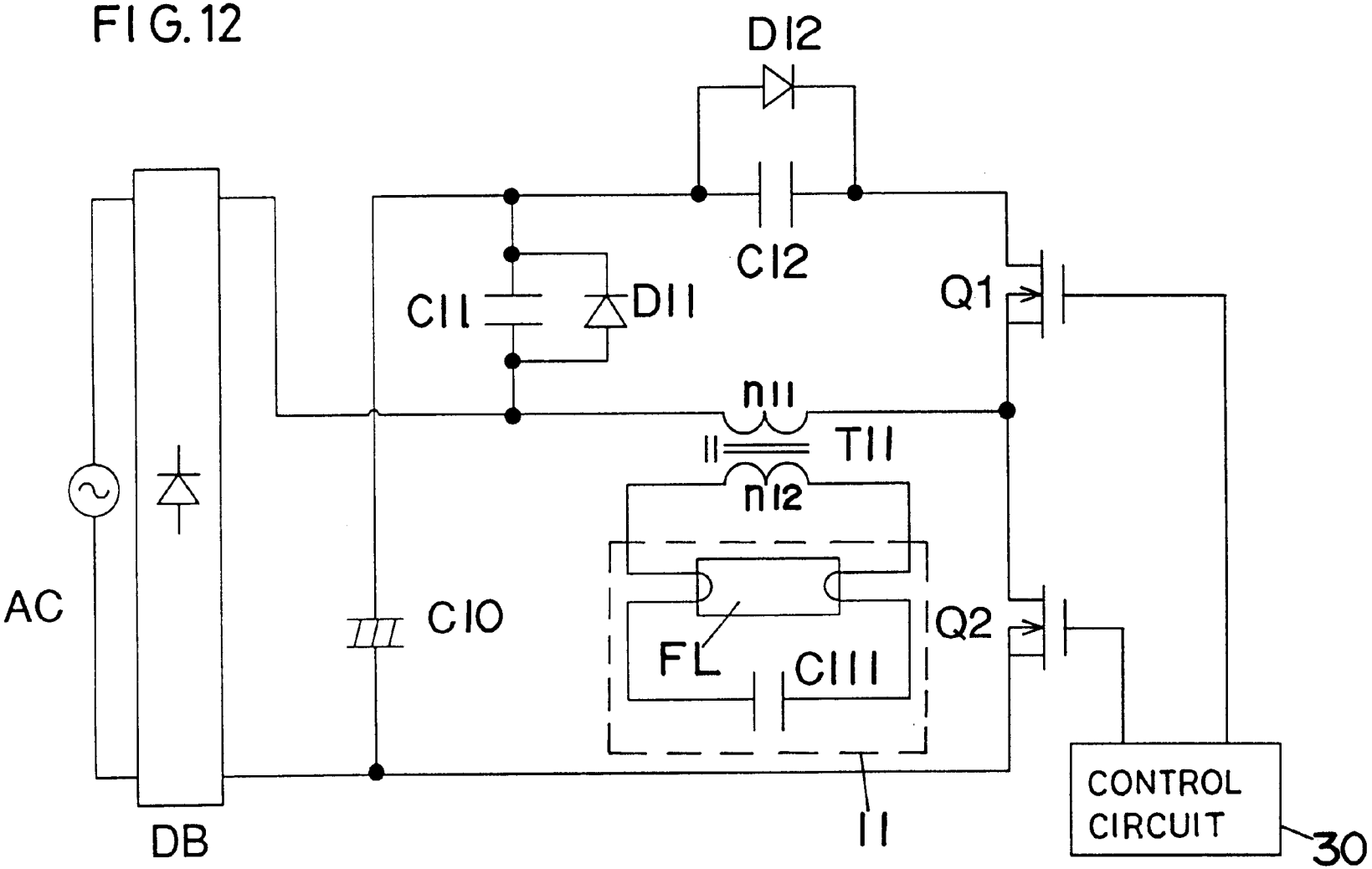

FIG. 12 shows in a schematic circuit diagram the discharge lamp lighting device in another embodiment according to the present invention, in which the device comprises the rectifier DB, capacitors C10–C12, diodes D11 and D12, FET's Q1 and Q2 and transformer T11 in the same manner as in the embodiment of FIG. 1, while a control circuit 30 different from that in the embodiment of FIG. 1 is provided.

Figure 13:
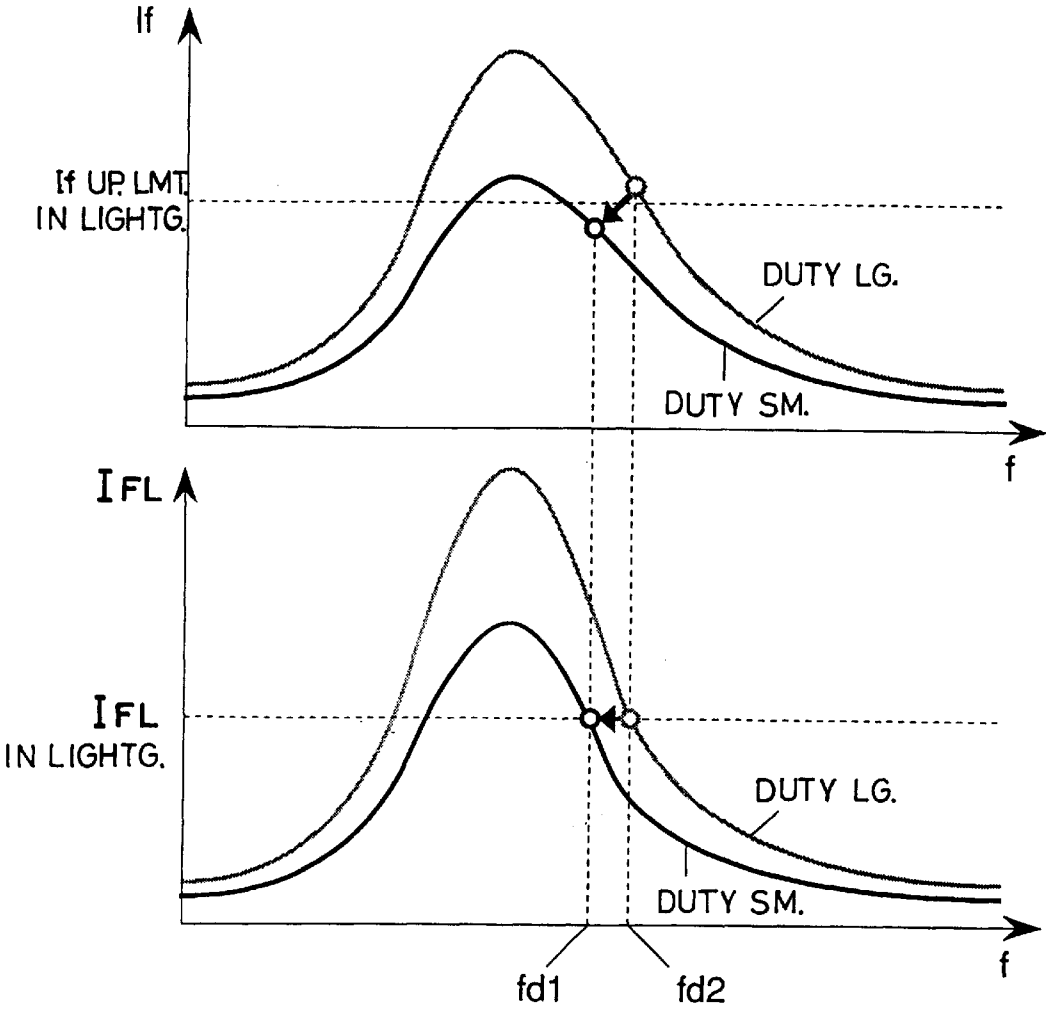
FIGS. 13–15 are explanatory waveform diagrams for the operation of respective other embodiments of the device according to the present invention.
Figure 14:
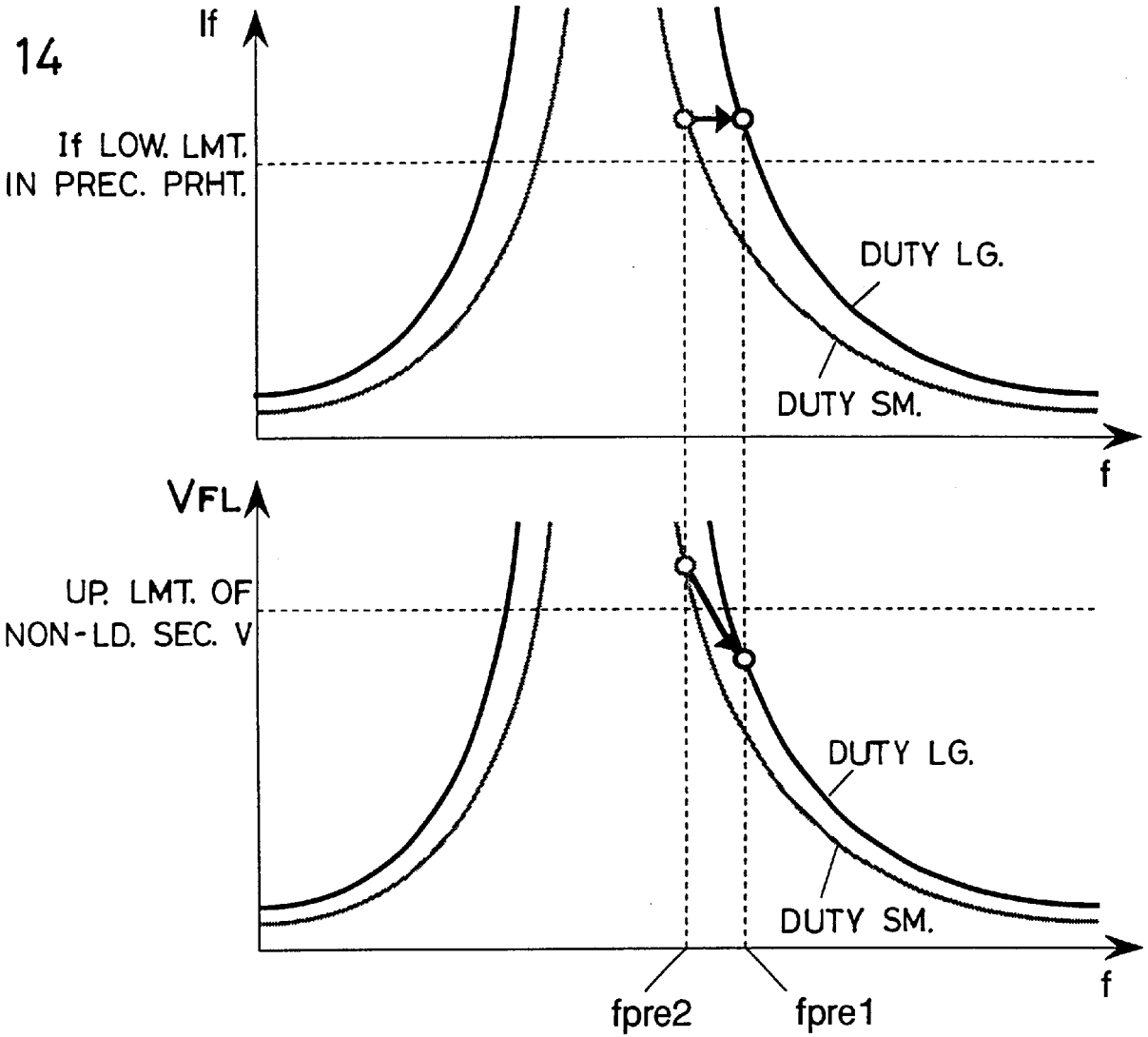
Figure 15:
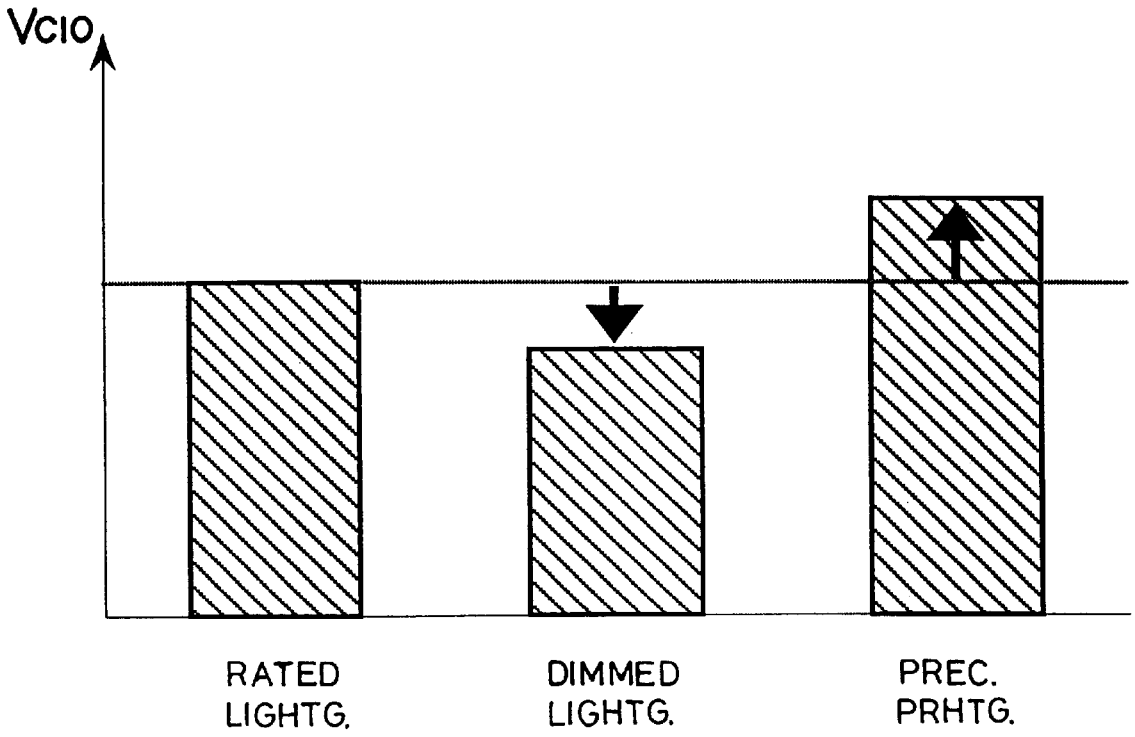

FIGS. 13–15 are explanatory views for the operation of the control circuit 30 in the embodiment of FIG. 12. In recent years, there has been a tendency that the discharge lamps are reduced in their diameter for the purpose of dimensional minimization of the lighting fixture, higher efficiency of the discharge lamp and saving of resources, as a result of which the filaments of the discharge lamp are made thinner to be sufficiently elongated within such discharge lamp of the reduced diameter. In respect of such discharge lamp, the life of the filaments, that is, the life of the discharge lamp is attempted to be assured by defining an upper limit value for the filament current upon lighting the lamp (see FIG. 13). This upper limit value is set below a lower limit of the filament current for the preceding preheating (see FIG. 14). Further, the smaller diametered discharge lamp has such characteristics that a difference between a upper limit value of an applied voltage for preventing the lamp from being lighted during the preceding preheating and the voltage across the lamp during the dimming lighting is small, while the lamp impedance is relatively high, and there arises no remarkable difference in the resonance characteristics between the non-load state and the dimming state when the DC voltage VC10 is equal at both of these states. As a result, in the case of the preheating circuit formed by capacitor connected across the other ends of the pair of filaments, any difference in the operational frequency (switching frequency) between the preceding preheating and the dimming lighting becomes smaller, and it becomes difficult to provide the difference in the filament current between the preceding preheating and the dimming lighting.

In the dimming lighting, therefore, the ON duty ratio of the second FET Q2 is made smaller than in the foregoing case where the DC voltage VC10 is equal, so that the ratio of the energy supplied to the load with respect to the input energy is enlarged, whereby the DC voltage VC10 is lowered to have the lamp lighted at a frequency made as low as possible. In the preceding preheating, further, the ON duty ratio of FET Q2 is made larger than in the foregoing case where the DC voltage VC10 is equal so that the ratio of the energy supplied to the load with respect to the input energy is made smaller, whereby the DC voltage VC10 is increased in the extent of tolerance to have the lamp lighted at a frequency made as high as possible.

More practically, the dimming lighting is performed such that, in contrast to the lighting at a frequency fd2 before making the ON duty ratio smaller as shown in FIG. 13, the voltage VC10 is decreased with the ON duty ratio made smaller, to lower the frequency to fdl at which the lamp current IFL is equalized and the filament current If is below the upper limit value in the lighting. On the other hand, the preceding preheating is attained, in contrast to the preheating at a frequency fpre2 before making the ON duty ratio larger as shown in FIG. 14, by enlarging the ON duty ratio to increase the DC voltage VC10 within the tolerance, and increasing the frequency to fpre1 at which the filament current If is larger than the lower limit value in the preceding preheating and the applied voltage to the lamp in the preceding preheating is below the upper limit value.

Accordingly, the lighting of the discharge lamp even of the small-diametered type can be realized while satisfying the preheating conditions through the preheating circuit formed by capacitor connected across the other ends of the pair of filaments by modifying the operation of FET's Q1 and Q2 with signals from the control circuit 30 to modify the DC voltages at the respective operation as shown in FIG. 15.

Figure 16:
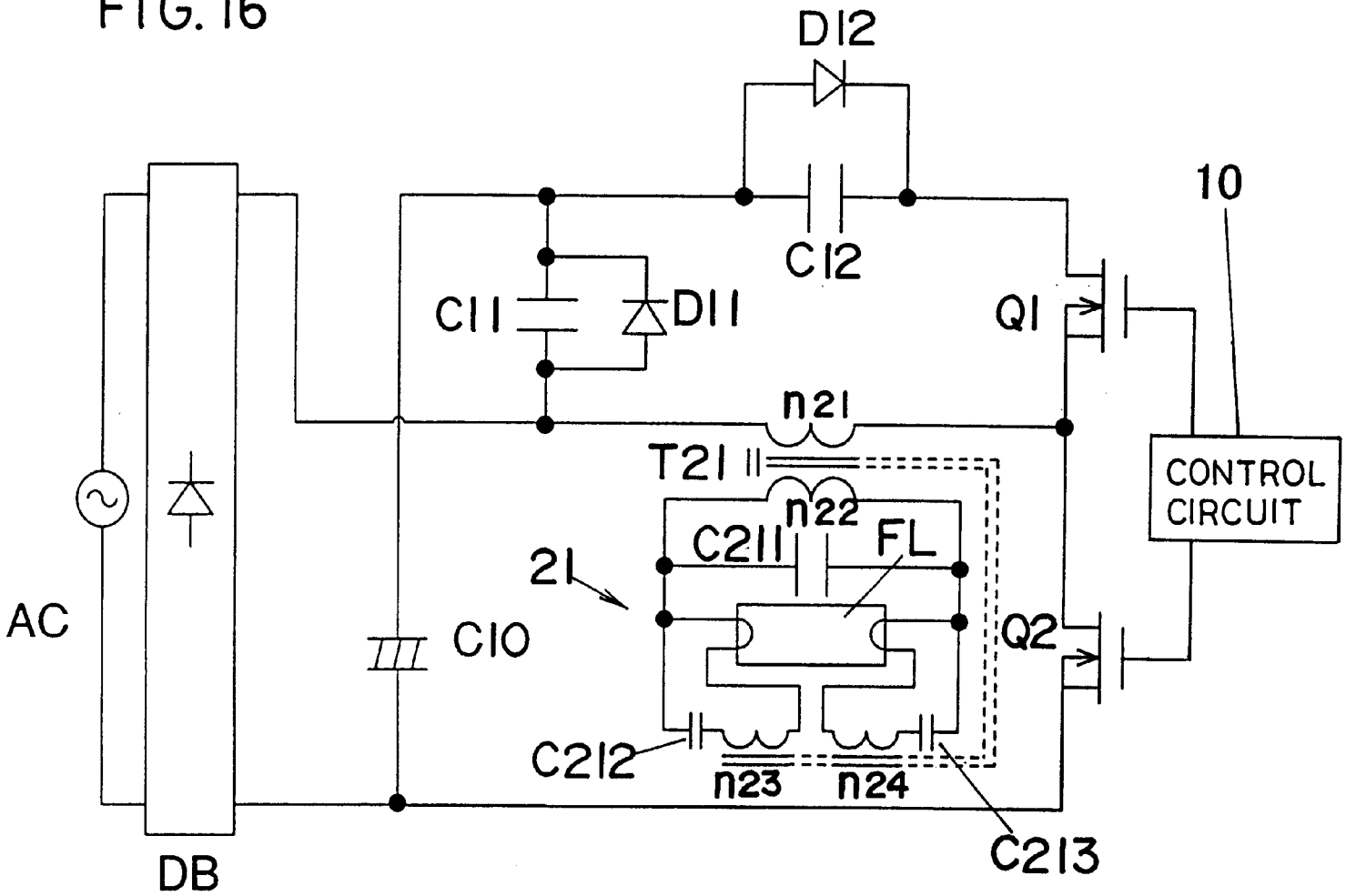
FIGS. 16–18 are schematic circuit diagrams showing respectively other embodiments of the device according to the present invention.

FIG. 16 shows in a schematic circuit diagram the discharge lamp lighting device in another embodiment of the present invention, in which the device comprises the rectifier DB, capacitors C10–C12, diodes D11 and D12, FET's Q1 and Q2 and control circuit 10 as arranged similar to the embodiment of FIG. 1, while this device differs from the embodiment of FIG. 1 in the structure of the transformer T21 having a primary winding n21 connected between the positive polarity output terminal of the rectifier DB and the junction point of FET's Q1 and Q2 and three secondary windings n22, n23 and n24.

In the above transformer T21, the secondary winding n22 is connected to the parallel circuit of the capacitor C211 and discharge lamp FL, the secondary winding n23 is connected across one filament of the discharge lamp FL and in series with a capacitor C212, and further the secondary winding n24 is connected across the other filament of the lamp FL and in series with a capacitor C213. In the present embodiment of FIG. 16, therefore, the load circuit 21 comprises the capacitors C211–C213 and the discharge lamp FL.

Accordingly, in the embodiment of FIG. 16, the discharge lamp FL is preheated at one filament with a resonating circuit of the capacitor C212 with the secondary winding n23 and at the other filament with a resonating circuit of the capacitor C213 and secondary winding n24, whereby the resonating circuit for preheating the filaments can be designed independently of the main resonating circuit, so that the optimum preheating can be set even with respect to the discharge lamp of the small diametered type, and the discharge lamp can be optimally lighted.

Figure 17:
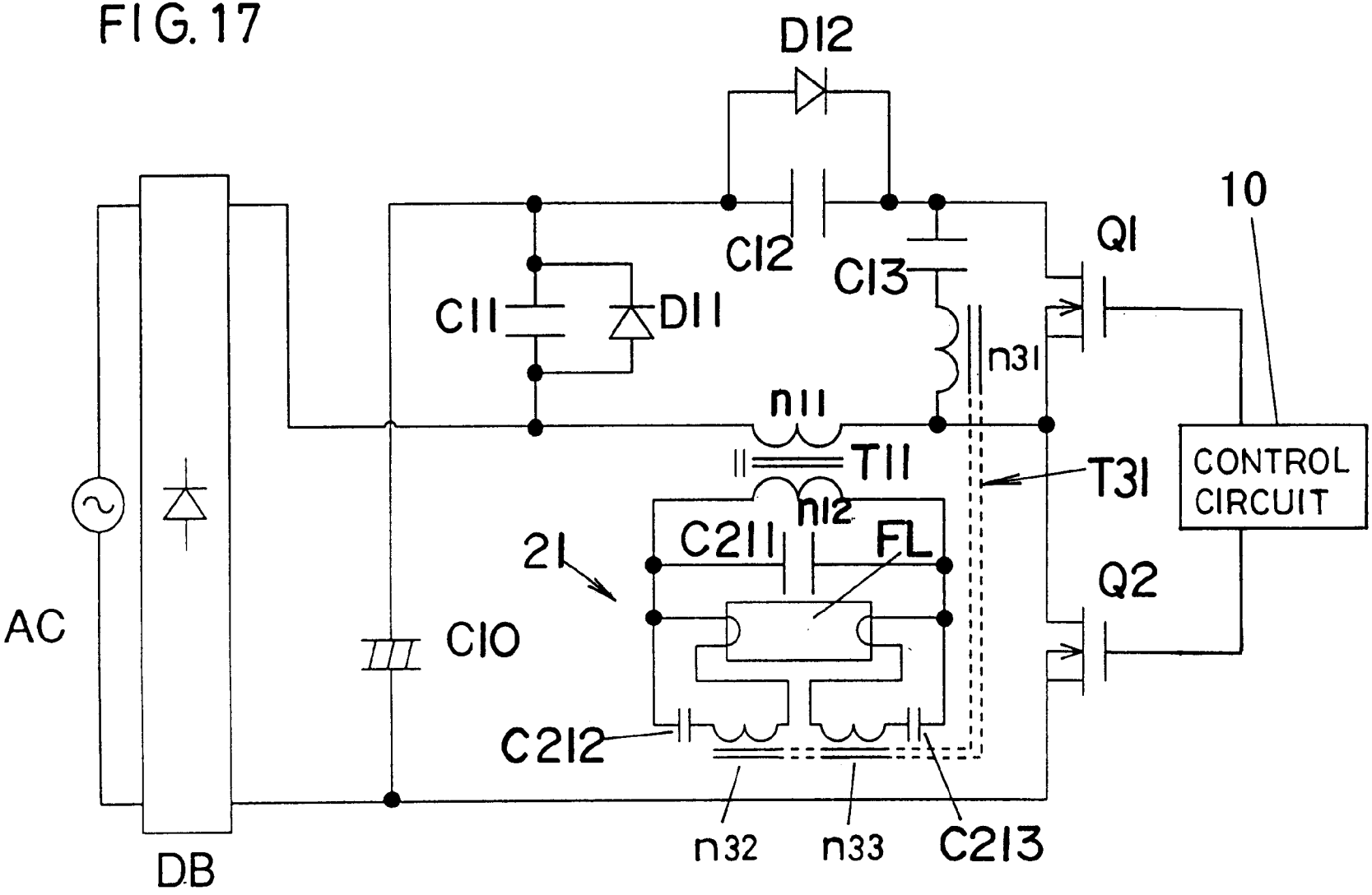

FIG. 17 is a schematic circuit diagram showing the discharge lamp lighting device in another embodiment of the present invention, in which the device also comprises the rectifier DB, capacitors C10–C12, diodes D11 and D12, FET's Q1 and Q2, transformer T11 and control circuit 10, which are arranged in the same manner as in the embodiment of FIG. 1, while the device differs from the embodiment of FIG. 1 in the provision of a capacitor C13 connected at one end to the drain of FET Q1 and of the transformer T31 having a primary winding n31 connected between the other end of the capacitor C13 and the source of FET Q1 and further secondary windings n32 and n33.

In the above transformer T31, the secondary winding n32 is connected across one filament of the discharge lamp FL and in series with the capacitor C212, and the secondary winding n33 is connected across the other filament of the lamp FL and in series with the capacitor C213. That is, the arrangement is so made that the series circuit of the capacitor C13 and primary winding n31 and acting as a resonance circuit for preheating the filaments is connected in parallel with FET Q1, further resonance circuits for preheating the filaments are connected respectively in parallel to each filament, and currents for preheating the filaments in the discharge lamp FL are taken out of the secondary windings n32 and n33. In this embodiment of FIG. 17, too, the load circuit 21 is formed with the capacitors C211–C213 and the discharge lamp FL, similar to the embodiment of FIG. 16.

Now, in the embodiment of FIG. 17, the discharge lamp FL is preheated at one filament by the resonance circuit comprising the capacitor C212 and secondary winding n32, and at the other filament by the resonance circuit comprising the capacitor C213 and secondary winding n33, whereby the main resonance circuit and filament-preheating resonance circuits can be provided as designed to be independent of each other, so that the optimum preheating setting is made possible even with respect to the discharge lamp of small-diametered type, and the discharge lamp can be optimally lighted. Further, as FET Q1 is clamped with this parasitic diode and the diode D12, the voltage across FET Q1 will be of a square wave equal in the amplitude to the DC voltage VC10. With this voltage of FET Q1 employed for forming the resonance circuit for the filaments, a preheating current small in the crest factor can be supplied.

Figure 18:
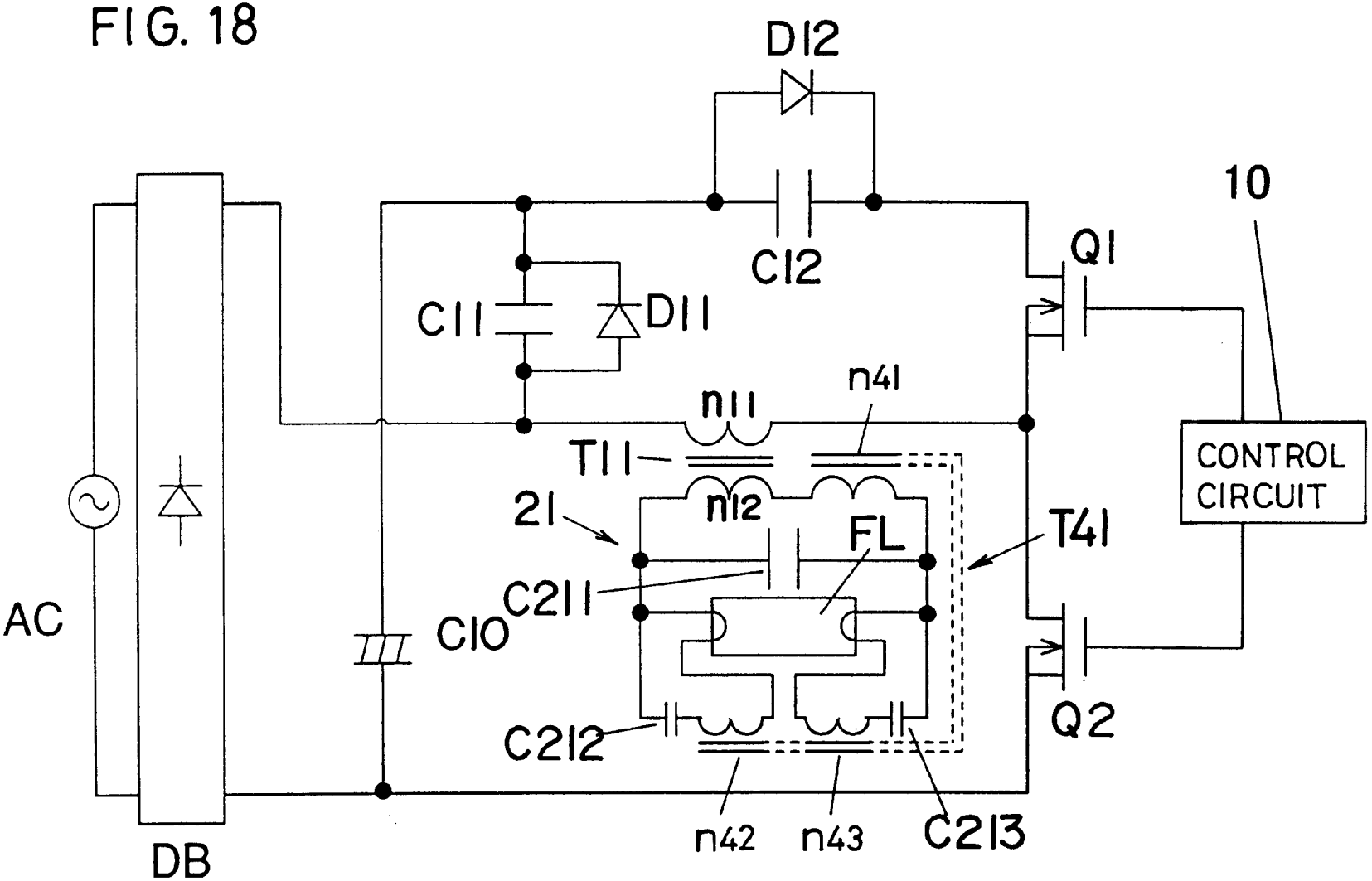

FIG. 18 is a schematic circuit diagram showing the discharge lamp lighting device in another embodiment of the present invention, in which the device also comprises the rectifier DB, capacitors C10–C12, diodes D11 and D12, FET's Q1 and Q2, transformer T11 and control circuit 10 arranged similar to the embodiment of FIG. 11, while a further transformer T41 having a primary winding n41 connected in series with the secondary winding n12 of the transformer T11 as well as secondary windings n42 and n43 is provided, to be different from the embodiment of FIG. 1.

Here, the secondary winding n42 of the further transformer T41 is connected across one filament of the discharge lamp FL and in series with a capacitor C212, and the other secondary winding n43 is connected across the other filament of the lamp and in series with a capacitor C213. In the embodiment of FIG. 18, the load circuit 21 comprises the capacitors C211–C213 and discharge lamp FL in the same manner as in the embodiment of FIG. 16.

Accordingly, in the embodiment of FIG. 18, the discharge lamp FL is preheated at one filament with the resonance circuit comprising the capacitor C212 and secondary winding n42, and at the other filament with the resonance circuit comprising the capacitor C213 and resonance circuit n43, whereby the circuit design can render the preheating resonance circuits independent of the main resonance circuit, the discharge lamp even of the small diametered type can be set for the optimum preheating, and the discharge lamp can be optimally lighted.

Figure 19:
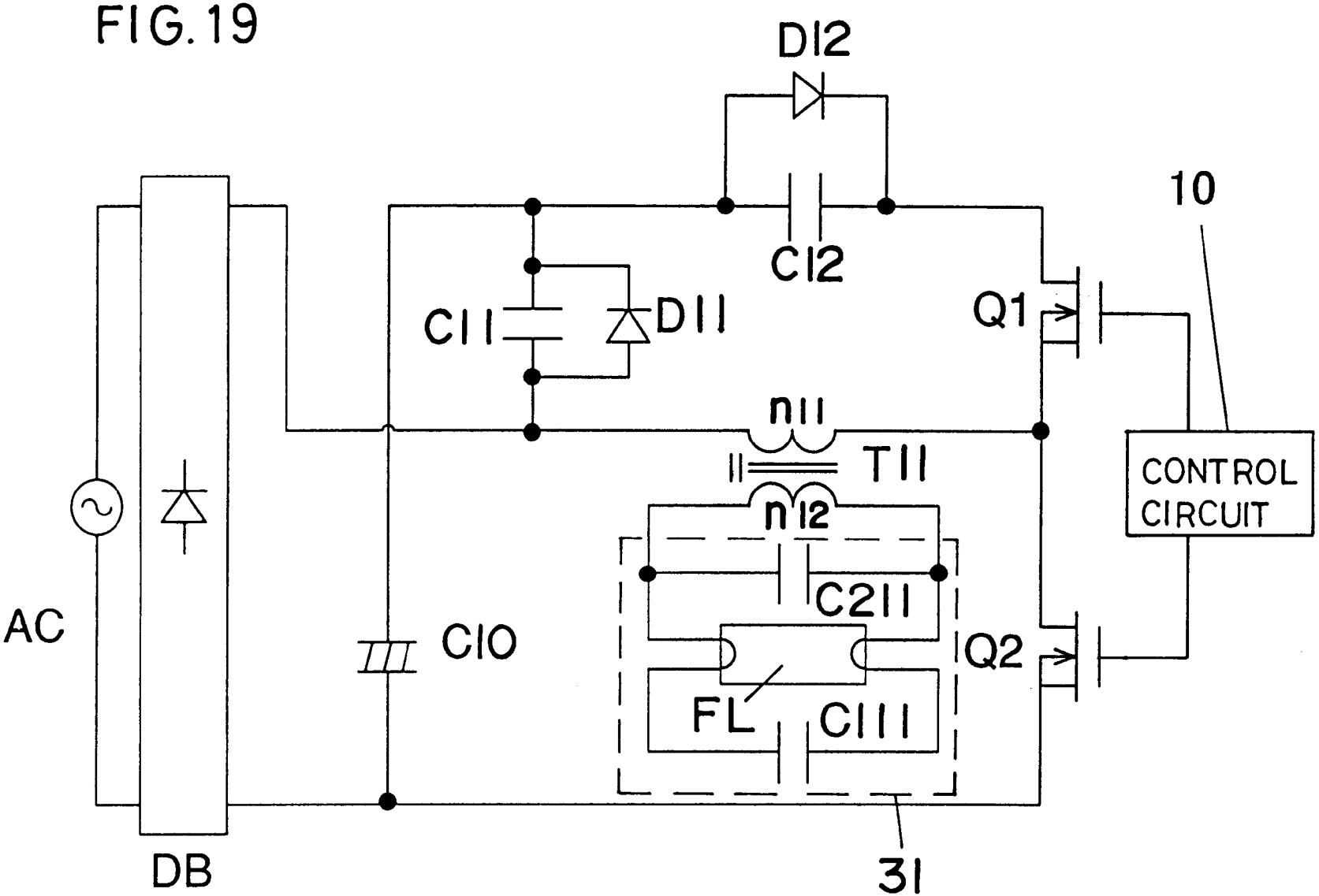
FIG. 19 is a circuit diagram in which another load circuit is employed in the discharge lamp lighting device of FIG. 1 according to the present invention.

FIG. 19 is a circuit diagram showing an example of application of another load circuit to the discharge lamp lighting device in the embodiment of FIG. 1, in which the load circuit 31 comprises the capacitor C211 connected in parallel to the primary winding n12 of the transformer T11, the discharge lamp FL having a pair of filaments respectively connected at their one end across the capacitor C211, and the capacitor C111 across which the other ends of the filaments are connected.

In the embodiment of FIG. 19, a capacitor for resonance is formed with the capacitor for preheating C111 and the additional capacitor C211, so that the design flexibility with respect to the filament current can be improved and a simpler design of the discharge lamp lighting device for the discharge lamp of the smaller diametered type, for example, is made attainable. Further, as the capacitor C211 is connected on the side of the discharge lamp lighting device with respect to the discharge lamp, it is enabled to prevent any spike-shaped high voltage from occurring as caused by the energy accumulated in the transformer T11 upon removing the lamp FL.

Figure 20:
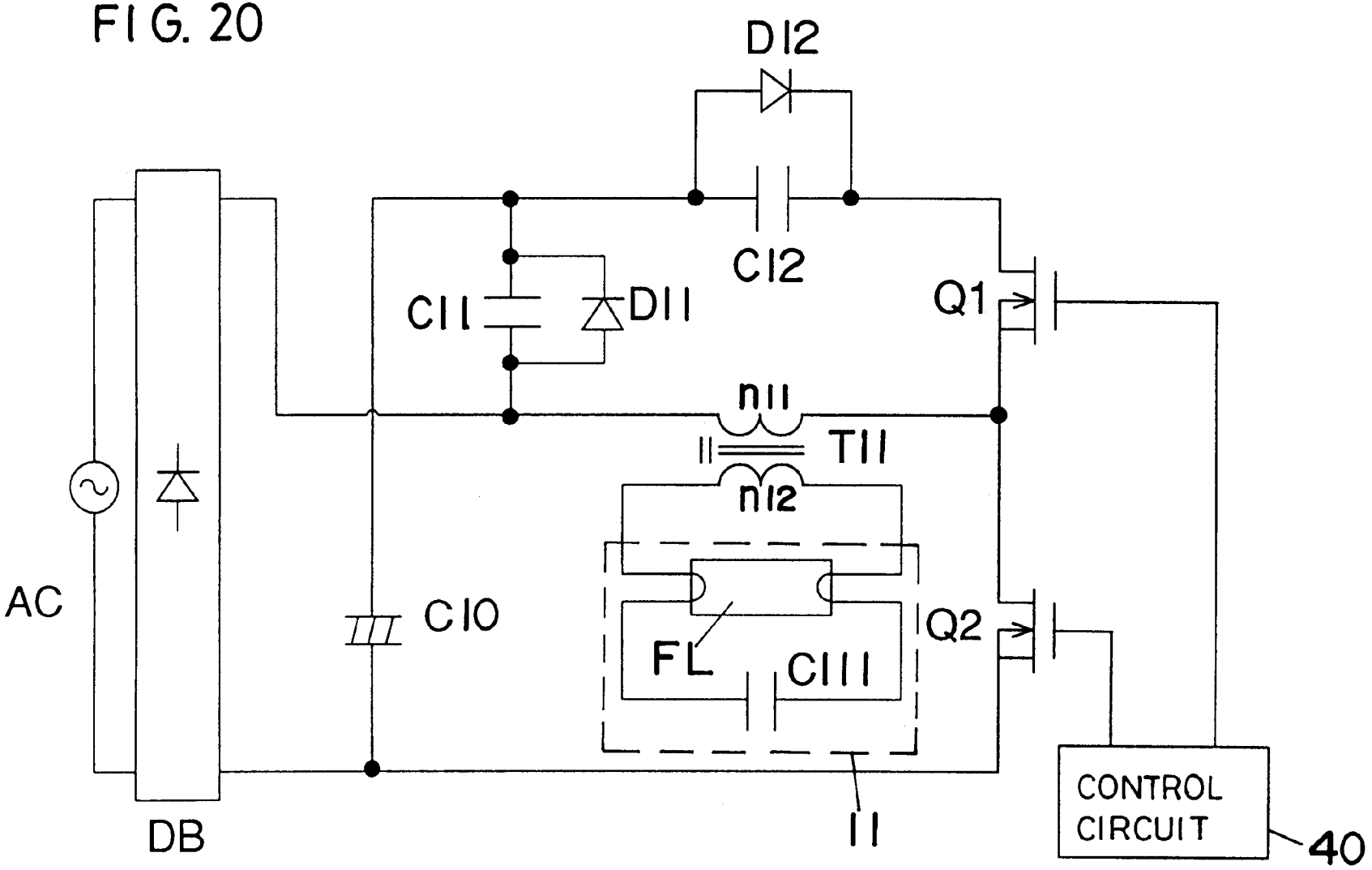
FIG. 20 is a schematic circuit diagram showing another embodiment of the discharge lamp lighting device according to the present invention.
Figure 21:
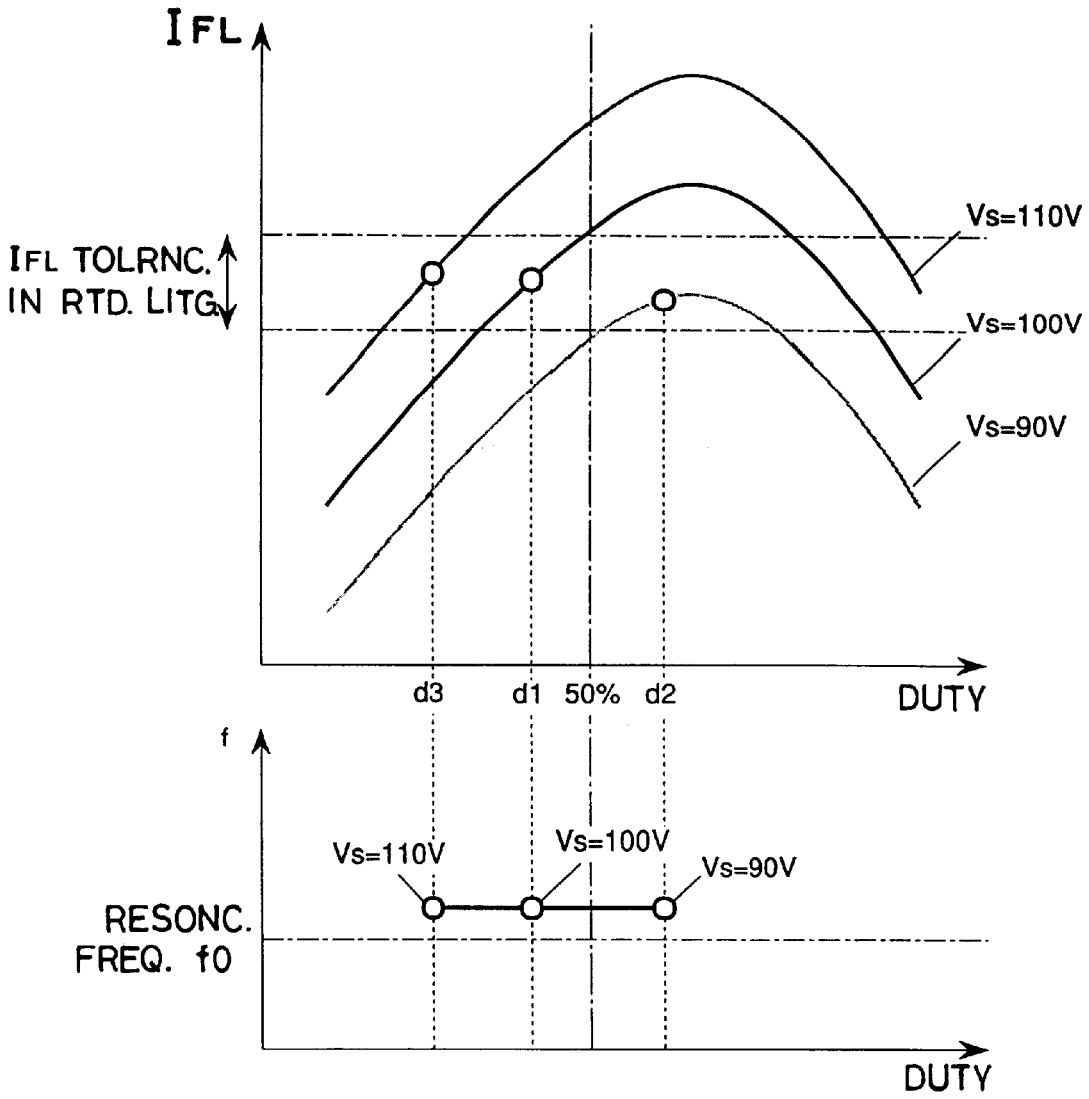
FIG. 21 is a waveform diagram showing, in upper part, the characteristics of ON duty ratio with respect to a load current and, in lower part, the characteristics of ON duty ratio with respect to a switching frequency in the embodiment of FIG. 20.

FIG. 20 is a schematic circuit diagram showing the discharge lamp lighting device in another embodiment according to the present invention, in which the device comprises the rectifier DB, capacitors C10–C12, diodes D11 and D12, FET's Q1 and Q2 and transformer T11 as arranged in the same manner as in the embodiment of FIG. 1, while the device is different from the FIG. 1 embodiment in the provision of a control circuit 40 for controlling the ON/OFF operation of FET's Q1 and Q2 while properly modifying the ON duty ratio with the switching frequency made constant to render the load current to be within the tolerance, in the event where the AC source voltage Vs fluctuates during the rated lighting, for example. The rated voltage of the foregoing AC source Vs is assumed to be 100V. FIG. 21 shows, in upper part, the characteristics of the ON duty ratio of FET Q2 with respect to the load current and, in lower part, the characteristics of the ON duty ratio of FET Q2 with respect to the switching frequency, and the control circuit 40 is detailed with reference to this drawing.

When the ON duty ratio of FET Q2 for drawing the input current in is larger than 50% with the switching frequency made constant, the energy supplied to the load circuit 11 decreases but the input current increases, and the DC voltage VC10 increases. At portions where the ON duty ratio is slightly larger than 50%, increase in the load current IFL because of the increment in the DC voltage VC10 becomes larger, and the peak of the load current IFL with respect to the ON duty ratio deviated, as shown in FIG. 21, to larger side from the ON duty ratio 50%. With such characteristics utilized, the ON duty ratio is made d2 to be larger than 50% when the source voltage Vs has become low, then the load current IFL will be within the tolerance.

Further, as the circuit efficiency is more improved when the resonance circuit operates at a frequency closer to the resonance frequency f0, with any reactive current component reduced, the control is so made as to render the switching frequency constant even upon occurrence of fluctuation in the source voltage Vs as shown in FIG. 21, while varying the ON duty ratio of FET Q2 for drawing the input current in the sequence of d1, d2 and d3, so that the load current IFL will be within the tolerance.

Now, in the embodiment of FIG. 19, it is made possible to keep the load current IFL within the tolerance even in the event of the fluctuation in the source voltage Vs, by controllably modifying the ON duty ratio of FET Q2 drawing the input current in response to the fluctuation in the source voltage Vs.

Figure 22:
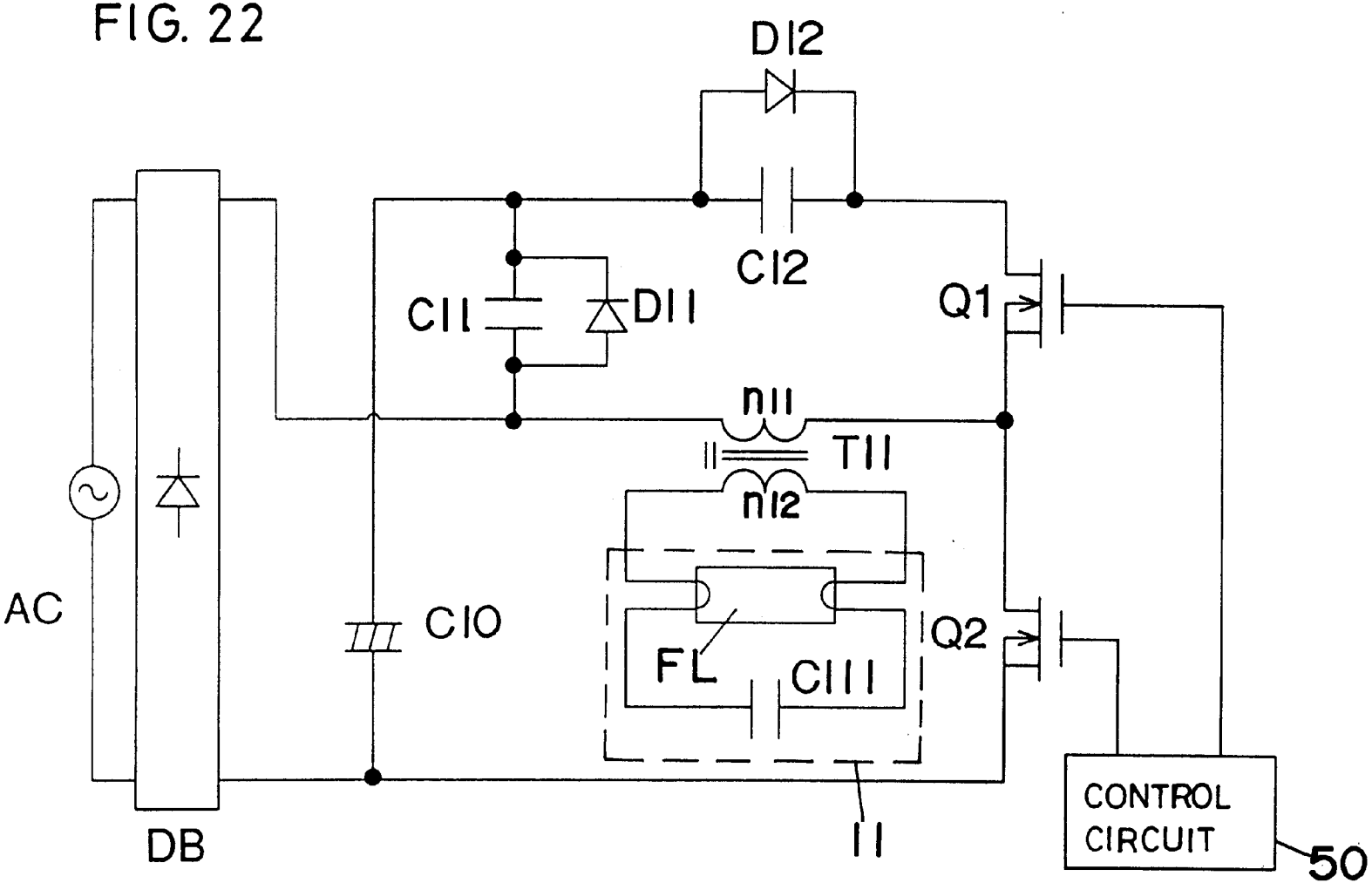
FIG. 22 is a schematic circuit diagram showing still another embodiment of the discharge lamp lighting device according to the present invention.

FIG. 22 is a schematic circuit diagram showing the discharge lamp lighting device in another embodiment of the present invention, in which the device comprises the rectifier DB, capacitors C10–C12, diodes D11 and D12, FET's Q1 and Q2 and transformer T11 in the same manner as in the embodiment of FIG. 1, while this embodiment differs from the FIG. 1 embodiment in the provision of a control circuit 50 for performing various ON/OFF control of FET's Q1 and Q2 such that, when the source voltage Vs fluctuates in rated lighting state, for example, the ON/OFF control is performed mainly with the ON duty ratio properly modified rather than the switching frequency so as to keep the load current within the tolerance.

Figure 23:
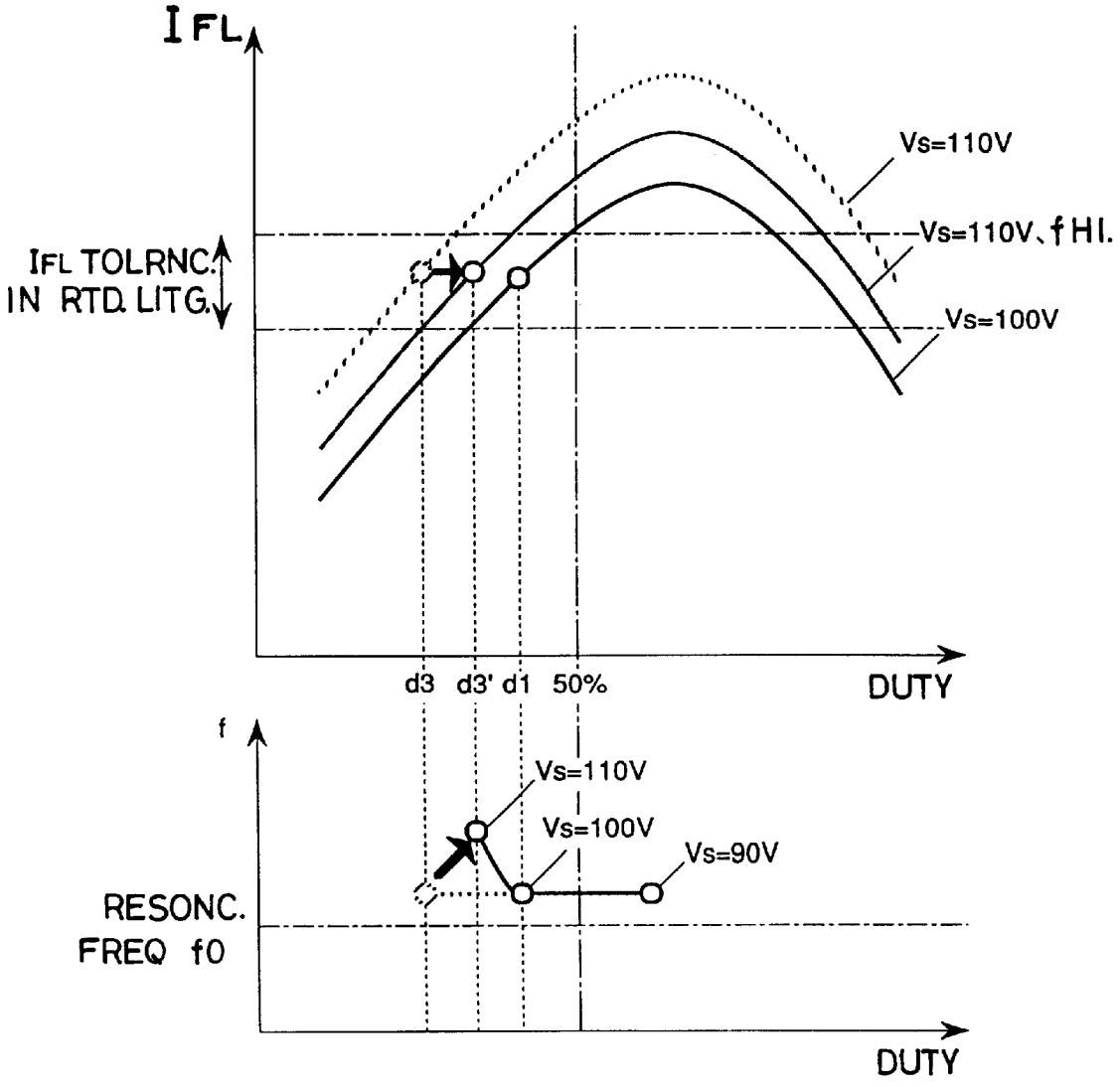
FIG. 23 is a waveform diagram showing, in upper part, the characteristics of ON duty ratio with respect to the load current and, in lower part, the characteristics of ON duty ratio with respect to the switching frequency in the embodiment of FIG. 22.

In FIG. 23, the ON duty ratio characteristics of FET Q2 with respect to the load current are shown in the upper part, and the ON duty ratio characteristics of FET Q2 with respect to the switching frequency are shown in the lower part.

In the embodiment of FIG. 19, the control is performed so that, upon fluctuation in the source voltage Vs, the load current will be kept within the tolerance by modifying the ON duty ratio of FET Q2 in the sequence of d1, d2 and d3 so as to draw in the input current, while keeping the switching frequency constant. At this time, the ON duty ratio is caused to be less than 50% as the source voltage Vs of the AC power source AC increases, and the sinusoidal waveform of the load current is caused to be distorted. When the load circuit includes the discharge lamp, there arises a problem that any high frequency component caused by the distortion in the load current will be radiated as a noise.

Here, in the embodiment of FIG. 22, the control is performed such that, as shown in FIG. 23, the ON duty ratio is rendered closer to 50% as much as possible by increasing the switching frequency in a state of Vs>100V at which the ON duty ratio becomes too small, and the high frequency component due to the distortion of the load current. When the source voltage Vs is 110V, for example, the ON/OFF control is performed with the ON duty ratio made to be d3' larger than d3 and the switching frequency increased. In short, a control is performed for properly setting the switching frequency and ON duty ratio at the respective AC source voltage so that the circuit efficiency and the higher frequency component will be subjected to a trade-off.

Now, according to the embodiment of FIG. 22, it is possible to keep the load current within the tolerance and to reduce the noise radiated from the discharge lamp even upon fluctuation of the AC source voltage Vs, by properly controllably modifying the switching frequency and ON duty ratio of FET Q2 which draws in the input current in response to the voltage fluctuation in the AC source voltage Vs.

Figure 24:
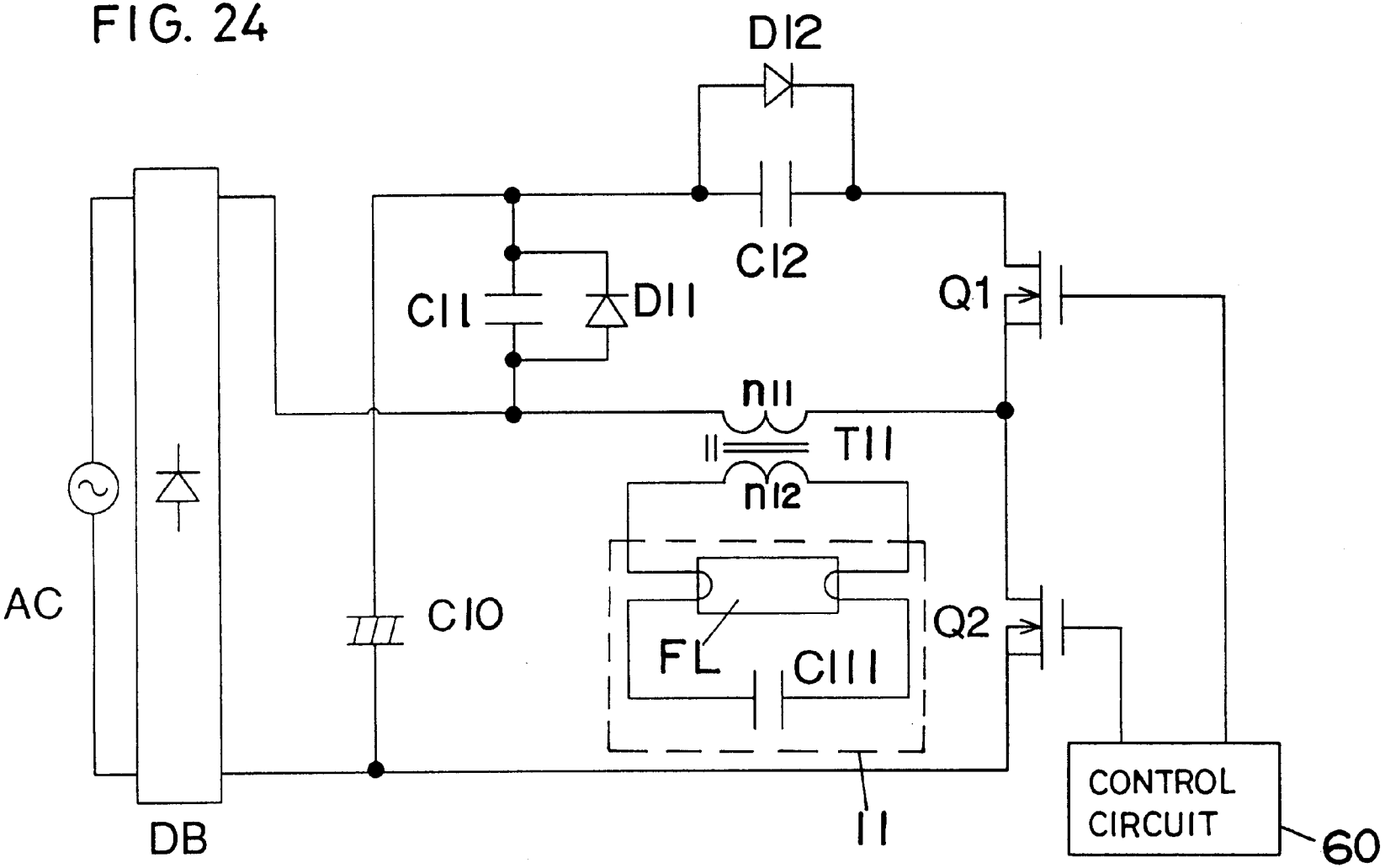
FIG. 24 is a schematic circuit diagram showing still another embodiment of the discharge lamp lighting device according to the present invention.

FIG. 24 is a schematic circuit diagram of the discharge lamp lighting device in another embodiment of the present invention, in which the device also comprises the rectifier DB, capacitors C10–C12, diodes D11 and D12, FET's Q1 and Q2 and transformer T11 in the same manner as in the embodiment of FIG. 1, while this embodiment differs from that of FIG. 1 in the provision of a control circuit 60 for various ON/OFF controlling with respect to FET's Q1 and Q2 such that, when the AC source voltage Vs fluctuates during the rated lighting, for example, the ON/OFF control is performed mainly with the ON duty ratio properly modified rather than the switching frequency, whereas, when the voltage fluctuates during a drive of the load circuit at a lower output than the rated output, the ON/OFF control is performed mainly with the switching frequency properly modified rather than the ON duty ratio.

Figure 25:
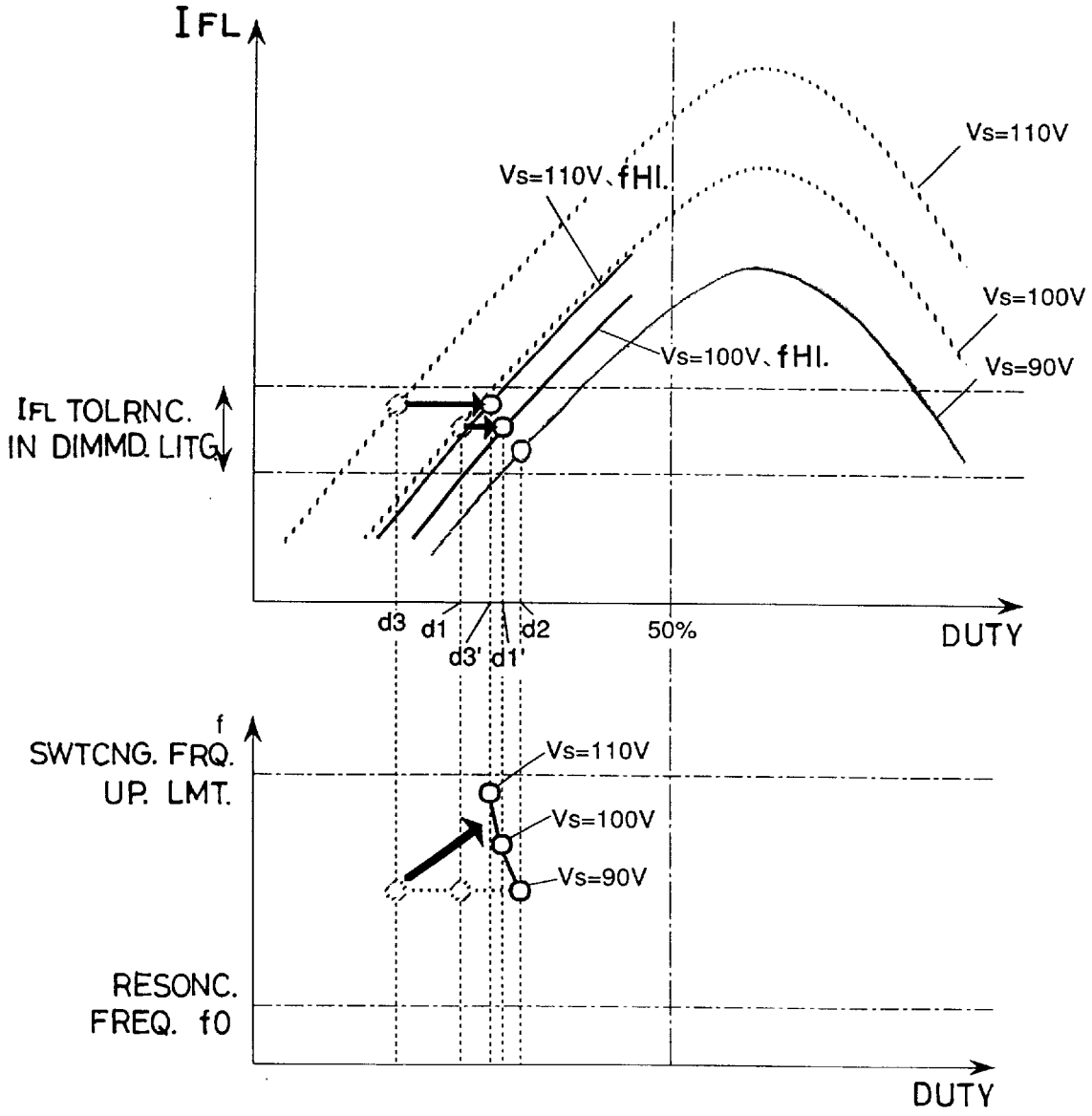
FIG. 25 is a waveform diagram showing, in upper part, the characteristics of ON duty ratio with respect to the load current and, in lower part, the characteristics of ON duty ratio with respect to the switching frequency in the embodiment of FIG. 24.

FIG. 25 shows in upper part the characteristics of the ON duty ratio of FET Q2 with respect to the load current and in lower part the characteristics of the ON duty ratio of FET Q2 with respect to the switching frequency, respectively, and the above control circuit 60 shall be detailed with reference to this drawing.

In the embodiment of FIG. 19, the control for keeping the load current within the tolerance upon fluctuation of the source voltage Vs is carried out by retaining the switching frequency constant, and modifying the ON duty ratio of FET Q2 which draws the input current in to be in the sequency of d1, d2 and d3. When the device in this event is formed for lighting as dimmed the discharge lamp FL in the load circuit 11, the ON/OFF control is to be performed at a small ON duty ratio so as to restrain any boosting of the DC voltage VC10 upon the dimmed lighting, so that the distortion in the waveform of the load current will be increased when the device output is decreased.

In the embodiment of FIG. 24, therefore, the control is performed for reducing the higher harmonic component caused by the distortion of the load current, by properly modifying the ON duty ratio and the switching frequency, mainly the switching frequency, in response to the AC source voltage Vs, so that the ON duty ratio can take a value possibly larger and less varying. When the voltage Vs is 100V, for example, the control is made by increasing the switching frequency high with the ON duty ratio set at d1' larger than d1, whereas, when the voltage Vs is 110V, the control is made by increasing the switching frequency high with the ON duty ratio set at d3' larger than d3.

When in this event the preheating circuit formed by capacitor connected across the other ends of the pair of filament is to be employed with respect to the discharge lamp FL of the small diametered type, the control is performed for adjusting the switching frequency within a range in which preheating conditions are satisfied (in the range below "upper limit of switching frequency" in FIG. 25), because the switching frequency elevated too high causes a risk to arise in that the preheating current for the filaments increases to cause the preheating conditions not to be satisfiable, whereby the load current is made retainable within the tolerance to reduce the higher harmonic components in the load current even upon fluctuation of the AC source voltage, while satisfying the preheating conditions.

According to the embodiment of FIG. 24, the load current can be retained within the tolerance even upon fluctuation of the AC source voltage Vs by properly controllably modifying the switching frequency and ON duty ratio of FET Q2 which draws the input current in response to the fluctuation of the voltage Vs, and also the noise radiated from the discharge lamp can be reduced.

Figure 26:
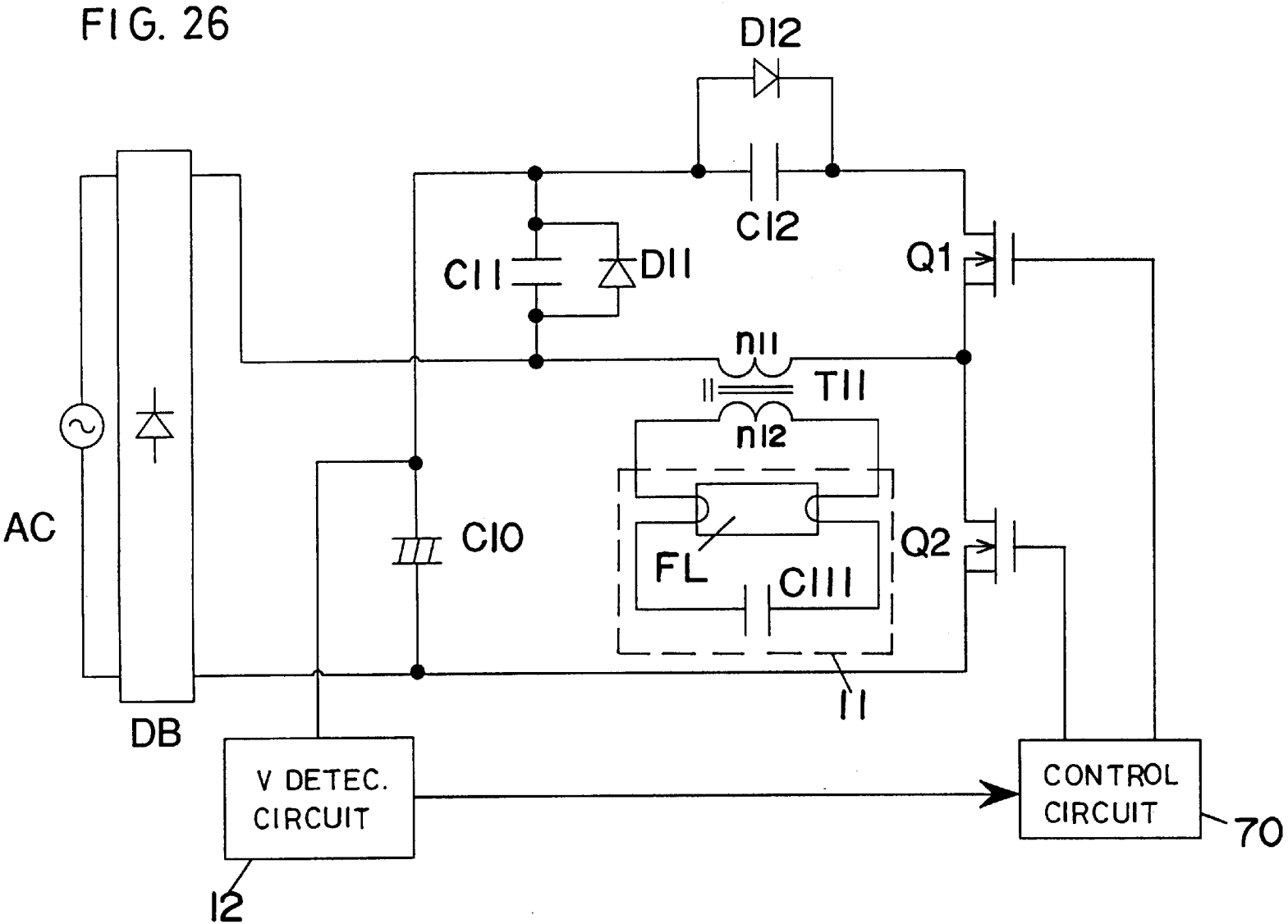
FIGS. 26 and 27 are schematic circuit diagrams showing further embodiments of the discharge lamp lighting device according to the present invention.

FIG. 26 is a schematic circuit diagram of the discharge lamp lighting device in another embodiment according to the present invention, in which the device comprises the same rectifier DB, capacitors C10–C12, diodes D11 and D12, FET's Q1 and Q2 and transformer T11 as in the embodiment of FIG. 1, while this device differs from the FIG. 1 embodiment in the provision of a voltage detecting circuit 12 for detecting the voltage across the smoothing capacitor C10, and a control circuit 70 for controlling the ON/OFF operation of FET's Q1 and Q2 with the switching frequency, ON period, duty ratio and so on properly modified for stopping the operation of FET's Q1 and Q2 in abnormal condition in accordance with detected result of the voltage detecting circuit 12.

The ON/OFF control with respect to FET's Q1 and Q2 is performed by properly modifying the switching frequency, ON period, duty ratio and so on, so as to render, for example, the voltage value detected by the voltage detecting circuit 12 to be a predetermined value, whereby the smoothing capacitor C10 is enabled to retain a constant voltage at such predetermined value. As a result, it is possible to obtain stable output characteristics, and to restrain any flickering of lighting in the event where the load circuit includes the discharge lamp.

Further, when the detected voltage value of the voltage detecting circuit 12 reaches above a level deemed an abnormal condition, the switching operation of FET's Q1 and Q2 is controlled to be stopped, whereby the circuit elements can be prevented from being damaged by any overvoltage.

Figure 27:
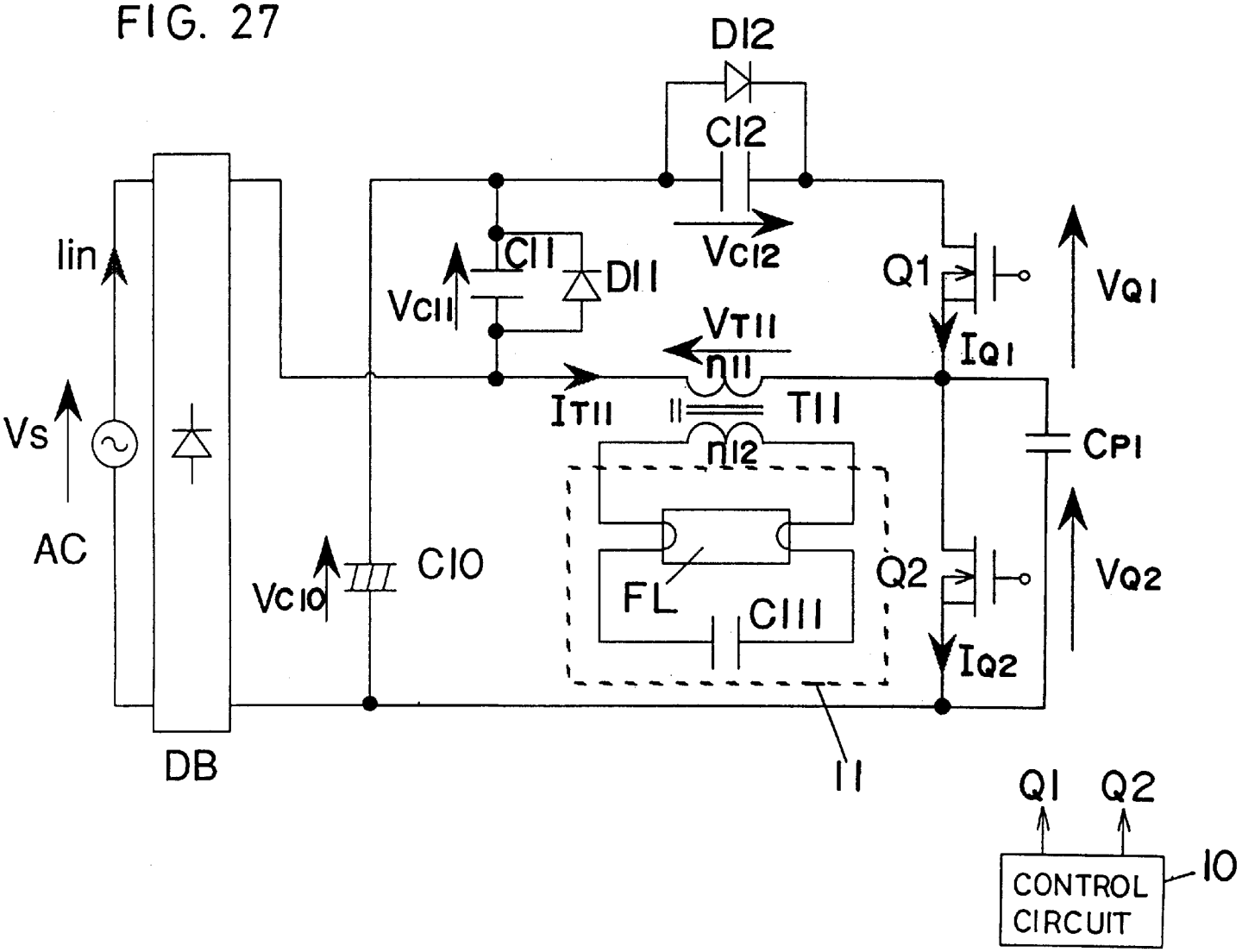

FIG. 27 is a schematic circuit diagram of the discharge lamp lighting device in another embodiment according to the present invention, which comprises the same rectifier DB, capacitors C10–C12, diodes D11 and D12, FET's Q1 and Q2, transformer T11 and control circuit 10 as those in the embodiment of FIG. 1, whereas the device is different from the FIG. 1 embodiment in a further provision of a capacitor CP1 connected in parallel to FET Q2.

Figure 31:
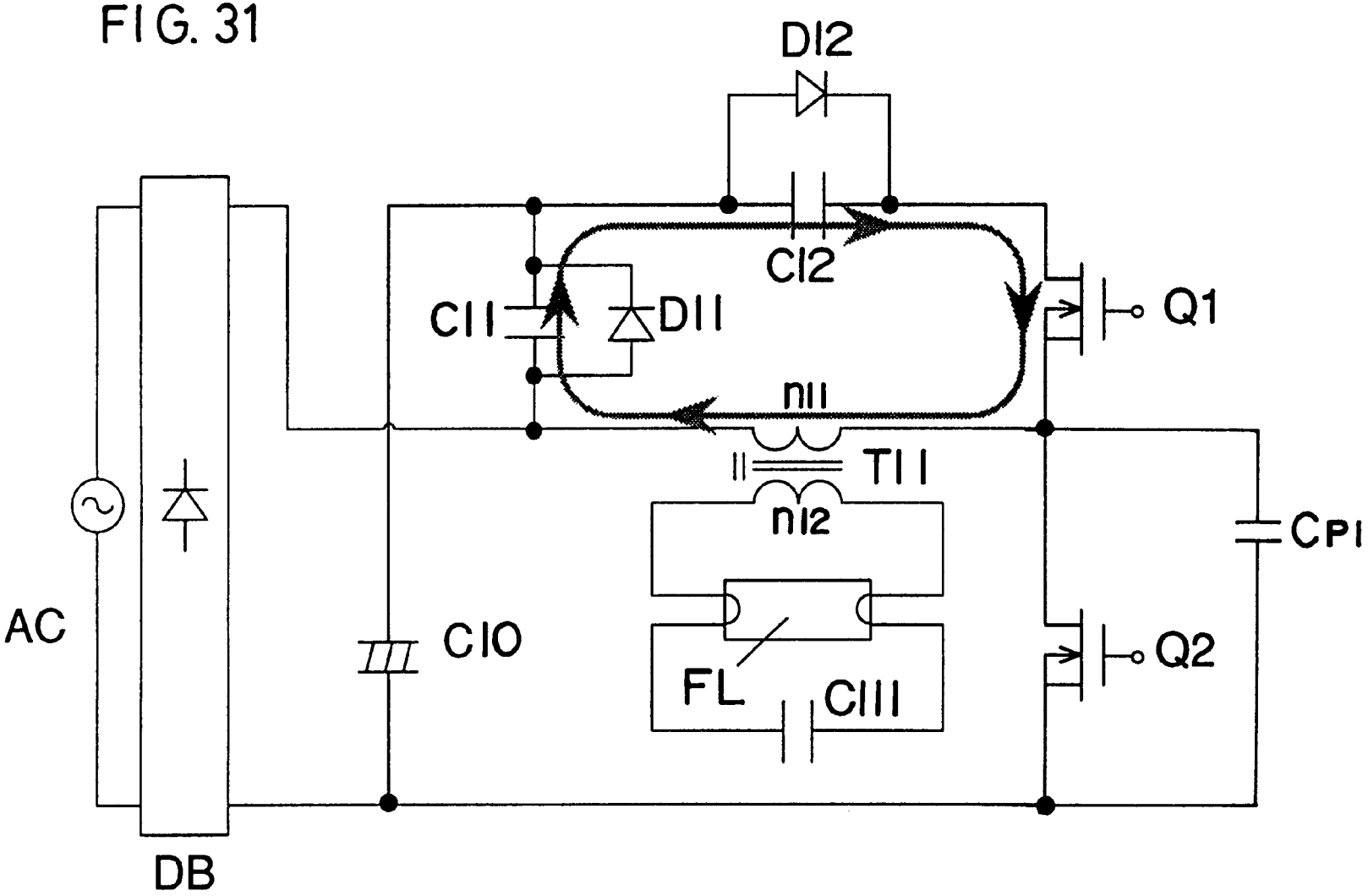
Figure 32:
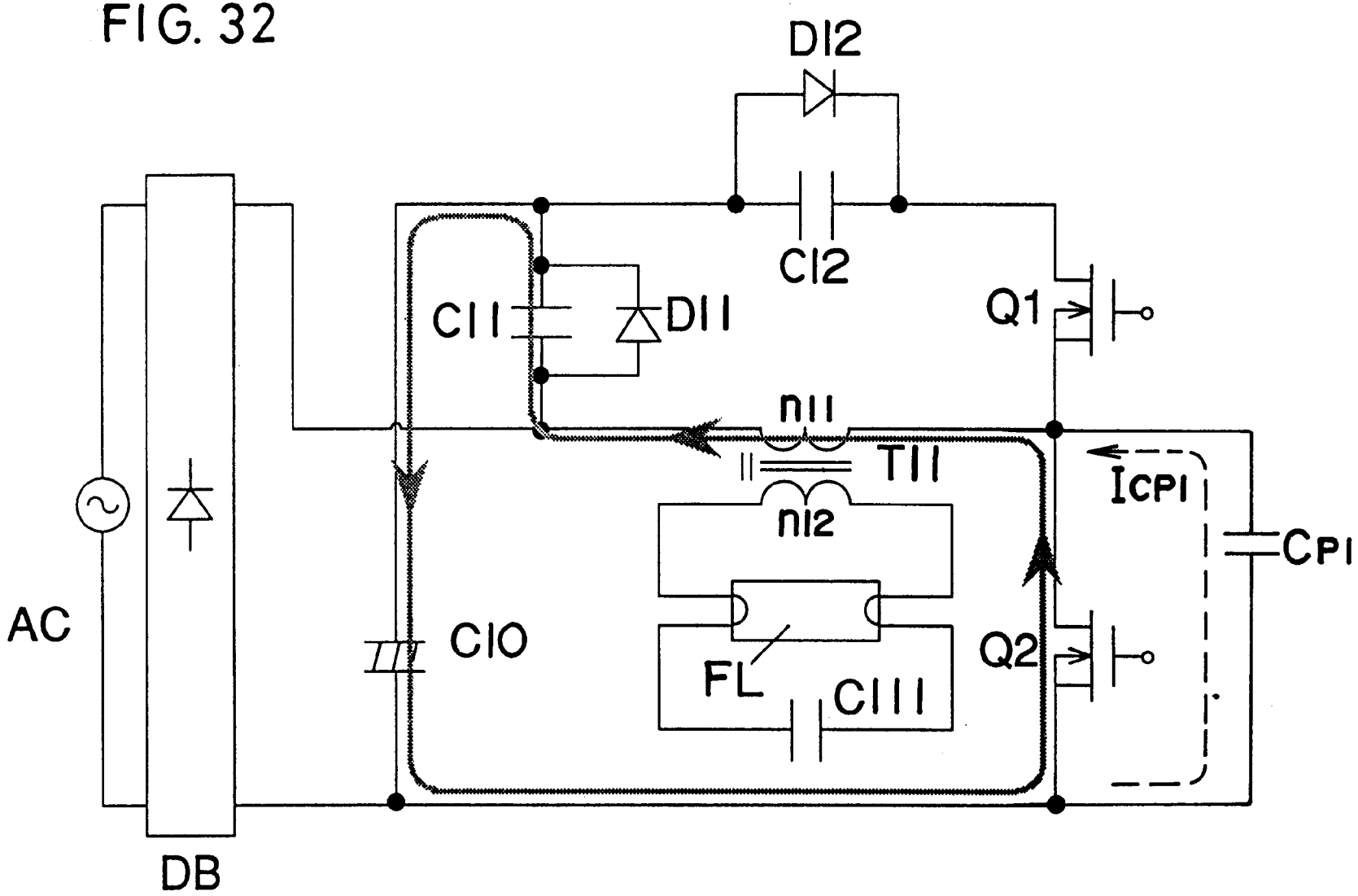
Figure 33:
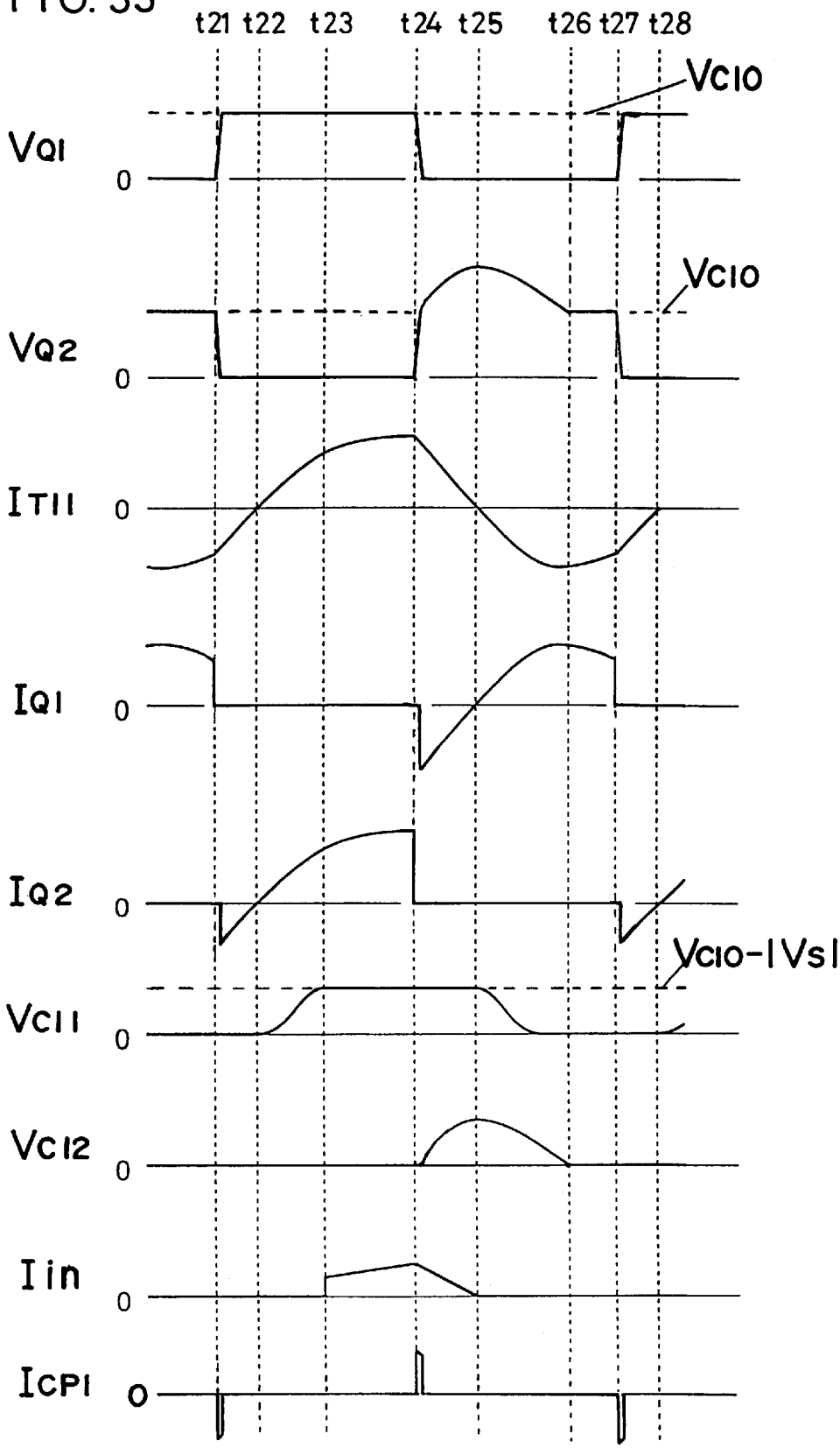
FIG. 33 shows in waveform diagrams respective signals at various parts in the circuit of FIG. 27 at the operation thereof.

FIGS. 28–32 are explanatory circuit diagrams for the operation of the discharge lamp lighting device shown in FIG. 27, FIG. 33 shows in waveform diagrams various signals at respective points in the operation of the device of FIG. 27, and the operation of this embodiment of FIG. 27 shall be described with reference to these drawings.

Figure 28:
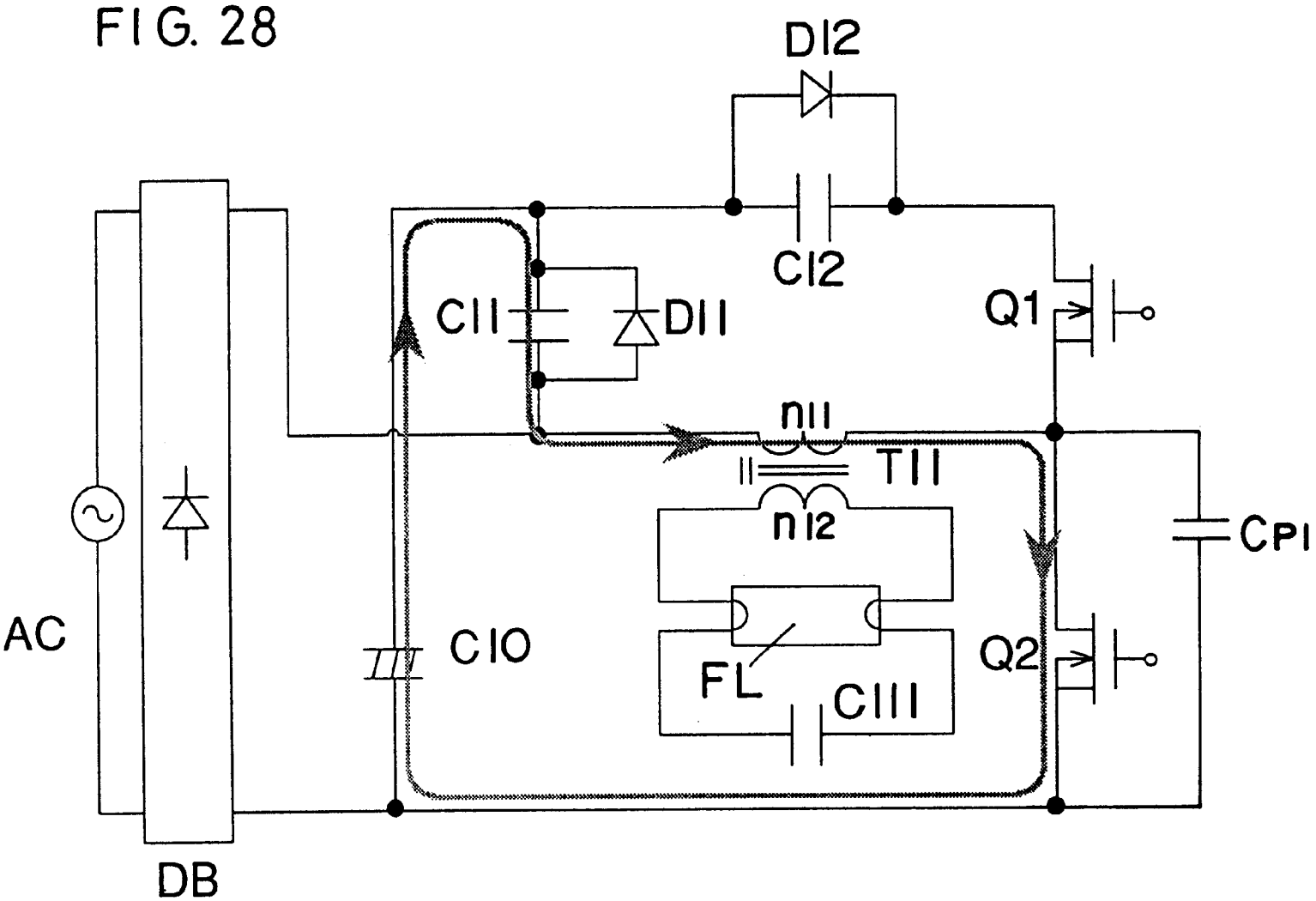
FIGS. 28–32 are explanatory circuit diagrams for the operation of the discharge lamp lighting device in FIG. 27.

Now, as time t22 shown in FIG. 33 is reached in a stationary state after charging of the smoothing capacitor C10, there flows a current IT11 through a path from the capacitor C10 to the first capacitor C11, primary winding n11, FET Q2 and back to the capacitor C10, as shown by arrows in FIG. 28, so that the first capacitor C11 will be charged by the smoothing capacitor C10 made as a power source, whereby the voltage VC11 of the capacitor C11 is increased, and a power is supplied through the transformer T11 to the load circuit 11, upon which the current IT11 does not flow to the capacitor CP1.

Figure 29:
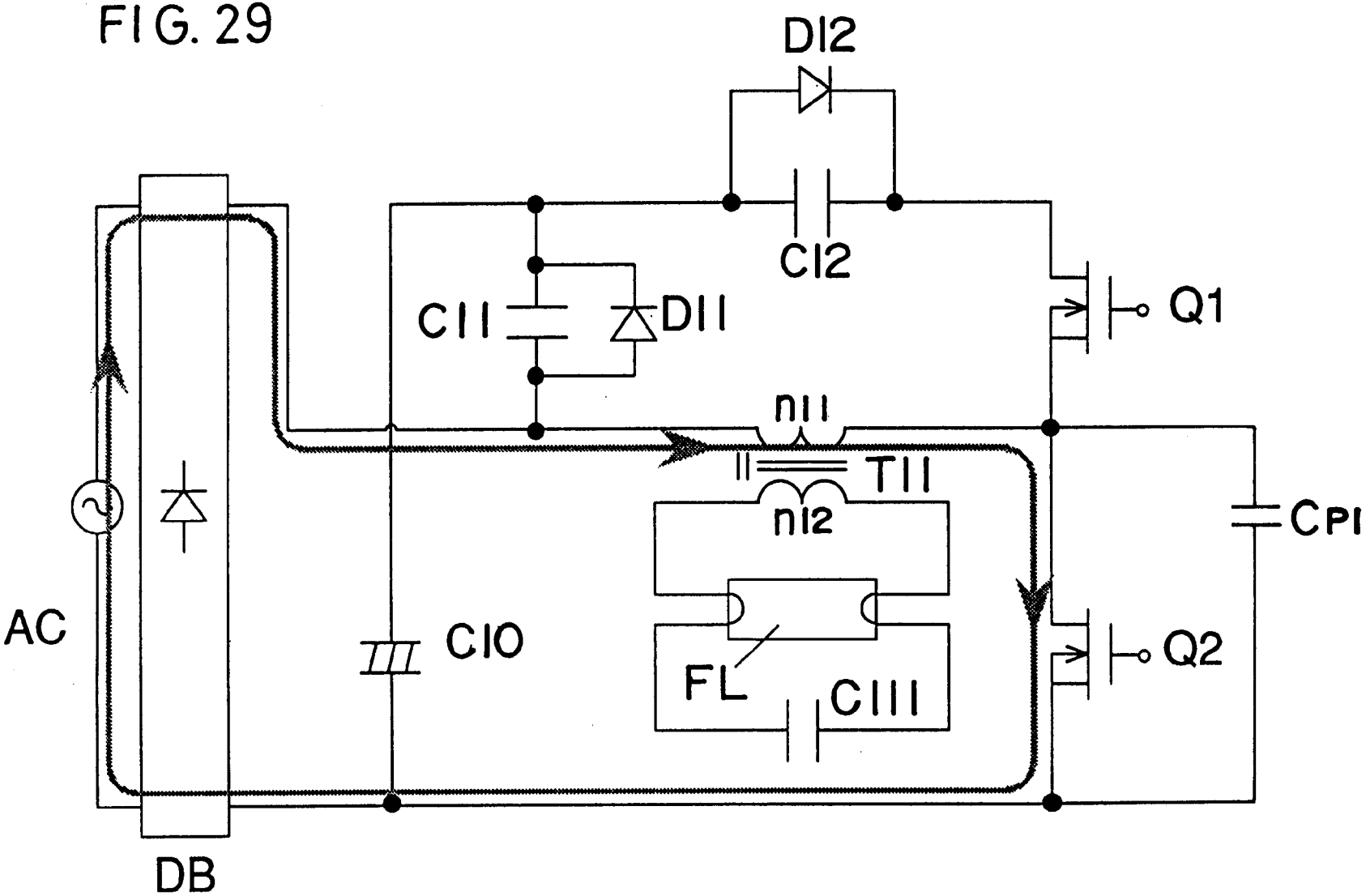

Thereafter, as the voltage VC11 of the capacitor C11 increases to reach a differential voltage (VC10–|Vs|) between the voltage VC10 and the output voltage |Vs| of the rectifier DB (at time t23 in FIG. 33), the current IT11 flows through a path of the AC power source AC, rectifier DB, primary winding n11, FET Q2, rectifier DB and source AC, as shown by arrows in FIG. 29, and the input current Iin is drawn from the source AC into the discharge lamp lighting device.

As FET Q2 turns OFF thereafter (at time t24 in FIG. 33), the energy accumulated in the transformer T11 causes a current ICP1 for charging the capacitor CP1 to flow, and a voltage VQ2 across FET Q2 increases gradually, while a current IQ2 flowing through FET Q2 becomes momentarily zero, whereby the switching loss at FET Q2 can be remarkably reduced.

Figure 30:
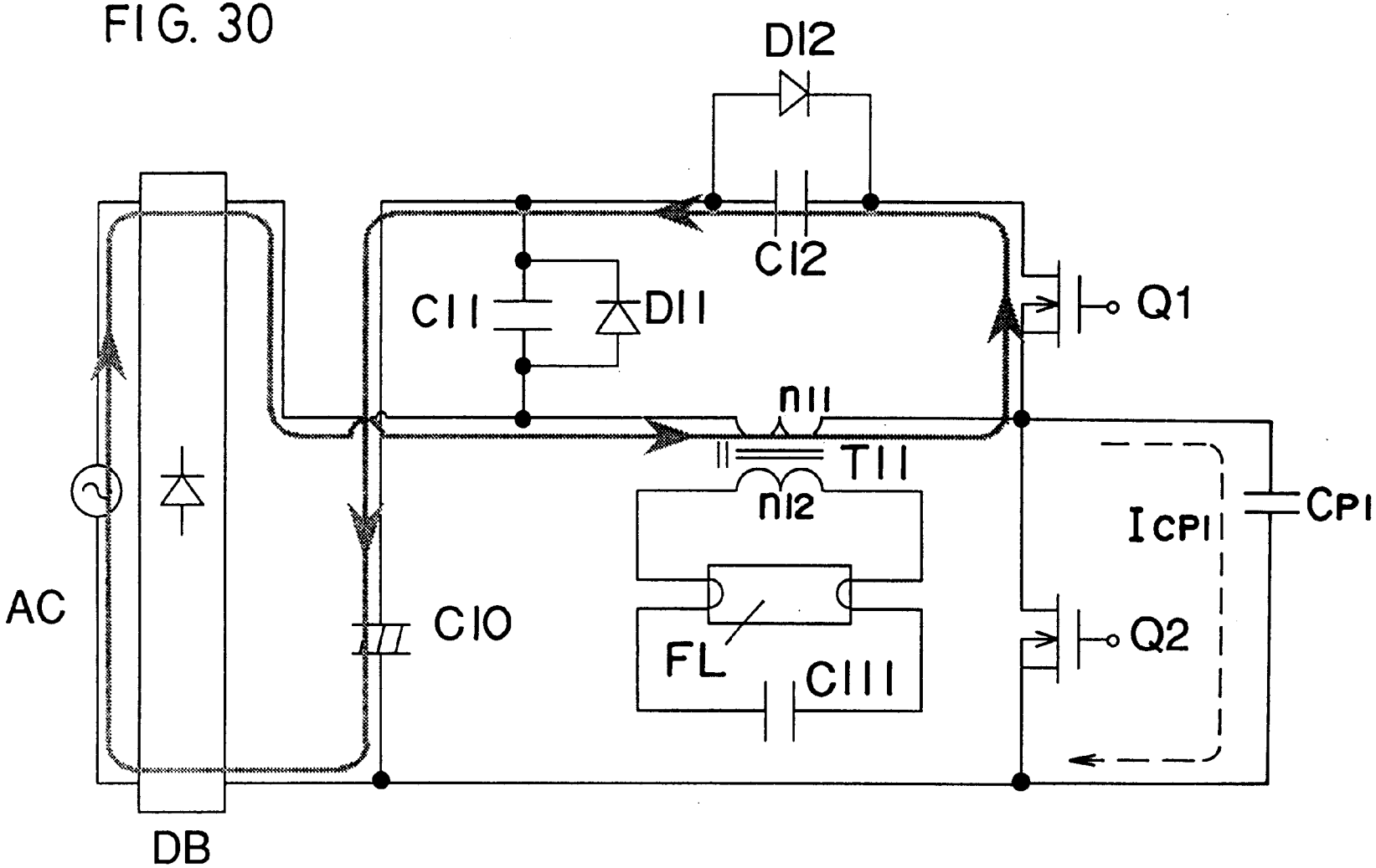

When the voltage VQ1 becomes zero, as shown in FIG. 30, the transformer T11 in which the energy is accumulated by the current flown through the primary winding n11 and the AC power source AC act as a source to cause the current IT11 to flow through a path of the source AC, rectifier DB, primary winding n11, parasitic diode of FET Q1, capacitor C12, smoothing capacitor C10, rectifier DB and source AC, and these capacitors C10 and C12 are charged while drawing the input current Iin into the device. At this time, the voltage VC12 of the capacitor C12 is caused to rise as shown in FIG. 33 by a resonance action with a leakage inductance of the transformer T11. FET Q1 is then turned ON.

Upon turning ON of FET Q1, the resonance action of the leakage inductance of the transformer T11 with the capacitors C11, C12 and C111 causes a resonance current to flow through a path, as shown by arrows in FIG. 31, of the capacitor C11, capacitor C12, FET Q1, primary winding n11 and capacitor C11. Thereafter, the voltages VC11 and VC12 of the capacitors C11 and C12 start dropping (at time t25 in FIG. 33), and their energies are supplied through the transformer T11 to the load circuit 11, upon which the direction of the current flowing to the primary winding n11 will be inverse to that in ON state of FET Q2, so that an alternating high frequency voltage will be applied to the load circuit 11. Thereafter. as the voltages VC11 and VC12 of the capacitors C11 and C12 reach zero (at time t26 in FIG. 33), the diodes D11 and D12 connected in parallel to these capacitors are turned ON to have the resonance current continued to flow.

Further, as FET Q1 turns OFF thereafter (at time t27 in FIG. 33), the energy accumulated in the transformer T11 causes the current ICP1 for charging the capacitor CP1 to flow so that the voltage VQ1 across FET Q1 gradually increases, whereas the current IQ1 becomes momentarily zero, as shown in FIG. 32, whereby any switching loss at FET Q1 can be remarkably reduced.

As the voltage VQ2 reaches zero, as shown in FIG. 32, a current is caused to flow through a path of the primary winding n11, capacitor C11, capacitor C10, parasitic diode of FET Q2 and primary winding n11, to have the energy accumulated in the transformer T11 discharged. Thereafter, as the discharge of the energy accumulated in the transformer T11 completes (at time t28), the circuit state at time t28 as shown in FIG. 28 restores.

According to the embodiment of FIG. 27, as has been described, it is possible to reduce the crest factor of the current flowing to the load circuit 11 without increasing the voltage of the capacitor C10, and also to reduce the switching loss by rendering the voltage rise at ON time of FET to be gradual.

Figure 34:
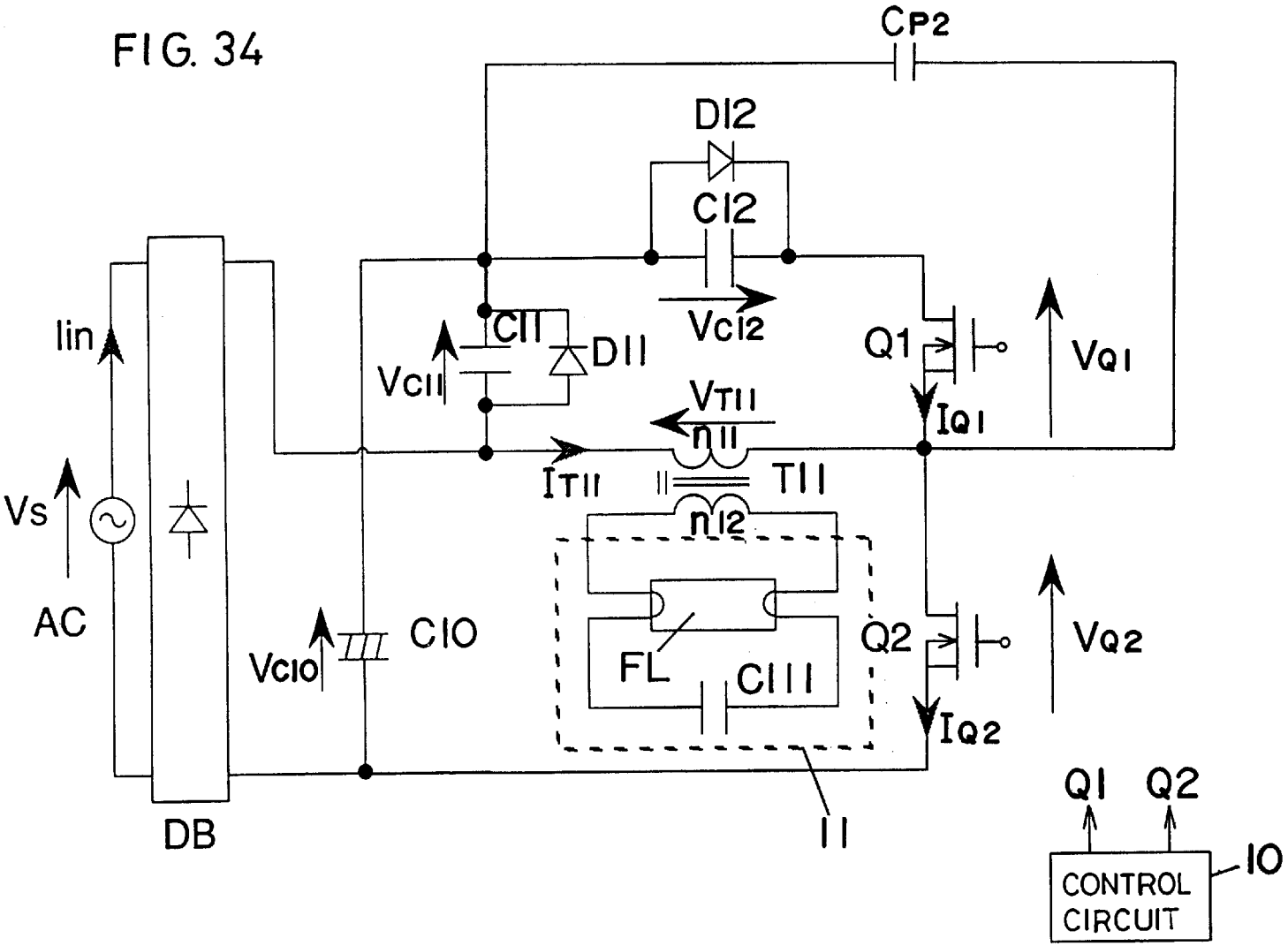
FIGS. 34–36 are schematic circuit diagrams showing still further embodiments of the discharge lamp lighting device according to the present invention.

FIG. 34 is a schematic circuit diagram of the discharge lamp lighting device in another embodiment of the present invention, which also comprises the same rectifier DB, capacitors C10–C12, diodes D11 and D12, FET's Q1 and Q2, transformer T11 and control circuit 10 as in the embodiment of FIG. 1, while the device is different therefrom in the provision of a further capacitor CP2.

In this case, the capacitor CP2 is connected at one end to the drain of FET Q2 and at the other end through the capacitor C10 to the source of FET Q2. That is, in the sense of high frequency, this capacitor CP2 is equivalent to one connected in parallel to FET Q2. Accordingly, in similar manner to the embodiment of FIG. 27, it is possible to reduce the switching loss.

Figure 35:
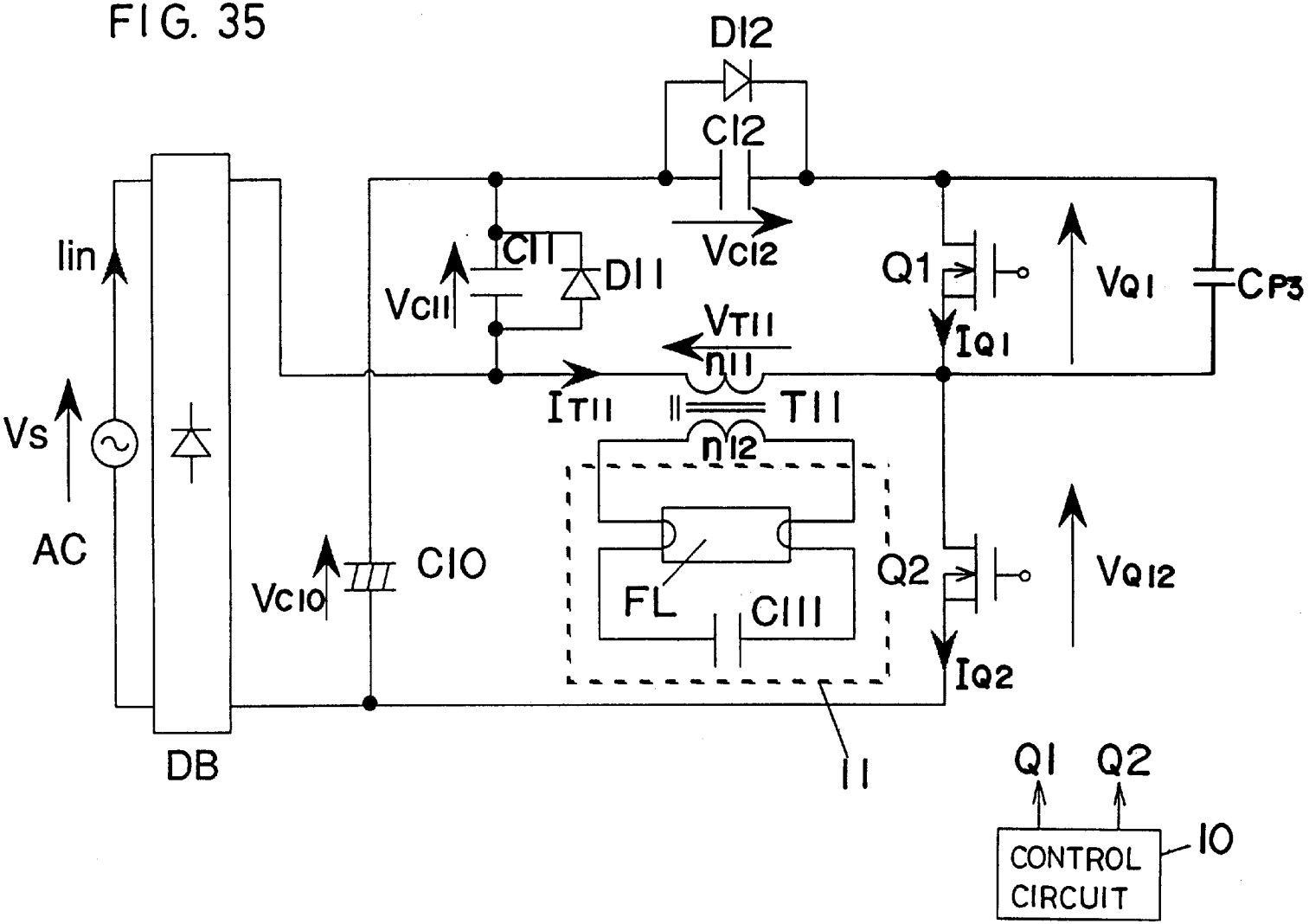

FIG. 35 is a schematic circuit diagram of the discharge lamp lighting device in another embodiment of the present invention, which device also comprises the same rectifier DB, capacitors C10–C12, diodes D11 and D12, FET's Q1 and Q2, transformer T11 and control circuit 10 as those in the embodiment of FIG. 1, while the device differs therefrom in the provision of a further capacitor CP3 connected in parallel to FET Q1. In this instance, the capacitor CP3 employed is of a smaller capacity than the capacitors C11 and C12, whereby the circuit operation of this embodiment is made substantially the same as that of the embodiment of FIG. 27, and the switching loss can be reduced.

Figure 36:
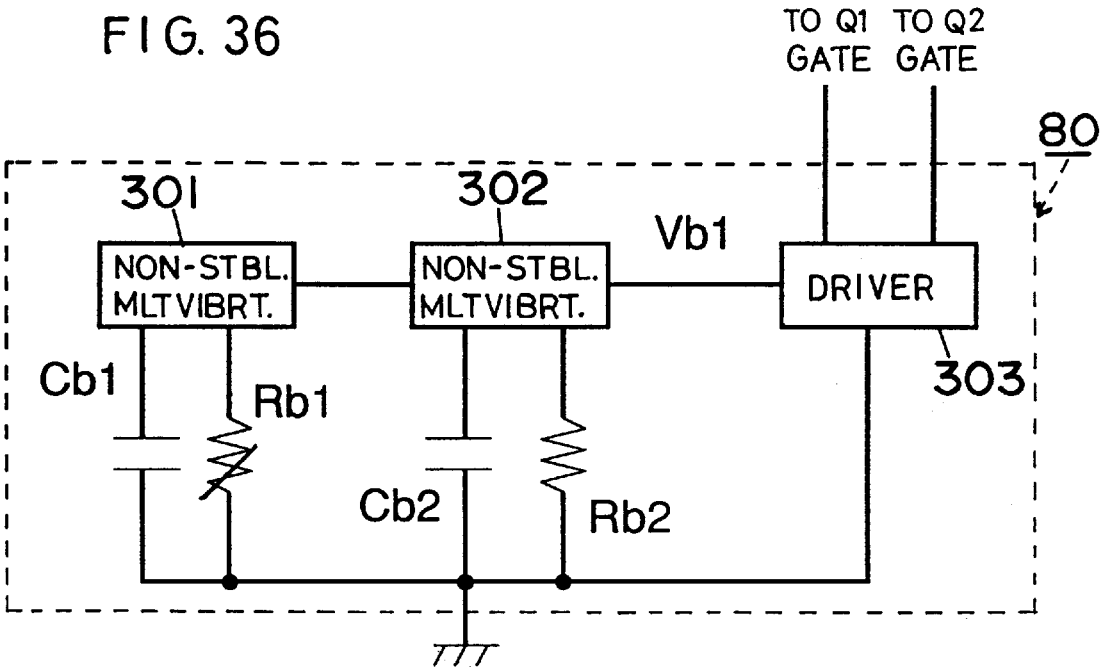

FIG. 36 is a schematic circuit diagram of a control circuit used in the discharge lamp lighting device in another embodiment of the present invention, FIGS. 37(*a*) and 37(*b*) are explanatory waveform diagrams for the operation of the control circuit, and the embodiment shall be described with reference to these drawings.

The discharge lamp lighting device of FIG. 36 comprises the same rectifier DB, capacitors C10–C12, diodes D11 and D12, FET's Q1 and Q2 and transformer T11 as in the embodiment of FIG. 1, while this device differs therefrom in the provision of the control circuit 80 for ON/OFF controlling of FET's Q1 and Q2 by properly modifying the switching frequency, ON period, duty ratio and so on, so as to adjust the power supplied to the load circuit 11 for enabling the dimmed lighting.

The control circuit 80 in this embodiment of FIG. 36 comprises an astable multivibrator 301 such as $\mu$PD5555C, a parallel connection of a capacitor Cb1 and a variable resistor Rbl connected at one end to the multivibrator 301 for determining oscillation frequency thereof, a monostable multivibrator 302 such as $\mu$PD5555C, a parallel connection of a capacitor Cb2 and a resistor Rb2 connected at one end to the monostable multivibrator for determining high period of an output pulse of the multivibrator, and a driver 303 for turning, for example, FET Q1 ON and FET Q2 OFF when an output pulse Vb1 of the monostable multivibrator 302 is high.

Figure 37A:
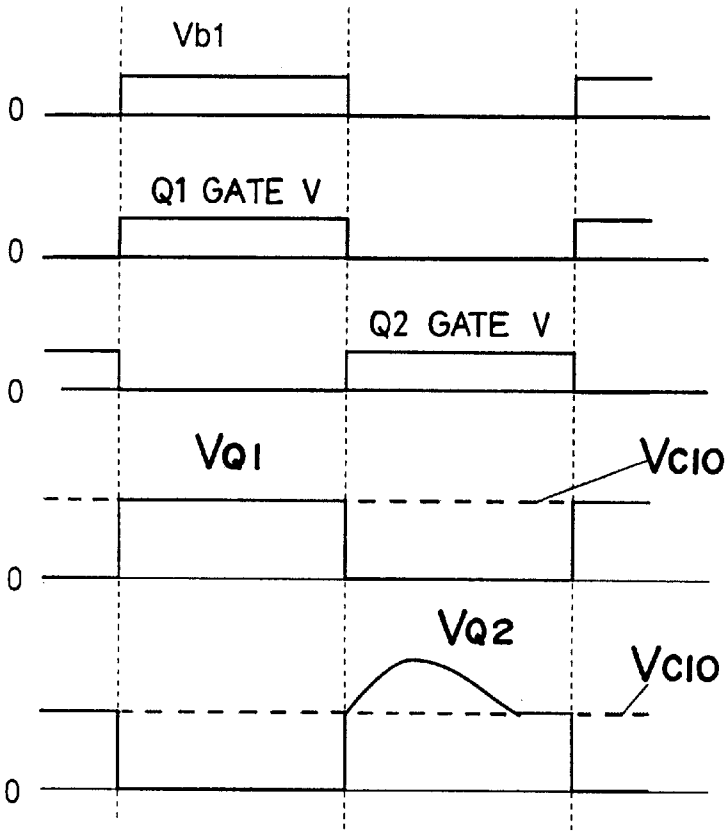
FIGS. 37(*a*) and 37(*b*) are explanatory waveform diagrams for the operation of a control circuit in the embodiment of FIG. 36.
Figure 37B:
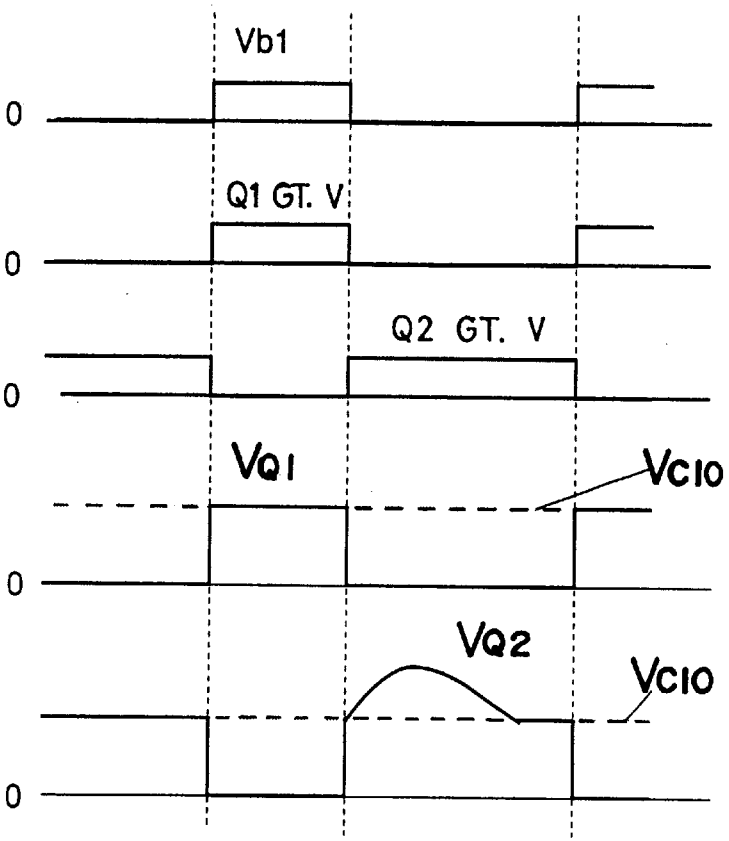

Referring briefly to the circuit operation of this control circuit 80 next, FET's Q1 and Q2 are alternately turned ON and OFF in the rated lighting, as shown in FIG. 37(*a*). When the rated lighting is shifted to the dimmed lighting, FET's Q1 and Q2 are alternately turned ON and OFF with output pulses of a switching frequency modified higher as shown in FIG. 37(*b*), in order to lower the output of the discharge lamp FL, upon which the ON period of FET Q2 made constant causes the voltage VQ2 of FET Q2 to decrease until it becomes substantially equal to the voltage VC10 of the capacitor C10 even when the switching frequency increases, as a result of which the switching loss can be reduced.

Figure 38:
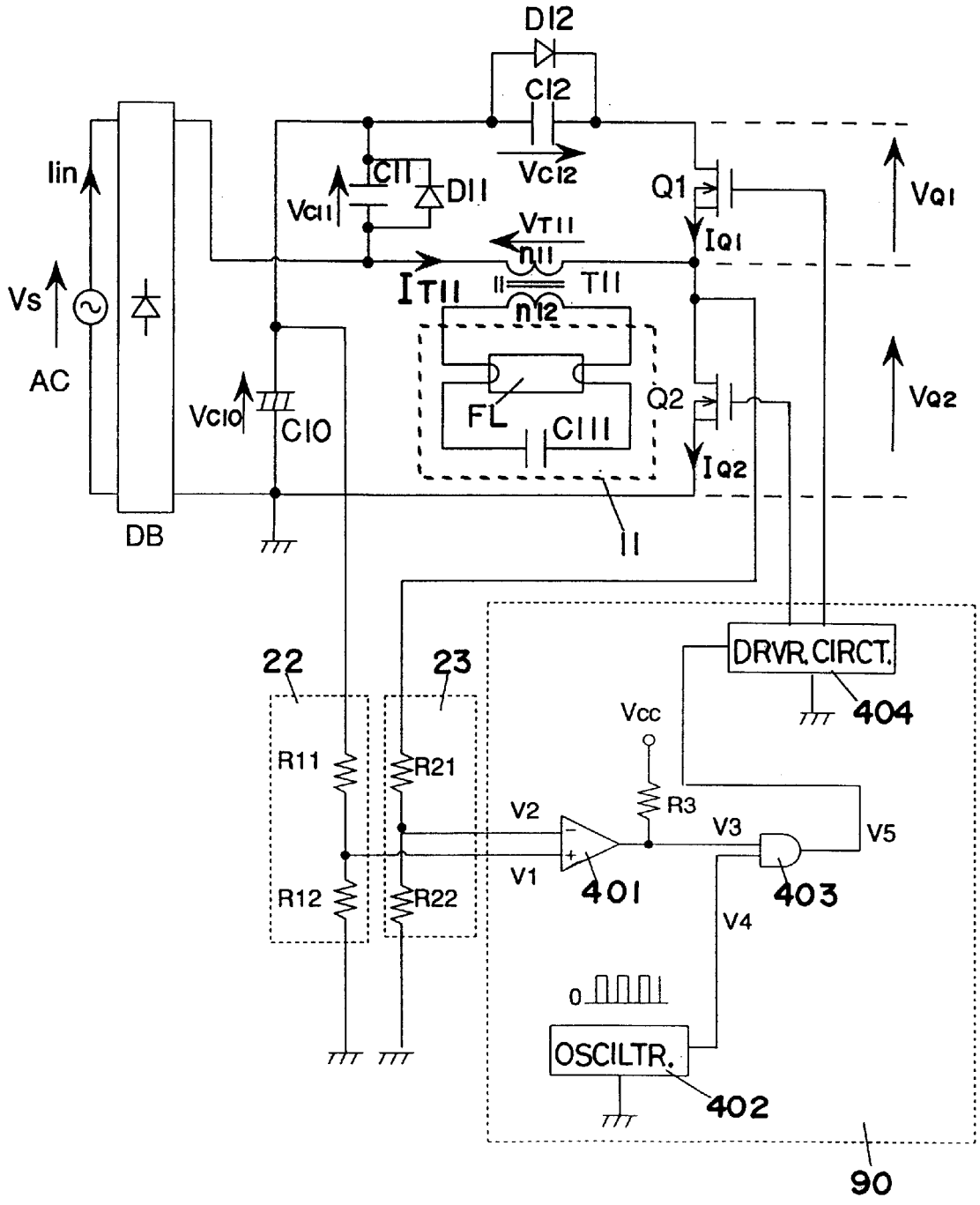
FIG. 38 is a schematic circuit diagram showing another embodiment of the discharge lamp lighting device according to the present invention.

FIG. 38 is a schematic circuit diagram of the discharge lamp lighting device in another embodiment of the present invention, FIGS. 39(*a*) and 39(*b*) are explanatory waveform diagrams for the operation of the control circuit in the present discharge lamp lighting device, and the embodiment of FIG. 38 shall be described with reference to these drawings.

The discharge lamp lighting device of FIG. 38 comprises the same rectifier DB, capacitors C10–C12, diodes D11 and D12, FET's Q1 and Q2 and transformer T11 as those in the embodiment of FIG. 1, but this device is different therefrom in the provision of a detecting circuit 22 which comprises a series circuit of resistors R11 and R12 and connected in parallel to the smoothing capacitor C10 for outputting as a voltage V1, at junction point of the resistors R11 and R12, the voltage across the capacitor C10, a detecting circuit 23 which comprises a series circuit of resistors R21 and R22 and connected in parallel to FET Q2 for outputting as a voltage V2, at junction point of the resistors R21 and R22, a voltage across the drain and source of FET Q2, and a control circuit 90 for ON/OFF controlling FET's Q1 and Q2 in response to both output signals from both detecting circuits 22 and 23 so as to adjust the supplied power to the load circuit 11 for the dimmed lighting.

Here, it is assumed that the resistors R11, R12 and R21, R22 are set to be at values which satisfy (R12/(R11+R12)) >(R22/(R21+R22)).

The control circuit 90 comprises a comparator 401 receiving at its non-inverting and inverting input terminals the output voltages V1 and V2 of the detecting circuits 22 and 23, a resistor R3 connected between an output terminal of this comparator 401 and a line of a voltage Vcc, an oscillator 402 of which the frequency and duty ratio are variable, an AND circuit 403 taking AND of output voltages V3 and V4 of the comparator 401 and oscillator 402, and a driver circuit 404 for turning FET's Q1 and Q2 ON/OFF in response to an output voltage V5 of the AND circuit 403.

Figure 39A:
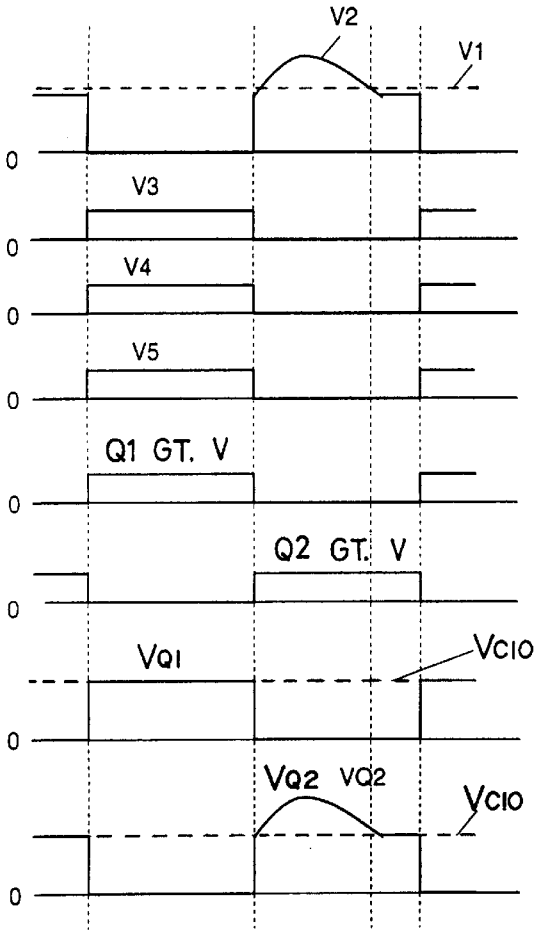
FIGS. 39(*a*) and 39(*b*) are explanatory waveform diagrams for the operation of a control circuit in the embodiment of FIG. 38.
Figure 39B:
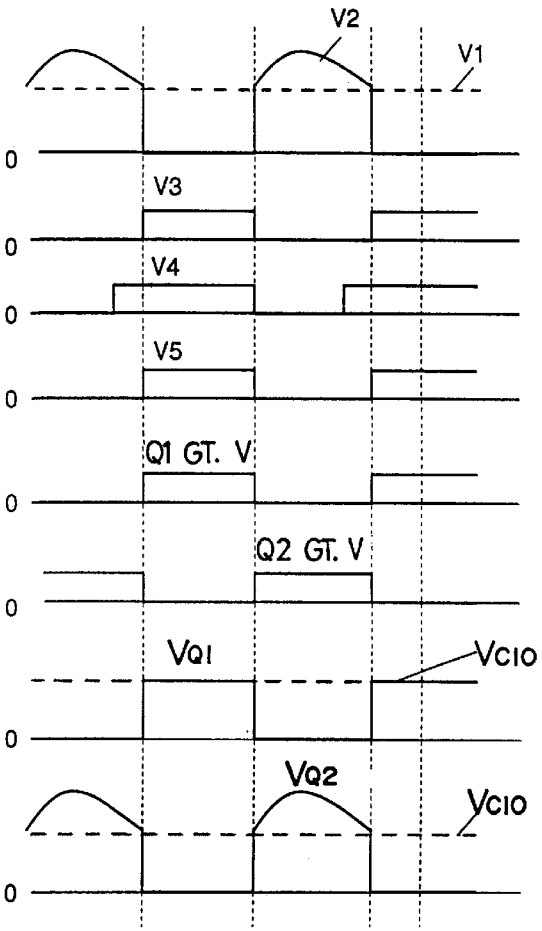

Referring next briefly to the operation of the control circuit 90, FET's Q1 and Q2 are alternately turned ON/OFF as shown in FIG. 39(*a*) in the rated lighting state. When this state shifts to the dimmed lighting state, FET's Q1 and Q2 are alternately turned ON/OFF at a switching frequency modified to be higher as shown in FIG. 39(*b*), so as to decrease the output of the discharge lamp FL, upon which the output voltage V3 of the comparator 401 will be High level when the voltage V1 is higher than the voltage V2 but will be Low level when the voltage V1 is lower than the voltage V2. On the other hand, the output of the oscillator 402 is modified so as to render ON period of FET's Q1 and Q2 to be unbalanced. The AND voltage V5 of these output voltages V3 and V4 will be an input signal to the driver circuit 404 and, even when the switching frequency of FET's Q1 and Q2 becomes higher, FET Q2 is turned ON only when the output of the oscillator 402 is at High level.

Therefore, similar to the embodiment of FIG. 38, it is possible to prevent the switching loss from increasing.

Figure 40:
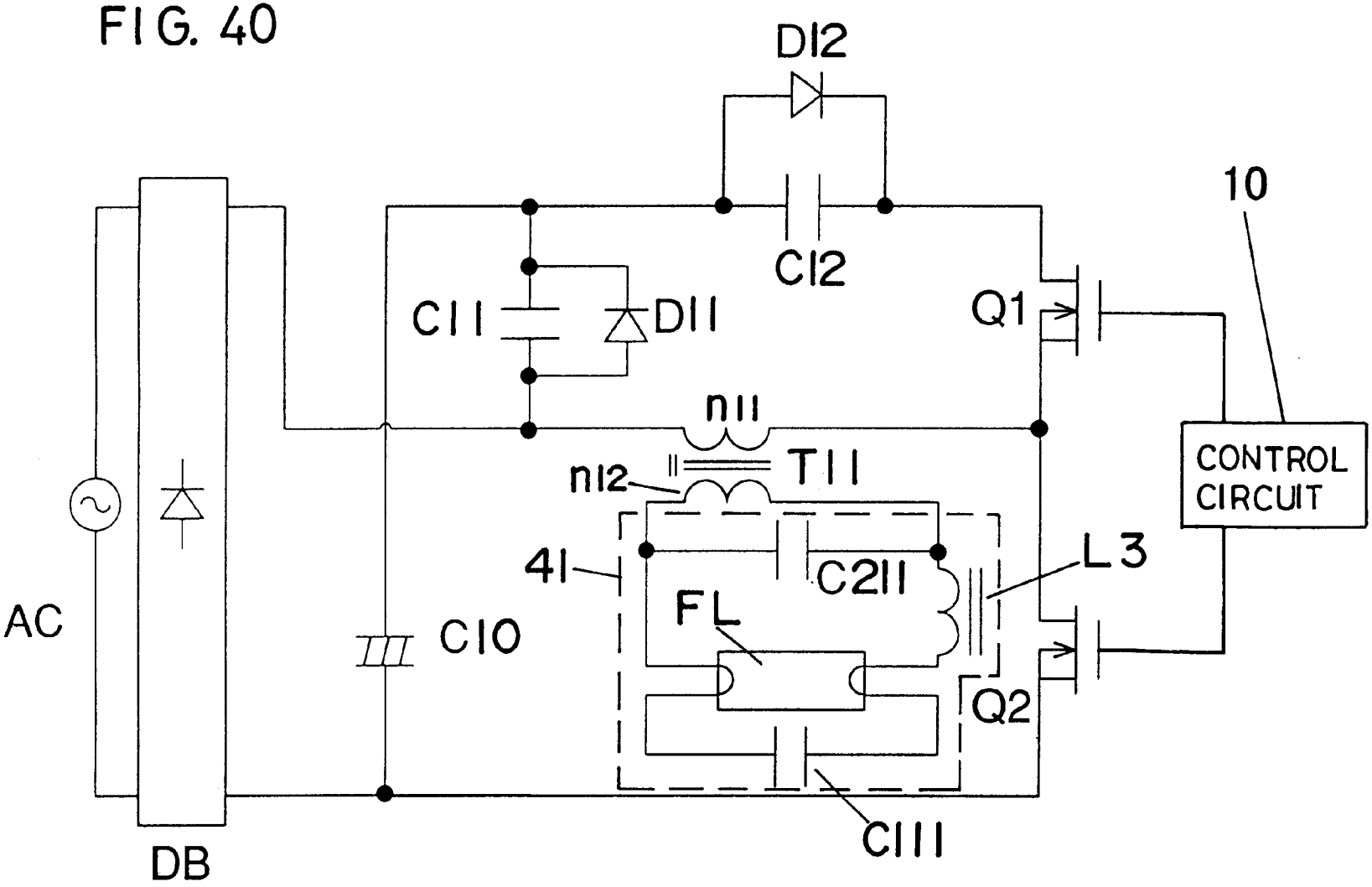
FIG. 40 is a circuit diagram showing an example of application of the device in the embodiment of FIG. 1 to another load circuit.

FIG. 40 is a circuit diagram showing an example of application of the discharge lamp lighting device in the embodiment of FIG. 1 to another load circuit, in which the load circuit 41 comprises a capacitor C211 connected in parallel to the primary winding n12 of the transformer T11, a discharge lamp FL having a pair of filaments connected at their one end to both ends of the capacitor C211, a preheating and resonating capacitor C111 connected across the other ends of the filaments of the lamp, and an inductor L3 interposed in one of both connecting lines between the capacitor C211 and the discharge lamp FL.

Figure 41:
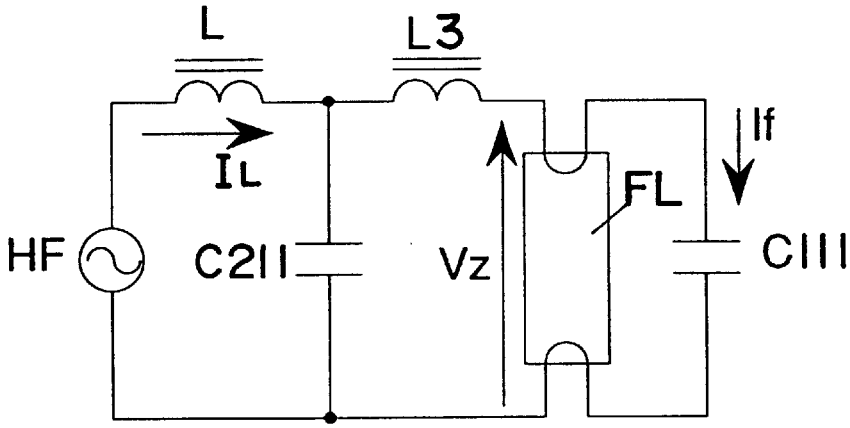
FIG. 41 is an equivalent circuit diagram to that of FIG. 40.

Assuming in this case that a high frequency oscillation of the transformer T11 is a high frequency oscillation source HF and the leakage inductor of the transformer T11 as viewed from the side of the secondary winding n12, the circuit shown in FIG. 40 can be replaced by an equivalent circuit shown in FIG. 41.

Figure 42A:
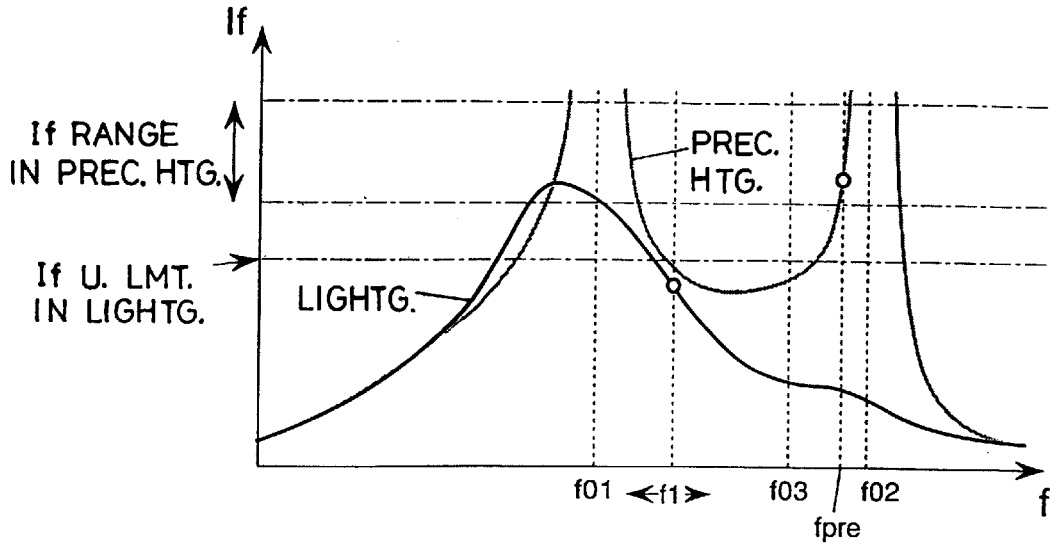
FIGS. 42(*a*) and 42(*b*) are frequency characteristic diagrams of the equivalent circuit in FIG. 40.
Figure 42B:
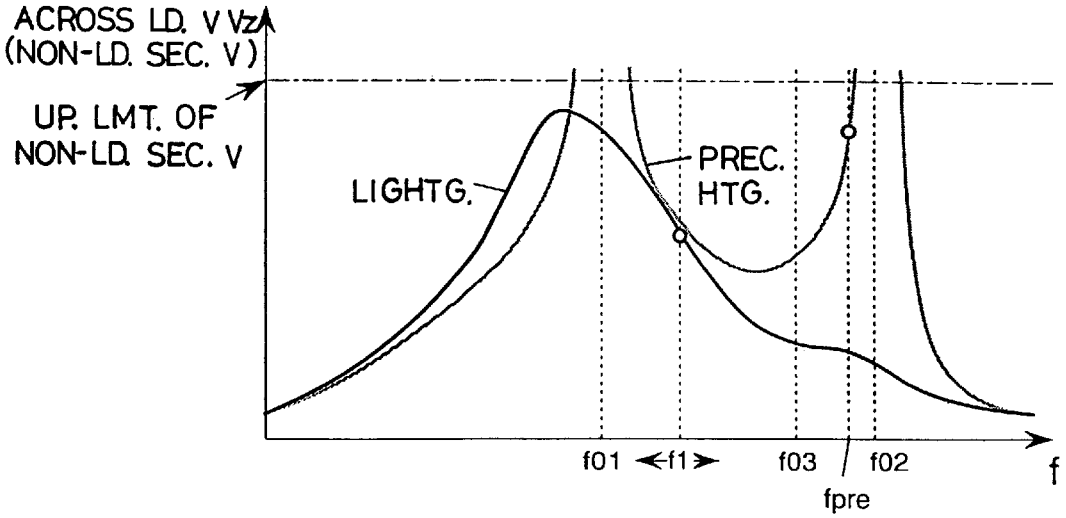

Since this equivalent circuit is caused to have two resonance frequencies f01 and f02 by a resonance circuit formed with an inductance L, the inductor L3 and capacitors C111 and C211, its frequency characteristics will be as shown in FIG. 42, while a frequency f03 shown in FIG. 42 will be an antiresonance frequency given by a following formula with respective values of the inductor L3 and capacitor C111 employed:

$$f03 = \frac{1}{2 \times \pi \times \sqrt{L3 \times C111}}$$

In an event of light load, a voltage Vz across the load and a filament current If will have a peak value, and will be dipped at the antiresonance frequency f03 between the resonance frequencies f01 and f02.

The lighting and dimmed lighting of the discharge lamp FL are performed in a frequency range f1 where an output adjacent to the resonance frequency f01 can be taken. On the other hand, the preceding preheating is carried out at a frequency fpre adjacent to the resonance frequency f02 at which an applied voltage to the lamp in the preceding preheating sufficiently low enough for not starting a proper preceding preheating current and discharge can be secured.

In a event where the discharge lamp FL is of the small diametered type, it is required to set the capacity of the capacitor C111 to be low, so as to reduce the preheating current upon the lighting. Upon the preceding preheating, on the other hand, it is required to increase the preheating current. With the device of FIG. 40, it is enabled by the second peak of resonance to flow a large preceding preheating current. In setting the relationship between the applied voltage to the lamp upon the preceding preheating and the preceding preheating current in this case, it will suffice the purpose to adjust the constants of the inductance L, inductor L3 and capacitors C111 and C211 and, as these constants are adjusted, frequency intervals of the resonance frequencies f01 and f02 are varied, so as to vary the resonance curve.

According to the embodiment shown in FIG. 40, as has been described, it is made possible to satisfy the preheating conditions even with the discharge lamp of small diametered type, by the presence in the load resonance circuit of two resonance frequencies and one antiresonance frequency, and the discharge lamp of small diametered type can be optimally lighted. While in the embodiment of FIG. 40 the transformer T11 is the leakage transformer, the arrangement is not limited thereto but an arrangement in which a transformer having no leakage component is provided with an inductor corresponding to the particular leakage may of course be employed.

Figure 43:
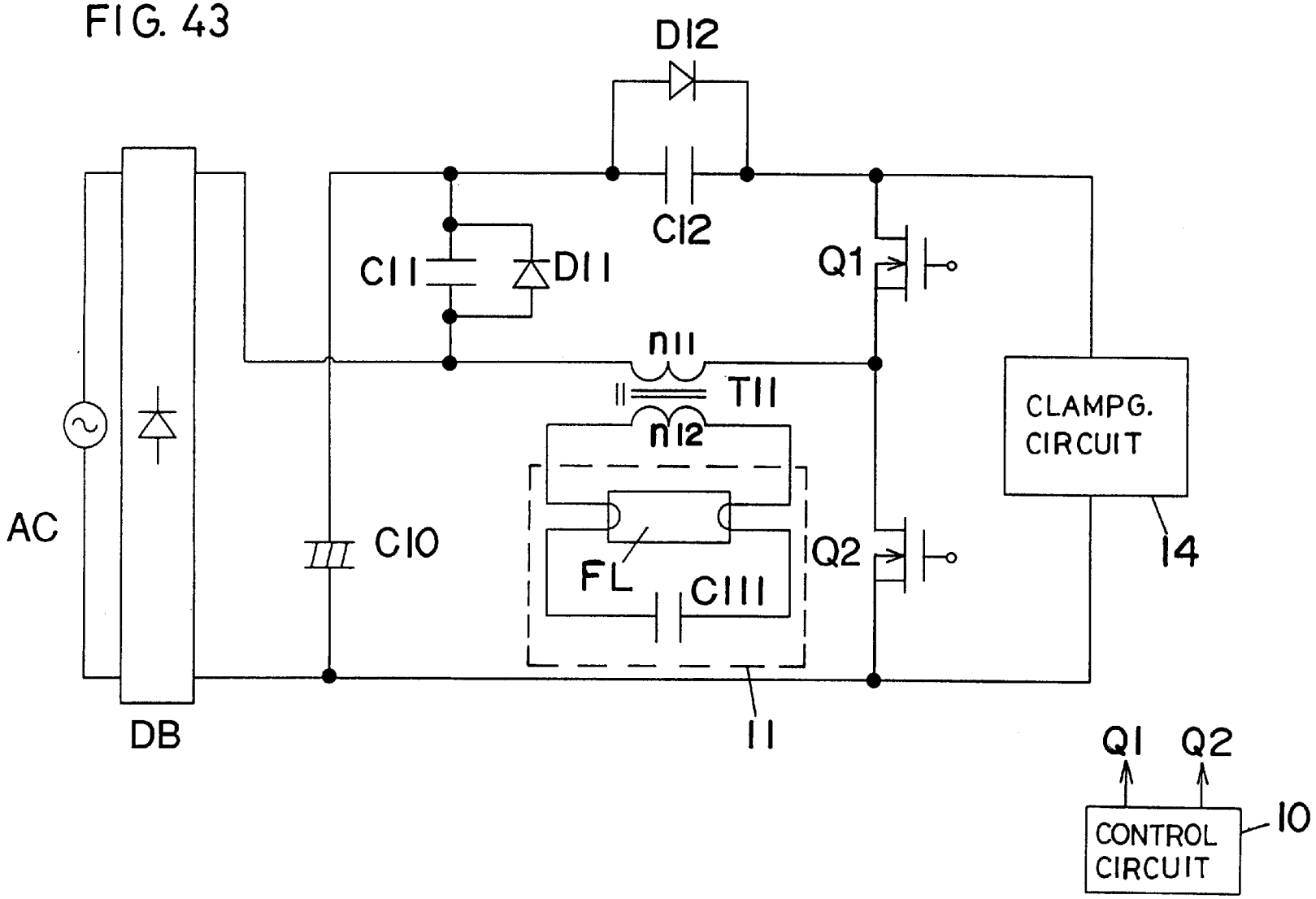
FIGS. 43–50 are schematic circuit diagrams showing still other embodiments of the discharge lamp lighting device according to the present invention.

FIG. 43 is a schematic circuit diagram of the discharge lamp lighting device in another embodiment of the present invention, in which the device is arranged in the same manner as in the embodiment of FIG. 1, while the device differs therefrom in a further provision of a clamp circuit 14 connected in parallel to FET's Q1 and Q2.

The clamp circuit 14 is of a high impedance in the event where the circuit operates normally and gives no substantial influence on the circuit operation. When on the other hand the voltage of the capacitor C12 which is performing a voltage resonance type operation is caused to abruptly increment in the event of an abnormal condition such as an abrupt change in the impedance of the load circuit 11, removal of the discharge lamp FL, at the end of lamp life and soon, such voltage arose is clamped by the circuit 14 at a predetermined voltage value, whereby any overvoltage can be prevented from being applied to the circuit elements and any damage of the elements can be prevented.

Figure 44:
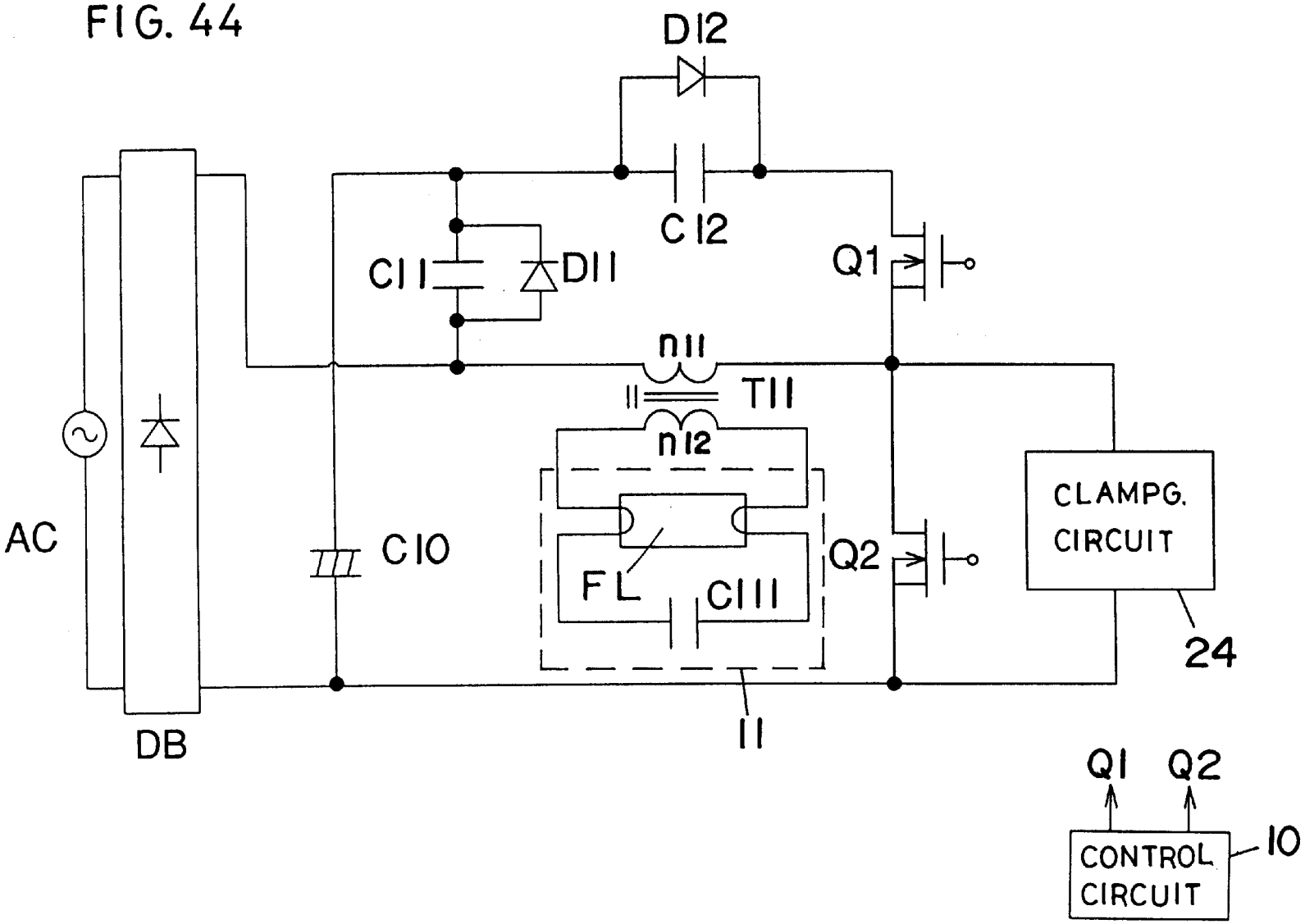

FIG. 44 is a schematic circuit diagram of the discharge lamp lighting device in another embodiment of the present invention, in which the device is arranged in the same manner as in the embodiment of FIG. 1, while the device differs therefrom in a further provision of a clamp circuit 24 connected in parallel with FET Q2 only.

In this embodiment of FIG. 44, too, the voltage of the capacitor C12 performing the voltage resonance type operation upon occurrence of the abnormal condition such as the abrupt change in the impedance of the load circuit 11 and the like and abruptly arose can be clamped at a predetermined voltage value, so that the overvoltage application to the circuit elements can be prevented and the circuit elements can be prevented from being damaged.

Figure 45:
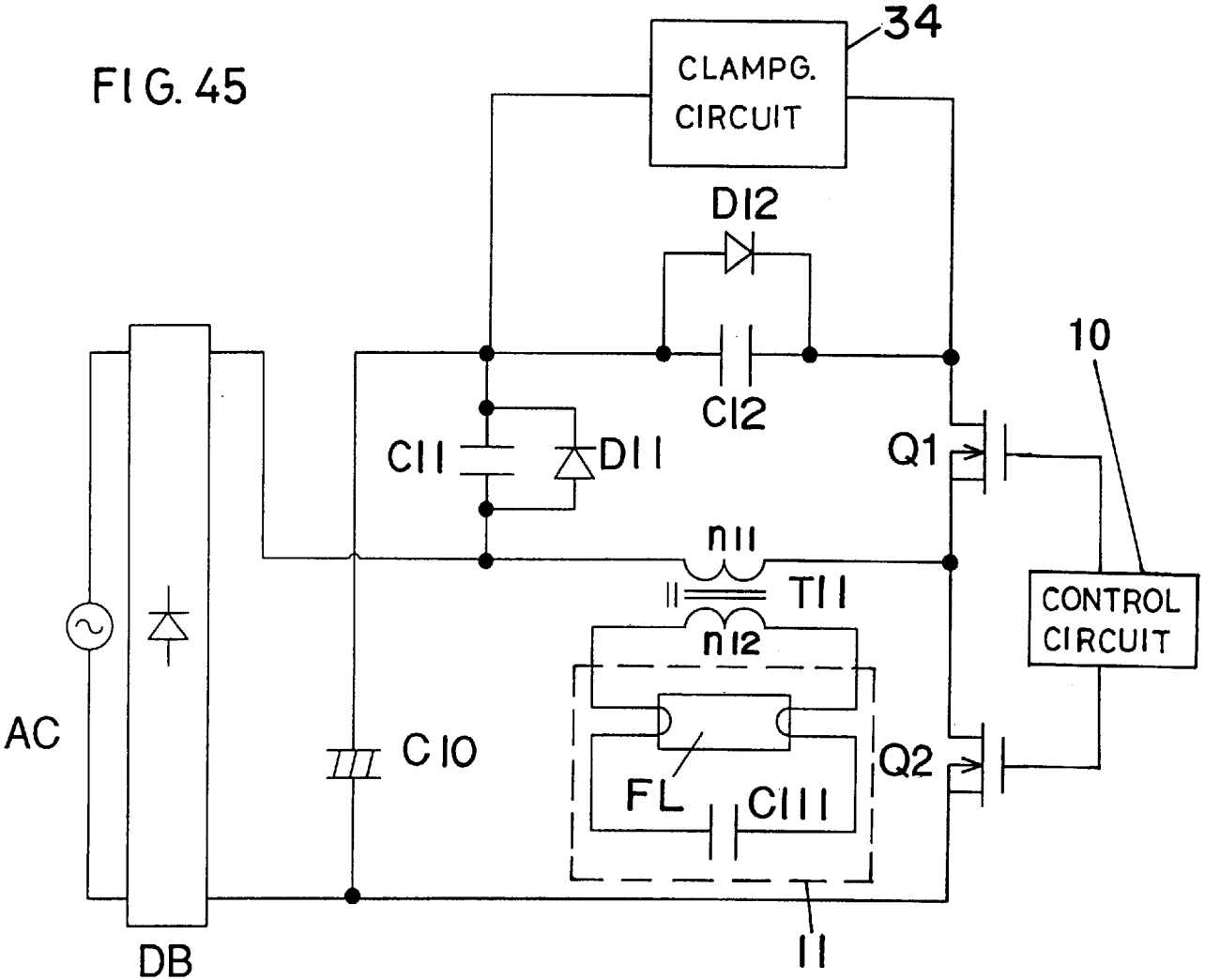

FIG. 45 is a schematic circuit diagram of the discharge lamp lighting device in another embodiment of the present invention, in which the device is arranged in the same manner as in the embodiment of FIG. 1, while this device differs therefrom in a further provision of a clamp circuit 34 connected in parallel to the capacitor C12.

In this embodiment of FIG. 45, too, the voltage abruptly arose of the capacitor C12 performing the voltage resonance type operation upon the abnormal condition such as the abrupt change in the impedance of the load circuit 11 is clamped at the predetermined voltage value, so that any overvoltage can be prevented from being applied to the circuit elements, and the elements can be prevented from being damaged.

Figure 46:
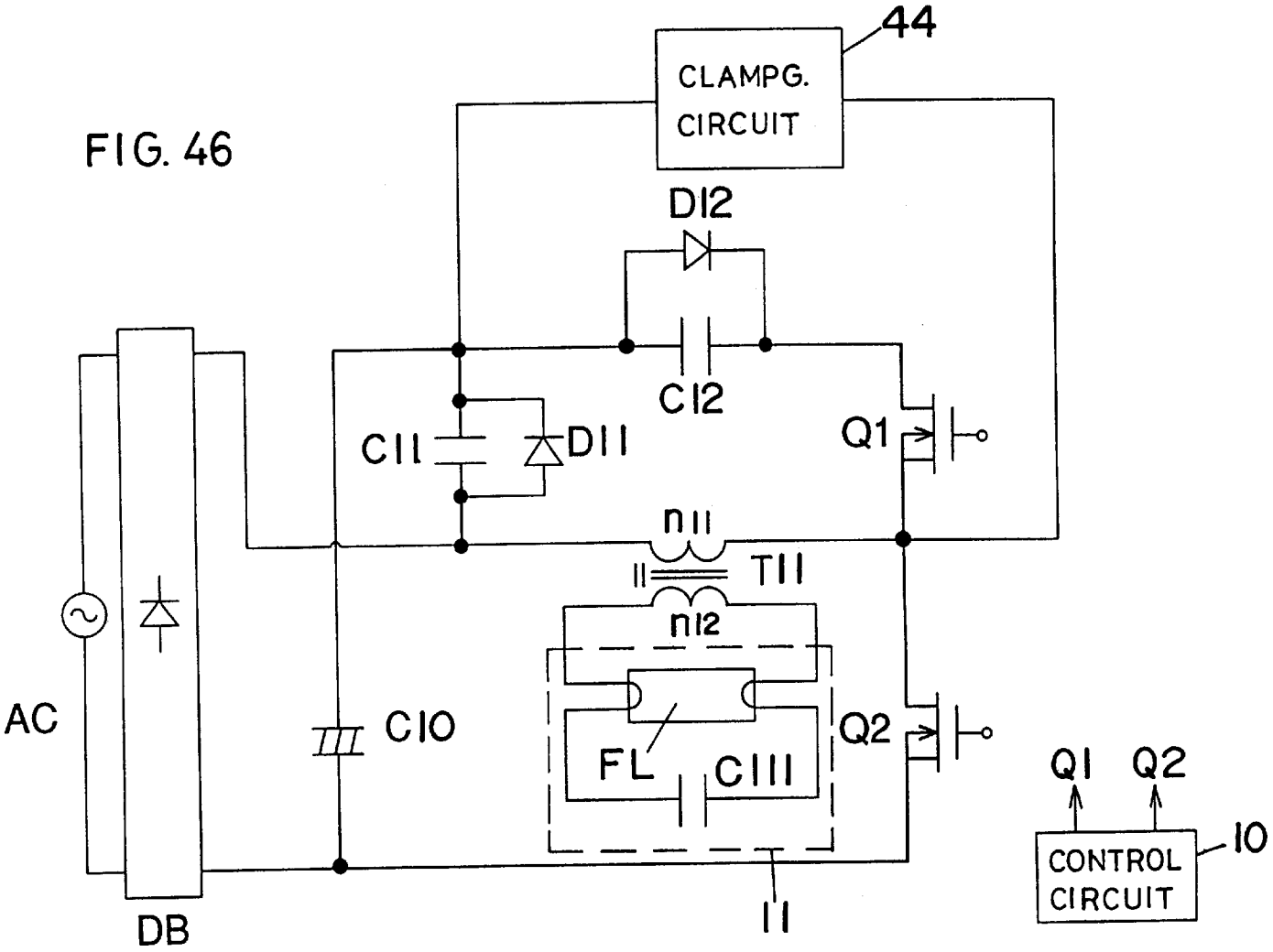

FIG. 46 is a schematic circuit diagram of the discharge lamp lighting device in another embodiment of the present invention, which device is arranged in the same manner as in the embodiment of FIG. 1, except for a further provision of a clamp circuit 44 connected between the junction point of the capacitors C11 and C12 and the junction point of FET's Q1 and Q2.

Also in this embodiment of FIG. 46, the voltage abruptly arose of the capacitor C12 performing the voltage resonance type operation upon the abnormal condition such as the abrupt change in the impedance of the load circuit 11 is clamped at the predetermined voltage value, so that the application of overvoltage to the circuit elements can be prevented so as to prevent the elements from being damaged.

Figure 47:
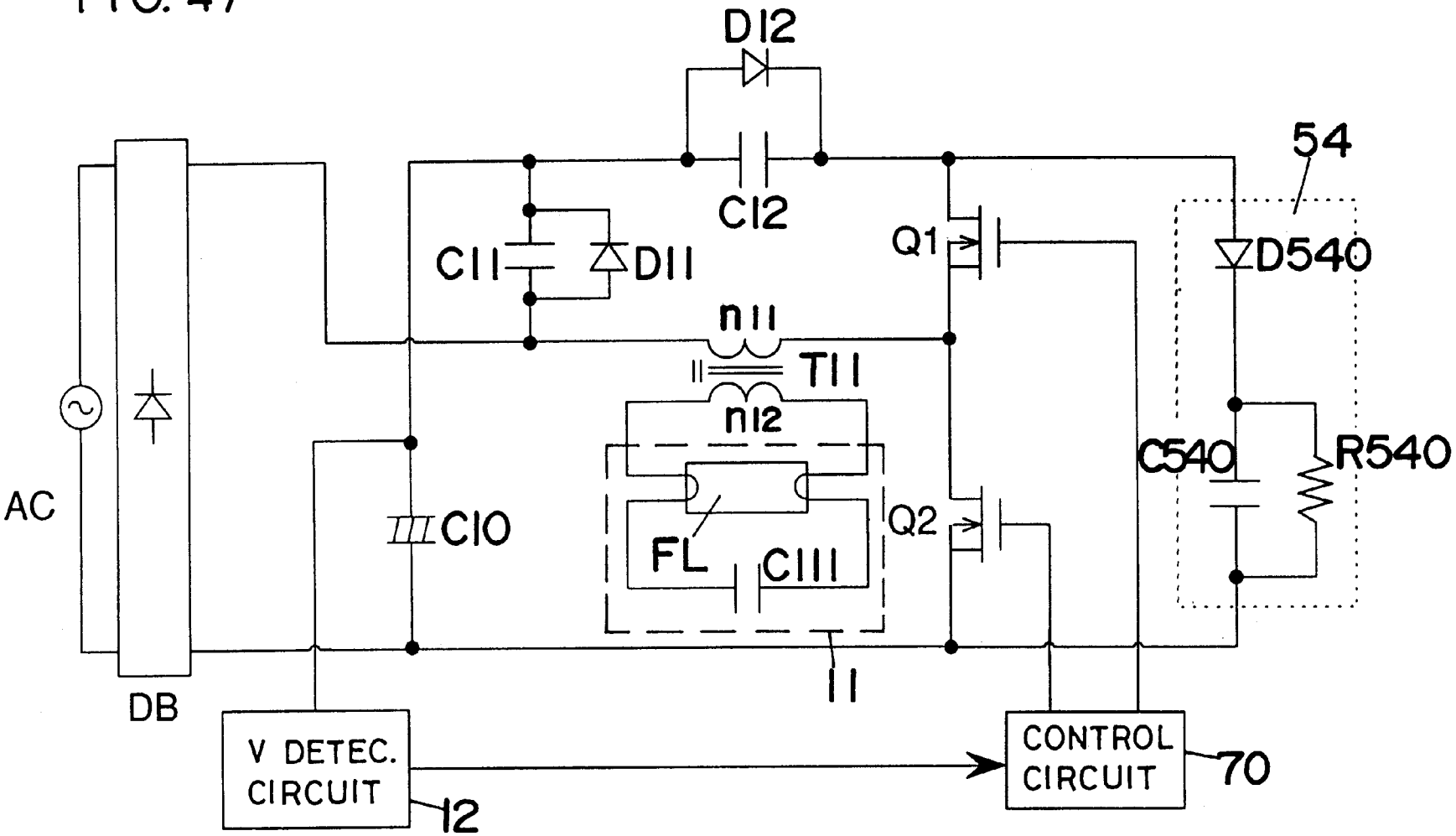

FIG. 47 is a schematic circuit diagram of the discharge lamp lighting device in another embodiment of the present invention, which device is arranged in the same manner as in the embodiment of FIG. 26, except for a further provision of a clamp circuit 54 connected in parallel to FET's Q1 and Q2.

The clamp circuit 54 comprises a diode D540 connected at the anode to the drain of FET Q1, a capacitor C540 connected between the cathode of the diode D540 and the source of FET Q2, and a resistor R540 connected in parallel to the capacitor C540. So long as the circuit operates normally, substantially a peak voltage of a sum of the voltage VC12 of the capacitor C12 and the voltage VC10 of the capacitor C10 is applied to the capacitor C540.

Upon the abrupt increment in the voltage of the capacitor C12 performing the voltage resonance type operation in the event of such abnormal condition as the abrupt change in the impedance of the load circuit 11, such abrupt voltage increment can be restrained by a turning ON of the diode D540 to charge the capacitor C540, and the overvoltage application to the circuit elements can be prevented, whereby it is made possible to detect the voltage increment at the capacitor C12, for example, to control FET's Q1 and Q2, and the circuit can be arranged for protecting the circuit so that any excessive stress can be prevented from being applied to the circuit elements.

The capacity of the capacitor C540 is so selected that the circuit elements will not be damaged by any overvoltage occurring momentarily upon the abnormal condition. Further, the resistor R540 is to adjust the discharge amount of the capacitor C540 so that, in normal condition, the voltage of the capacitor C540 is retained at the peak voltage described before and, in abnormal condition, the voltage retained at the capacitor C540 can be restrained to a level capable of preventing the circuit elements from being damaged.

In this embodiment of FIG. 47, too, similar to the embodiment of FIG. 43, any overvoltage application to the circuit elements can be prevented upon such abnormal condition as the abrupt change in the impedance of the load circuit 11, and the damage of the circuit elements can be prevented.

Figure 48:
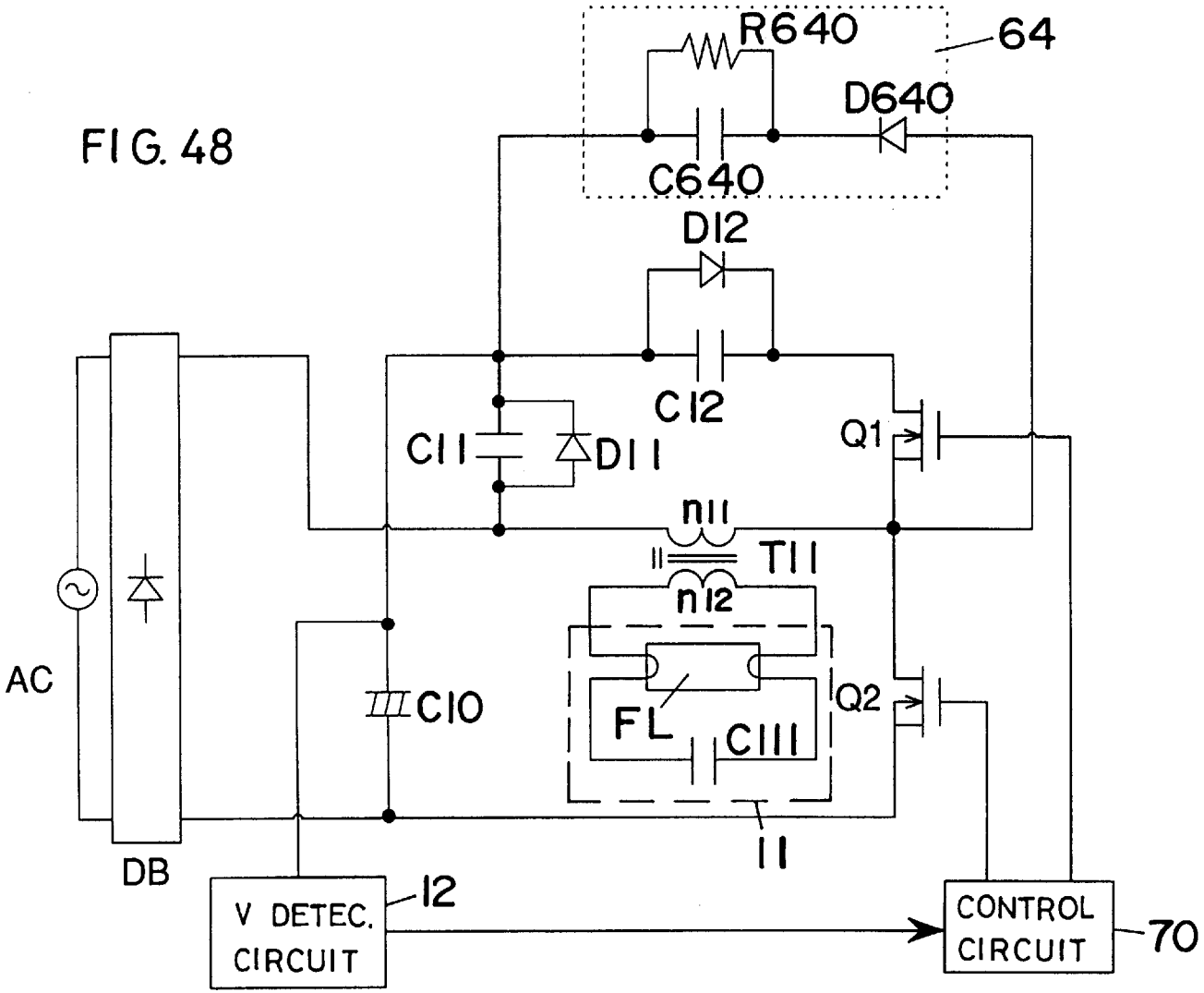

FIG. 48 is a schematic circuit diagram of the discharge lamp lighting device in another embodiment of the present invention, which device is arranged in the same manner as in the embodiment of FIG. 26, except that this device is further provided with a clamp circuit 64 comprising a diode D640 connected at the anode to the junction point between FET's Q1 and Q2, a capacitor C640 connected between the cathode of the diode D640 and the junction point of the capacitors C11 and C12, and a resistor R640 connected in parallel to the capacitor C640.

Also in this embodiment of FIG. 48, similar to the embodiment of FIG. 47, the abruptly voltage increment of the capacitor C12 performing the voltage resonance type operation upon such abnormal condition as the abrupt change in the impedance of the load circuit 11 is clamped at the predetermined voltage value, so that the overvoltage application to the circuit elements can be prevented, and the elements can be prevented from being damaged.

Figure 49:
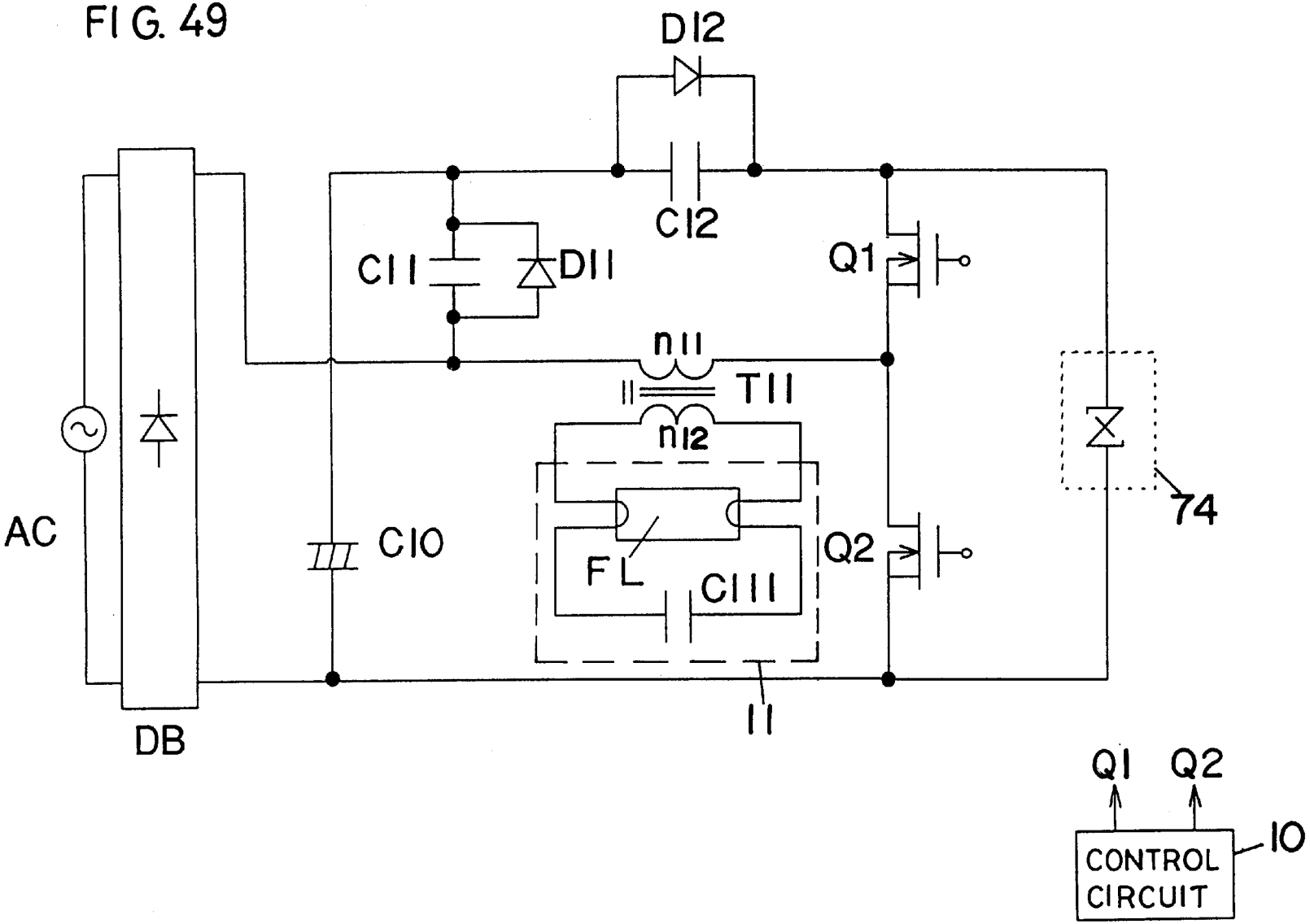

FIG. 49 is a schematic circuit diagram of the discharge lamp lighting device in another embodiment of the present invention, which device comprises the same elements as those in the embodiment of FIG. 1, while the device differs therefrom in the further provision of a clamp circuit 74 connected in parallel to FET's Q1 and Q2.

This clamp circuit 74 includes a circuit-protecting element of an impedance which is higher under a voltage below a predetermined voltage but is varied when the predetermined voltage is reached so as not to allow any higher voltage than that to be applied. In the embodiment of FIG. 49, there is shown a ZNR.

Here, also in the embodiment of FIG. 49, similar to the embodiment of FIG. 43, any overvoltage application to the circuit elements can be prevented by the clamping of the predetermined voltage value upon such abnormal condition as the abrupt change in the impedance of the load circuit 11, and the prevention of damage of the circuit elements is possible.

Figure 50:
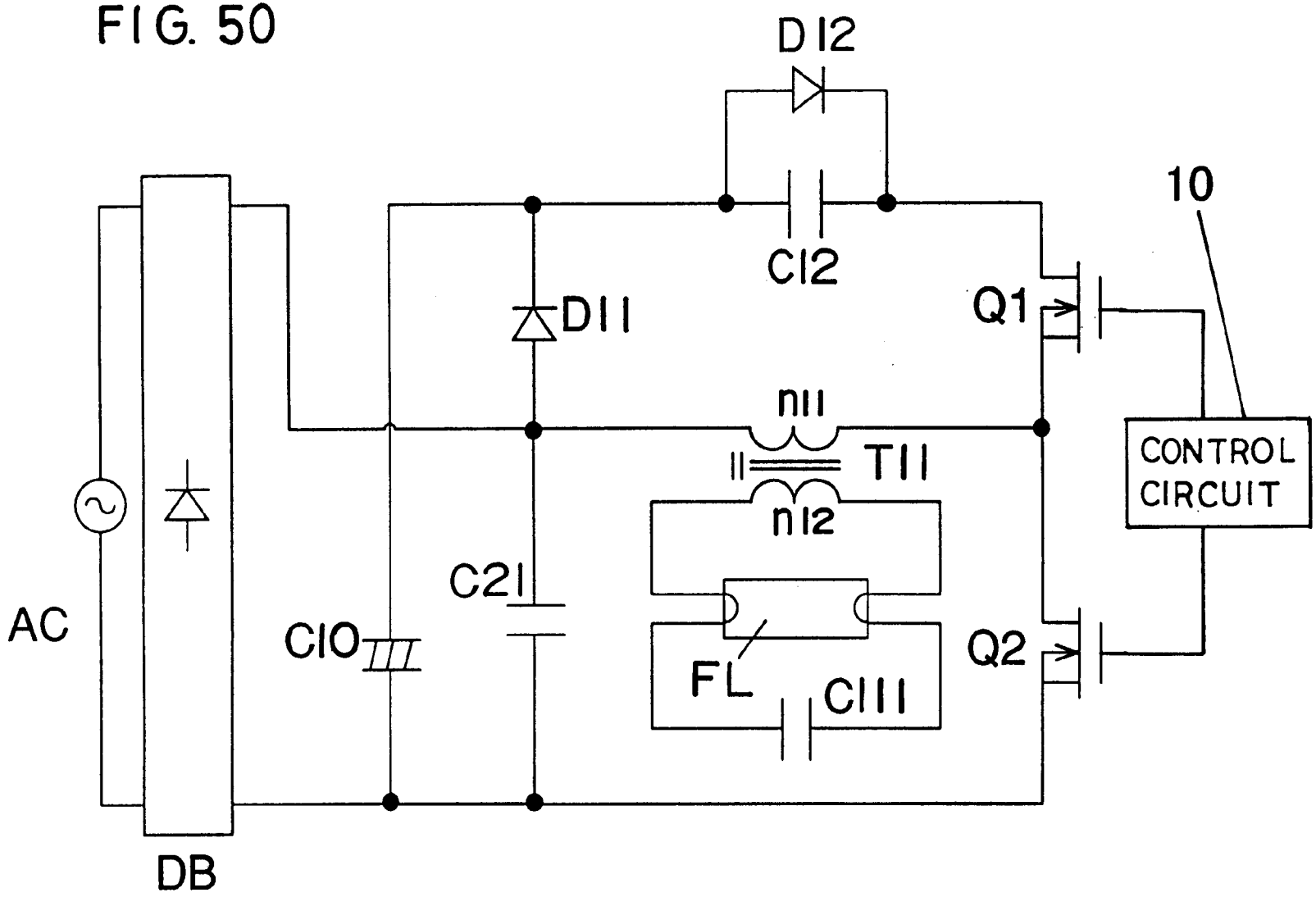
Figure 51:
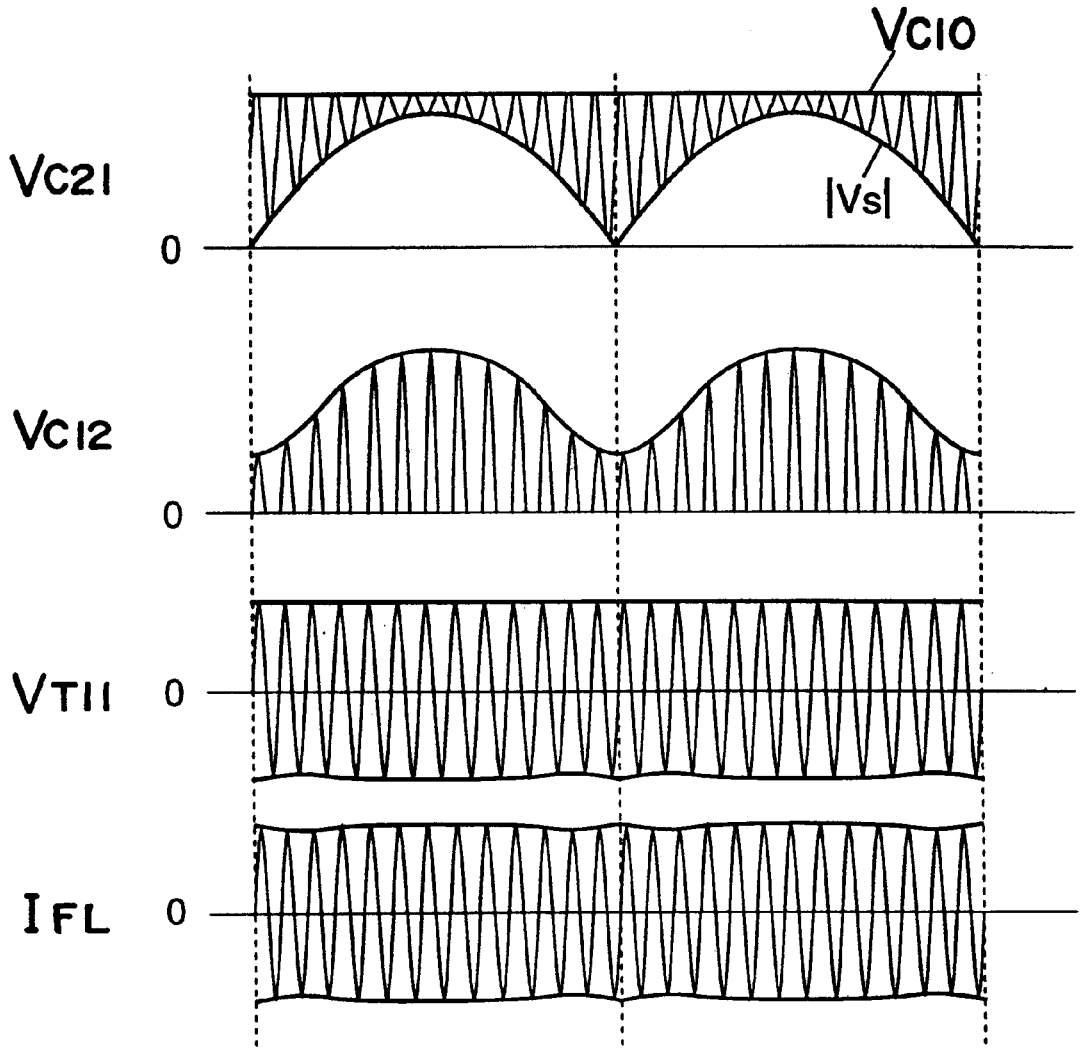
FIG. 51 shows in waveform diagrams respective signals at various parts of the device in the embodiment of FIG. 50.

While in the foregoing various embodiments the capacitor C11 is arranged as connected in parallel to the diode D11, the arrangement is not limited thereto but, as shown in FIG. 50, the capacitor C21 may be arranged as connected between both output terminals of the rectifier DB. The device may be comprised of, for example, the rectifier DB for rectifying the AC power from the AC source AC to the DC power, the diode D11 (first diode) connected at its anode to the positive polarity output terminal of the rectifier DB in forward direction, the smoothing capacitor C10 connected between the cathode of this diode D11 and the negative polarity output terminal of the rectifier DB, the diode D12 (second diode) connected at its anode to the cathode of the diode D11 in forward direction, FET's Q1 and Q2 (a pair of switching elements) connected in series between the cathode of the diode D12 and the negative polarity output terminal of the rectifier DB, the control circuit 10 for the ON/OFF control of FET's Q1 and Q2, the transformer T11 having the primary winding n11 connected between the junction point of FET'S Q1 and Q2 and the positive polarity output terminal of the rectifier DB as well as the secondary winding n12 connected to the load circuit 11, the capacitor C21 (first capacitor) connected across both output terminals of the rectifier DB, and the capacitor C12 (second capacitor) connected in parallel to the diode D12. With this arrangement, as shown in FIG. 51, the voltage VC21 of the capacitor C21 is made to be a voltage waveform clamped by the voltage VC10 of the capacitor C10 and the voltage after rectification of the input voltage Vs. Therefore, as the voltage VT11 such as shown in FIG. 51 is caused to be applied to the primary winding n11 by the voltages VC21 and VC12, a voltage of a substantially constant fluctuation level is to be applied to the transformer T11. As a result, the crest factor of the current IFL flowing to the secondary side load circuit 11 is reduced, and it is possible to accomplish the same effect as in the embodiment of FIG. 1.

Figure 52:
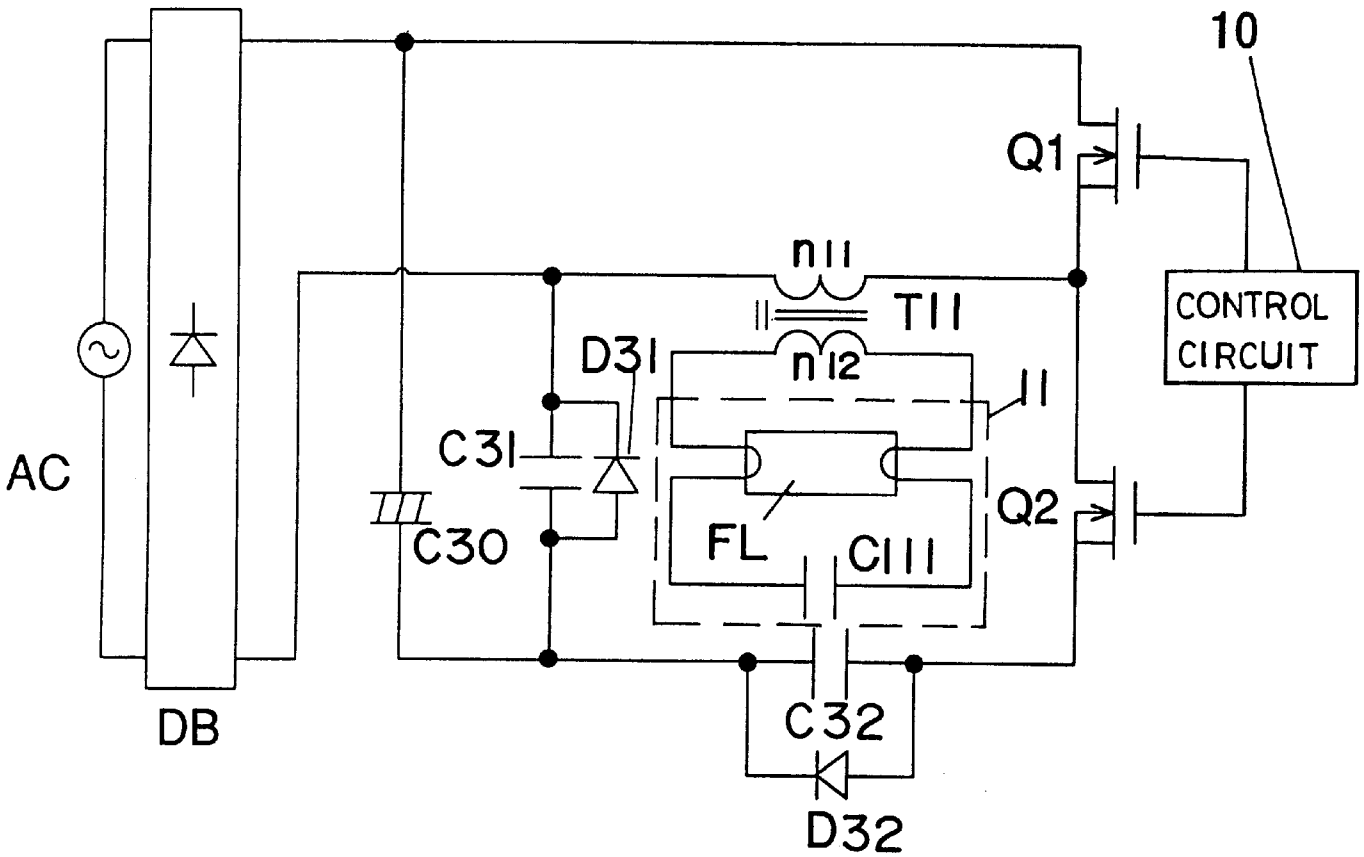
FIG. 52 is a schematic circuit diagram showing another embodiment of the discharge lamp lighting device according to the present invention.

Other than the arrangement shown in FIG. 50, it is of course possible to attain the same effect as in the embodiment of FIG. 1 by arranging the discharge lamp lighting device, as shown in FIG. 52, with the rectifier DB for rectifying the AC power from the AC source AC into the DC power, for example, the diode D31 (first diode) connected at the cathode and in forward direction to negative polarity output terminal of the rectifier DB, the smoothing capacitor C30 connected between the anode of this diode D31 and the negative polarity output terminal of the rectifier DB, the diode D32 (second diode) connected at the cathode and in forward direction to the anode of the diode D31, FET's Q1 and Q2 (a pair of switching elements) connected in series between the anode of the diode D32 and the positive polarity output terminal of the rectifier DB, the control circuit 10 for the ON/OFF control of these FET's Q1 and Q2, the transformer T11 having the primary winding n11 connected between the junction point of FET's Q1 and Q2 and the negative polarity output terminal of the rectifier DB and the secondary winding n12 connected to the load circuit 11, and the capacitors C31 and C32 (first and second capacitors) respectively connected in parallel to the diodes D31 and D32.

Figure 53:
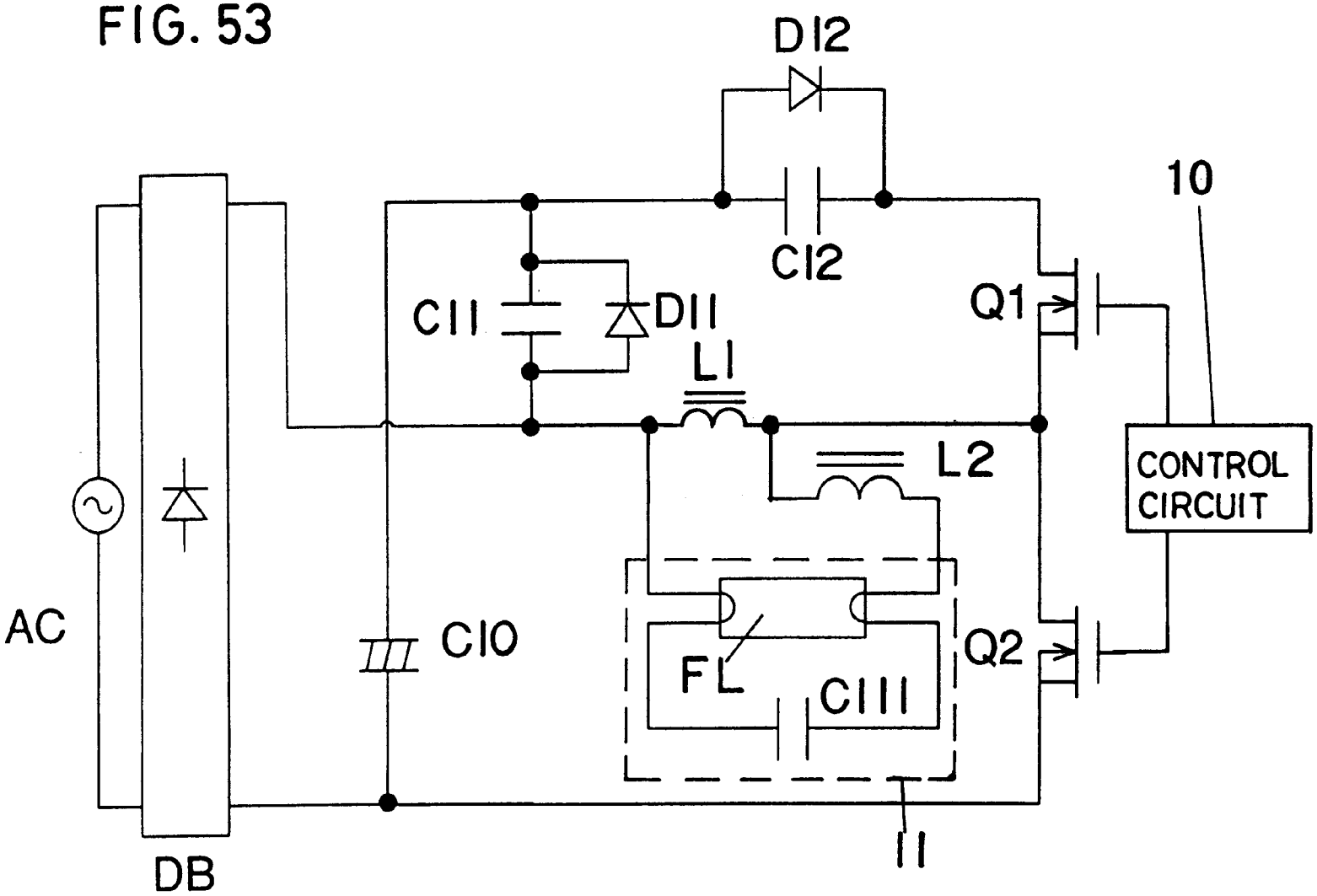
FIG. 53 is a schematic circuit diagram showing another embodiment of the discharge lamp lighting device according to the present invention.

FIG. 53 is a schematic circuit diagram of the discharge lamp lighting device in still another embodiment of the present invention, and this device comprises the same rectifier DB, capacitors C10–C12, diodes D11 and D12, FET's Q1 and Q2 and control circuit 10 as in the embodiment of FIG. 1, while the device is different from the FIG. 1 embodiment in that the load circuit 11 is connected to other circuit parts without using the transformer.

In this case, the inductors L1 and L2 connected to the positive polarity output terminal of the rectifier DB are connected between the filaments of the discharge lamp FL in the load circuit 11, and these inductors L1 and L2 function in the same manner as the primary and secondary windings n11 and n12 of the transformer T11. Other respects of the arrangement and the effect are the same as those in the embodiment of FIG. 1.

Further, this arrangement as in FIG. 53 using the inductors L1 and L2 in place of the transformer T11 may be employed not only in the embodiment of FIG. 1 but also in the respective other embodiments described in the above.

What is claimed is:

1. A discharge lamp lighting device comprising a rectifier for rectifying an AC power into a DC power, first diode connected at one end in forward direction to one of output terminals of the rectifier, a smoothing capacitor connected between the other end of the diode and the other output terminal of the rectifier, second diode connected at one end in forward direction to the other end of the first diode, first and second capacitors connected respectively in parallel to the first and second diodes, a pair of switching elements connected in series between the other end of the second diode and the other output terminal of the rectifier, third and fourth diodes connected respectively in inverse parallel to each of the pair of the switching elements, a load circuit including a discharge lamp, and an inductor element connected between a junction point of the pair of the switching elements and one of the output terminals of the rectifier and across the discharge lamp in the load circuit.

2. A discharge lamp lighting device comprising a rectifier for rectifying an AC power into a DC power, first diode connected at one end in forward direction to one of output terminals of the rectifier, a smoothing capacitor connected between the other end of the first diode and the other output terminal of the rectifier, second diode connected at one end in forward direction to the other end of the first diode, first and second capacitors connected respectively in parallel to each of the first and second diodes, a pair of switching elements connected in series between the other end of the second diode and the other output terminal of the rectifier, third and fourth diodes connected respectively in inverse parallel to each of the pair of the switching elements, and a transformer having a primary winding connected between a junction point of the pair of the switching elements and one of the output terminals of the rectifier and a secondary winding connected to a load circuit including a discharge lamp.

3. A discharge lamp lighting device comprising a rectifier for rectifying an AC power into a DC power, first diode connected at one end in forward direction to one of output terminals of the rectifier, a smoothing capacitor connected between the other end of the first diode and the other output terminal of the rectifier, second diode connected at one end in forward direction to the other end of the first diode, first capacitor connected across both output terminals of the rectifier, second capacitor connected in parallel to the second diode, a pair of switching elements connected in series between the other end of the second diode and the other output terminal of the rectifier, third and fourth diodes connected respectively inverse parallel to each of the pair of the switching elements, and a transformer having a primary winding connected between a junction point of the pair of the switching elements and one of the output terminals of the rectifier and a secondary winding connected to a load circuit including a discharge lamp.

4. The device according to claim 1 which further comprises first inductor connected in parallel to the primary winding of the transformer.

5. The device according to claim 1 which further comprises second inductor connected in series to the secondary winding of the transformer, and the load circuit including the discharge lamp comprises a parallel circuit of the discharge lamp and third capacitor and is connected across the series connected second inductor and secondary winding.

6. The device according to claim 5 wherein the transformer has a leakage inductance component as the second inductor.

7. The device according to claim 1 which further comprises a control means for controlling ON/OFF operation of the pair of the switching elements for a modification of at least one of switching frequency and ON duty ratio of the elements.

8. The device according to claim 1 which further comprises means for controlling ON/OFF operation of the pair of the switching elements by modifying at least one of the switching frequency and ON duty ratio of the elements in response to a voltage fluctuation in the AC power, said control means controlling mainly the ON duty ratio when a rated output is supplied to the load circuit but mainly the switching frequency when the output to the load circuit decreases.

9. The device according to claim 1 which further comprises means for detecting a voltage across the smoothing capacitor, and means for controlling ON/OFF operation of the pair of the switching elements for a modification of at least one of the switching frequency and ON duty ratio of the elements in response to the voltage detected at the voltage detecting means.

10. The device according to claim 1 which further comprises a clamp circuit.

11. The device according to claim 1 which further comprises a capacitor connected in parallel at least in the sense of high frequency at least to one of the pair of the switching elements.

12. The device according to claim 2 wherein one of the switching elements is connected through the primary winding of the transformer across both output terminals of the rectifier, and which further comprises means for controlling ON operation of said one switching element in an event when a voltage at this one switching element is substantially equal to a voltage of the smoothing capacitor.

13. The device according to claim 12 which further comprises means for detecting the voltage across the one switching element connected through the primary winding of the transformer to both output terminals of the rectifier, and means for controlling ON/OFF operation of the pair of the switching elements utilizing the voltage detected by the detecting means.

14. The device according to claim 1 wherein the load circuit includes a discharge lamp having a pair of filaments connected at their one end to both ends of the secondary winding of the transformer, and a third capacitor connected across the other ends of the pair of filaments.

15. The device according to claim 1 wherein the load circuit includes a third capacitor connected across the secondary winding of the transformer, said discharge lamp having a pair of filaments connected at their one end to both ends of the third capacitor, and resonance circuits connected in parallel with the each filament for their preheating.

16. The device according to claim 1 wherein the load circuit has at least two resonance frequencies and at least one antiresonance frequency.

17. The device according to claim 5 wherein the fourth capacitor in the load circuit is connected through the second inductor across the secondary winding, the discharge lamp having a pair of filaments connected at their one end through the third inductor across the fourth capacitor, and a fifth capacitor connected across both other ends of the filaments.

18. The device according to claim 17 wherein the transformer has a leakage inductance component as the second inductor.

19. The device according to claim 1 which further comprises a control means for controlling at least one of switching frequency and duty ratio of the pair of the switching elements so that, in dimmed-lighting the discharge lamp in the load circuit, a DC voltage of the smoothing capacitor will be at a value lower than that in rated-lighting the lamp, whereas, in preceding-preheating a pair of filaments of the discharge lamp, the DC voltage of the smoothing capacitor will be at a value higher than that in the rated-lighting.

* * * * *